US012781312B2

(12) United States Patent
Taheri-Mousavi et al.

(10) Patent No.: US 12,781,312 B2
(45) Date of Patent: Nov. 3, 2026

(54) METHODOLOGIES FOR FORMULATING COMPOSITIONS, INCLUDING ALUMINUM ALLOYS WITH HIGH-TEMPERATURE STRENGTH

(71) Applicant: Massachusetts Institute of Technology, Cambridge, MA (US)

(72) Inventors: Seyedeh Mohadeseh Taheri-Mousavi, Pittsburgh, PA (US); Anastasios John Hart, Waban, MA (US); Greg Olson, Riverwoods, IL (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 19/107,673

(22) PCT Filed: Oct. 30, 2023

(86) PCT No.: PCT/US2023/078228

§ 371 (c)(1),
(2) Date: Feb. 28, 2025

(87) PCT Pub. No.: WO2024/092273

PCT Pub. Date: May 2, 2024

(65) Prior Publication Data

US 2026/0002237 A1 Jan. 1, 2026

Related U.S. Application Data

(60) Provisional application No. 63/487,248, filed on Feb. 27, 2023, provisional application No. 63/381,351, filed on Oct. 28, 2022.

(51) Int. Cl.

| | |
|---|---|
| ***C22C 21/00*** | (2006.01) |
| ***B22F 10/28*** | (2021.01) |
| ***B22F 10/85*** | (2021.01) |

(52) U.S. Cl.
CPC ..... *C22C 21/00* (2013.01); *B22F 10/28* (2021.01); *B22F 10/85* (2021.01); *B22F 2301/052* (2013.01)

(58) Field of Classification Search
None
See application file for complete search history.

(56) References Cited

U.S. PATENT DOCUMENTS

| | | | |
|---|---|---|---|
| 8,778,099 | B2 | 7/2014 | Pandey |
| 11,466,351 | B2 | 10/2022 | Bezencon et al. |

(Continued)

FOREIGN PATENT DOCUMENTS

| | | |
|---|---|---|
| WO | 2019/108596 | 6/2019 |

OTHER PUBLICATIONS

Mochugovskiy, Andrey G., et al. "The mechanism of L12 phase precipitation, microstructure and tensile properties of Al—Mg—Er—Zr alloy." Materials Science and Engineering: A 744 (2019): 195-205.*

(Continued)

*Primary Examiner* — Ryan A Jarrett
(74) *Attorney, Agent, or Firm* — Modern Times Legal; Robert J. Sayre

(57) ABSTRACT

An aluminum alloy with high strength at high temperature includes an aluminum matrix with over 80 molar % aluminum and $L1_2$ precipitate phases having a maximum dimension no greater than 20 nm in the aluminum matrix. The $L1_2$ precipitate phases have a formula of $Al_3M$, wherein M in the $L1_2$ precipitate phases comprises at least one of erbium and zirconium. This alloy and other compositions as well as the processing conditions for producing the compositions can be formulated via a computer-implemented method involving evaluation of material properties of simulated products formed from a plurality of precursor compositions.

10 Claims, 44 Drawing Sheets

(56) References Cited

U.S. PATENT DOCUMENTS

| | | | |
|---|---|---|---|
| 2004/0055671 | A1 | 3/2004 | Olson et al. |
| 2010/0143177 | A1 | 6/2010 | Pandey |
| 2018/0082044 | A1* | 3/2018 | Reed ..... C22C 19/057 |
| 2020/0210635 | A1 | 7/2020 | Washburn et al. |
| 2020/0257933 | A1 | 8/2020 | Steingrimsson et al. |
| 2021/0207249 | A1 | 7/2021 | Guo et al. |

OTHER PUBLICATIONS

M.T. Perez-Prado, et al., "An Al—5Fe—6Cr Alloy with Outstanding High Temperature Mechanical Behavior by Laser Powder Bed Fusion," 55 Additive Manufacturing 102828 (2022).

* cited by examiner

Pearson Coefficients for Linear Correlation

| | Ni | Er | Zr | Y | Yb | $L1_2$ | Diffusion resistivity | Misfit ε | Coarsening metric |
|---|---|---|---|---|---|---|---|---|---|
| Ni | 1.00 | | | | | | | | |
| Er | -0.24 | 1.00 | | | | | | | |
| Zr | -0.24 | -0.24 | 1.00 | | | | | | |
| Y | -0.24 | -0.24 | -0.24 | 1.00 | | | | | |
| Yb | -0.24 | -0.24 | -0.24 | -0.24 | 1.00 | | | | |
| $L1_2$ | -0.43 | 0.92 | -0.04 | -0.32 | -0.06 | 1.00 | | | |
| Diffusion resistivity | -0.03 | -0.23 | 0.78 | -0.18 | -0.35 | -0.07 | 1.00 | | |
| Misfit ε | 0.00 | 0.00 | -0.01 | 0.00 | 0.00 | -0.00 | -0.01 | 1.00 | |
| Coarsening metric | 0.04 | 0.23 | -0.77 | 0.17 | 0.34 | 0.07 | -0.96 | 0.22 | 1.00 |

METHODOLOGIES FOR FORMULATING COMPOSITIONS, INCLUDING ALUMINUM ALLOYS WITH HIGH-TEMPERATURE STRENGTH

BACKGROUND

The discussion of the background state of the art, below, may reflect hindsight gained from the disclosed invention(s); and these characterizations are not necessarily admitted to be prior art.

Precipitation-hardened alloys, including nickel/cobalt (Ni/Co)-based superalloys and lightweight aluminum (Al), titanium (Ti), and magnesium (Mg) alloys, are used widely in the aviation, space, automotive, and biomedical sectors. These alloys exhibit high strength, as precipitates impede the motion of dislocations which are the fundamental carriers of plastic deformation. There is, however, a maximum threshold for strength enhancement due to the trade-off between the fine size and high-volume fraction of precipitates, diminishing the strengthening contribution that can be achieved based on the Orowan strengthening theory [see Mittemeijer, E. J., Fundamentals of Materials Science: the microstructure-property relationship using metals as model systems, 754 (2010)]. Moreover, in casting, slow solidification further limits the incorporated volume fraction of heavy precipitates due to macro segregation. As a result, the realization of cast Al alloys with high-temperature strength is extremely limited and applications such as fan blades of jet engines or pistons of combustion engines often rely on costly and/or heavy Ti or steels.

Alloy design for additive manufacturing (AM) and other modes of rapid solidification is challenging because of the difficulty of devising compositions that achieve the desired mechanical performance and that are compatible with the rapid solidification conditions typical of additive manufacturing. For example, although aluminum (Al) alloys are the second most widely used alloys in all industries following steels, only a handful of high-strength Al alloys have shown to be compatible with additive manufacturing, including the high-temperature alloys described in the following publications: the published international patent application of Gong, et al., WO 2019/108596 A1; the inoculated alloy of Martin, et al., "3D printing of high-strength aluminium alloys," 549 Nature 365-369 (2017); the alloy described in Pérez-Prado, et al., "An Al-5Fe-6Cr alloy with outstanding high temperature mechanical behavior by laser powder bed fusion" 55 Addit. Manuf. 102828 (2022); the scandium, aluminum, and magnesium alloy sold as SCALMALLOY alloy from APWORKS (a subsidiary of Premium AEROTEC, part of AIRBUS GROUP); and the alloy described in Xue, et al., "Highly stable coherent nanoprecipitates via diffusion-dominated solute uptake and interstitial ordering," 4 Nat. Mater. 434-441 (19 Dec. 2022). The SCALMALLOY alloy and the alloy described in Xue, et al. are costly due to the inclusion of scandium. In contrast to the alloy of Gong, et al., the strength of other known printable aluminum alloys drops significantly at elevated temperatures (typically 250-400° C.). Aluminum alloys with improved high-temperature strength would find wide applications such as fan blades of jet engines, vacuum pump rotors, or pistons of combustion engines.

The rapid solidification during laser-based AM also provides new opportunities through non-equilibrium processing pathways that cannot be explored with conventional processing such as casting, giving rise to unique microstructural features. Moreover, layer-wise melting circumvents the challenges of macro-segregation that occur during casting. Thus, there is an opportunity for a new class of high-temperature strengthened Al alloys to replace the currently limited alloys in high-temperature applications.

SUMMARY

An aluminum alloy, a method for its manufacture, its precursor composition, and a method and software for formulating compositions, such as the aluminum alloy, are described herein, where various implementations of the compositions and methods may include some or all of the elements, features, and steps described below.

An aluminum alloy with high strength at high temperature includes an aluminum matrix with a majority concentration (over 80 or 90 molar %) aluminum and $L1_2$ precipitate phases having a maximum dimension no greater than 20 nm (e.g., in a range from 16-20 nm) in the aluminum matrix. The $L1_2$ precipitate phases have a formula of $Al_3M$, wherein M in the $L1_2$ precipitate phases comprises at least one of erbium and zirconium. The "$Al_3M$" designation represents the fully saturated version of this composition, though, in practice, the "$Al_3M$" designation can represent a slightly modified ratio of the Al and M and should be interpreted to also cover such less-than-fully saturated embodiments.

More specifically, the aluminum alloy can comprise the following elements at the following molar percentages: $x_{Al}$=at least 80 molar % aluminum; $x_{Ni}$=up to 2 molar % nickel (e.g., in the form of $Al_3Ni$ precipitate in the aluminum matrix); $x_{Zr}$=0.1 to 1.5 molar % zirconium; and $x_{Er}$=0.1 to 1 molar % erbium, wherein $x_{Er} \leq x_{Zr}$. Even more specifically, particular exemplifications of the aluminum alloy comprise the following elements at the following molar percentages: $x_{Al}$=at least 80 molar % aluminum; $x_{Ni}$=1.204 to 1.332 molar % nickel; $x_{Zr}$=0.393 to 0.401 molar % erbium; and $x_{Er}$=0.894 to 1.005 molar % zirconium.

Additionally, the aluminum alloy can further comprise at least one of yttrium and ytterbium (e.g., both yttrium and ytterbium in a molar concentration of up to 0.1% or up to 1% in the aluminum alloy). Further, the aluminum alloy can further comprise additional $L1_2$ phases including scandium (Sc), thulium (Tm), lutetium (Lu), uranium (U), and/or neptunium (NP).

The aluminum alloy, because of its composition and structure, can be fabricated, even at large scale (having multi-cm or greater dimensions) without hot cracking. The aluminum alloy can have a surface hardness along its built direction of more than 150 HV, and it can retain that surface hardness after at least 8 (or more) hours of aging at 400° C. The aluminum alloy can have a yield strength of at least 400 MPa.

In a method for fabricating an aluminum alloy, a precursor composition (that can have the same, or substantially the same, elemental composition as the overall elemental composition of the produced aluminum alloy, described above) is heated to an elevated temperature above a solvus temperature at which the precursor composition is liquefied. The precursor composition is cooled from the elevated temperature at a cooling rate of at least 100 K/s to precipitate ternary phases having a formula of $Al_xNi_yM_z$ in an aluminum matrix comprising over 80% aluminum via rapid solidification. The aluminum alloy is then aged at a temperature below the solvus temperature to form $L1_2$ phases having a formula of $Al_3M$ from the ternary phases to produce the optimized aluminum alloy, wherein M in both the ternary phases and the $L1_2$ phases comprises erbium and zirconium, and wherein the $L1_2$ phases have dimensions no greater than 20 nm after aging the aluminum alloy.

The precursor composition can be provided as a powder, and the method can further include repeatedly depositing successive layers of the precursor composition powder, wherein selected locations of each layer are heated to the elevated temperature with a laser or an electron beam to form the ternary phase in the selected locations before the next layer of the precursor composition powder is deposited. In other exemplifications, the precursor composition can be deposited and heated to the elevated temperature via directed energy deposition. In still other exemplifications, the precursor composition is deposited and heated to the elevated temperature using a welding process, wire arc additive manufacturing, wire laser additive manufacturing, splat quenching, or giga casting.

A computer-implemented method for formulating a composition and processing parameters includes obtaining a set of rules that define formation of phases, compositions, and microstructure features when forming a product composition from a precursor composition. The rules utilize or generate values for the following: parameters according to which the precursor composition is processed, a coarsening metric reflecting a rate of phase growth based on precursor composition and the processing parameters, combined diffusivity of elements across the precursor composition and phases formed therefrom, misfit strain produced by misalignment of crystalline structures at phase interfaces, and volume fraction of phases during solidification and in as-built and aged conditions, and a coarsening metric. The set of rules includes evaluation of combined diffusivity across the precursor composition and phases formed therefrom and evaluation of misfit strain. A computing device (e.g., a single computing device or a network of computers) is used apply calculation-of-phase-diagram-(CALPHAD) based integrated-computational-materials-engineering (ICME) methods combined with machine-learning techniques to simulate production of product compositions from a plurality of different precursor compositions using the set of rules and evaluating a combination of material properties of the product compositions. Based on the evaluated material properties, a selected precursor composition with an optimized value for the combination of material properties is identified; and an output identifying the selected precursor composition with the optimized value for the combination of material properties is generated.

The material properties can include some or all of the following: coarsening metric, strength, crack- or defect-free manufacturing, high-temperature strength, microstructural stability at high temperature, creep resistance, and ductility. In additional exemplifications, this methodology can be applied to optimize other parameters or other alloy compositions or compositions formed of other materials (e.g., ceramic compositions) and can be used for other fabrication techniques.

After the selected precursor composition is identified, a tangible embodiment of the precursor composition can be formed that substantially matches the selected precursor composition identified in the above methodology.

Further, in addition to varying the precursor compositions, different processing conditions can be fed into the CALPHAD ICME methods in the simulated production of product compositions to optimize the processing conditions. The processing conditions can include processing and aging time and temperature (when processing the precursor composition to produce the product composition) and/or variability of processing environments and conditions (e.g., where the producer of the precursor composition may not formulate the composition exactly to specification—e.g., with a margin of error of 5 or 10 percent of specified element concentrations, or where environmental conditions may vary in the processing environments).

The computing device, in performing its evaluation, can use at least one technique selected from a convolutional neural network, K-nearest-neighbors, support vector machine, random forest, extreme gradient boost, and linear regression.

The method can also include using the computing device to apply inverse design techniques, such as particle swarm optimization and/or Bayesian optimization, to work backward from targeted material properties to select at least one of a precursor composition and processing parameters for producing a product composition that possesses the targeted material properties.

A non-transitory computer-readable medium stores instructions for performing the above-described computer-implemented methods.

Herein, we show that triggering nanoprecipitation of metastable phases forming due to rapid solidification processing, such as in laser-based powder bed fusion (LPBF) can realize high-temperature strength aluminum alloys, solving the tradeoff dilemma and macro segregation simultaneously. We combined the use of machine learning (ML) and calculation of phase diagram (CALPHAD)-based integrated computational materials engineering (ICME) methods to assist in designing the composition of an optimized aluminum (Al) alloy (Al—Er—Zr—Y—Yb—Ni, where Er=erbium, Zr=zirconium, Y=yttrium, Yb=Ytterbium). In this optimized alloy, $L1_2$ phases precipitate initially as nano metastable ternary phases (Al—Ni—M, M=Er, Zr, Y, and/or Yb) during rapid solidification and then form the $L1_2$ phase due to phase transformation during aging. We also considered minimization of $L1_2$ coarsening rates in the design to ensure strength stability at high temperatures. Exploiting solely the nanoprecipitation strategy, the strength of 3D printed samples from the designed composition is comparable to that of wrought 7075 aluminum alloy and, after thermal aging, is five times higher than its cast counterpart and exceeds that of 7075 aluminum alloy as well as that of a benchmark printable aluminum alloy referred to herein as "alloy 1" by 50%. This methodology for precipitation strengthening is applicable to a wide range of alloys and rapid solidification processes, and our hybrid ML/CALPHAD numerical framework can be used in the efficient and robust design of alloy microstructures to expand the capabilities of additive as well as traditional manufacturing.

The following Detailed Description references the accompanying drawings which form a part of this application, and which show, by way of illustration, specific example implementations. Other implementations may be made without departing from the scope of the disclosure.

Figure 1:
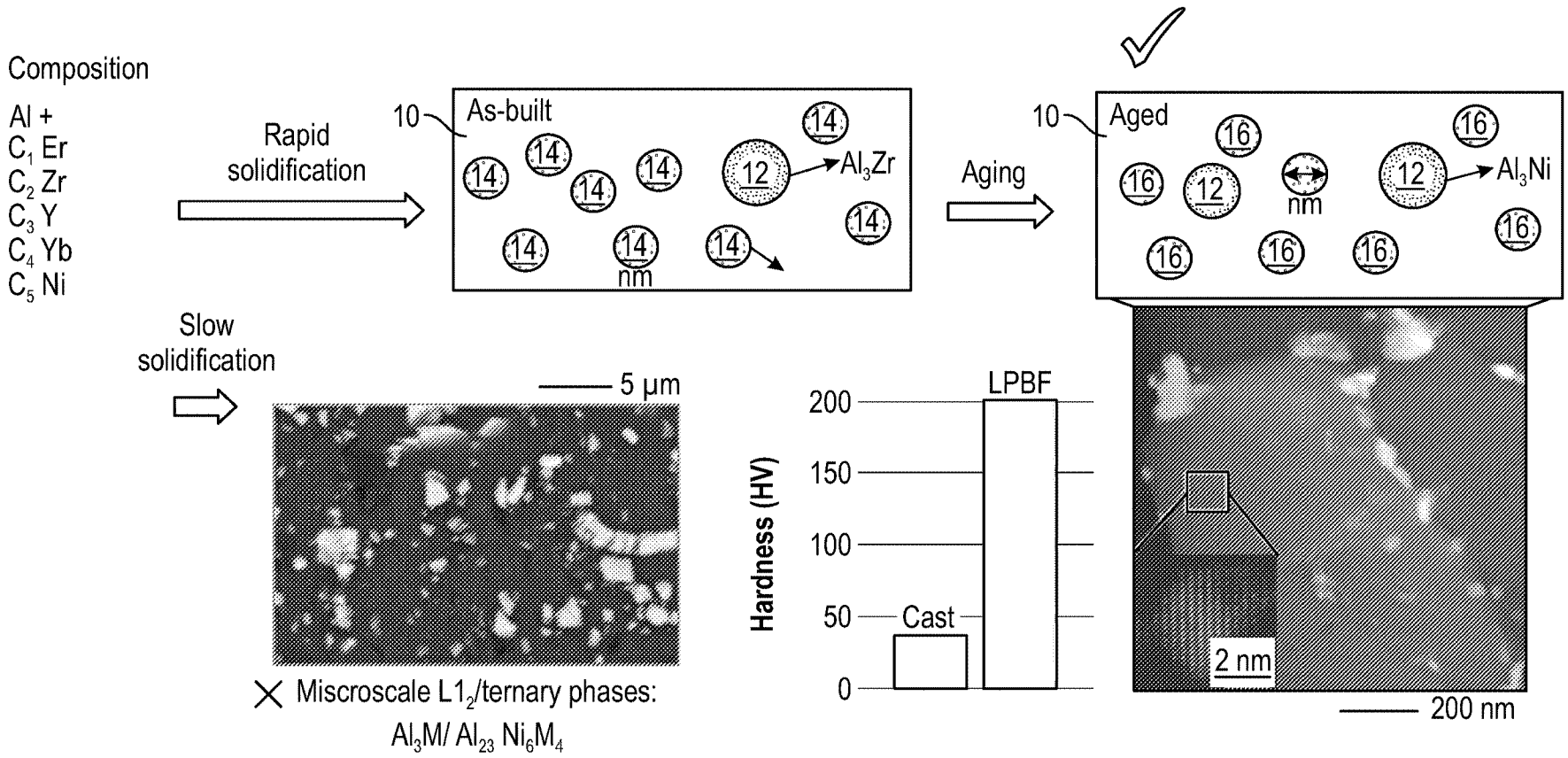
FIG. 1. illustrates an alloy design concept showing how the exploitation of nanoscale metastable phases due to rapid solidification transforms the length scales of the hardening phase from micro to nanoscale. Transmission electron microscopy (TEM) images show nanoprecipitation of $L1_2$ phases on grain boundaries, wherein the inset in the image at lower right shows inside grain interiors. The Vickers hardness of two processing conditions (cast and laser-based powder bed fusion) are also compared.

In the accompanying drawings, like reference characters refer to the same or similar parts throughout the different views. The drawings are not necessarily to scale; instead, an emphasis is placed on illustrating particular principles in the exemplifications discussed below. For any drawings that include text (words, reference characters, and/or numbers), alternative versions of the drawings without the text are to be understood as being part of this disclosure; and formal replacement drawings without such text may be substituted therefor.

DETAILED DESCRIPTION

The foregoing and other features and advantages of various aspects of the invention(s) will be apparent from the following, more particular description of various concepts and specific implementations within the broader bounds of the invention(s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise herein defined, used, or characterized, terms that are used herein (including technical and scientific terms) are to be interpreted as having a meaning that is consistent with their accepted meaning in the context of the relevant art and are not to be interpreted in an idealized or overly formal sense unless expressly so defined herein. For example, if a particular composition is referenced, the composition may be substantially (though not perfectly) pure, as practical and imperfect realities may apply; e.g., the potential presence of at least trace impurities (e.g., at less than 1 or 2%) can be understood as being within the scope of the description. Likewise, if a particular shape is referenced, the shape is intended to include imperfect variations from ideal shapes, e.g., due to manufacturing tolerances. Percentages or concentrations expressed herein can be in terms of weight or volume. Processes, procedures, and phenomena described below can occur at ambient pressure (e.g., about 50-120 kPa—for example, about 90-110 kPa)

and temperature (e.g., −20 to 50° C.—for example, about 10-35° C.) unless otherwise specified.

The term, "about," can mean within +10% of the value recited; and "substantially matches" or similar language can mean within 90% or 95% of the recited values, fractions, percentages, concentrations, etc. In addition, where a range of values is provided, each subrange and each individual value between the upper and lower ends of the range is contemplated and therefore disclosed.

Some of the terminology used herein is for the purpose of describing particular implementations and is not intended to limit more generic exemplifications of the invention. As used herein, singular forms, such as those introduced with the articles, "a" and "an," are intended to include the plural forms as well, unless the context indicates otherwise. Additionally, the terms, "includes," "including," "comprises" and "comprising," specify the presence of the stated elements or steps but do not preclude the presence or addition of one or more other elements or steps.

The solidification rates of, e.g., laser- or electron-beam powder-bed additive manufacturing (AM) are orders-of-magnitude higher than conventional casting (104-106 versus 1-10 K/s). When undergoing such rapid solidification, most conventional alloys that are designed for slow solidification must compromise attributes, e.g., grain or phase structures that would give rise to enhanced properties. Moreover, rapid solidification ordinarily tends to introduce cracks, such as via hot cracking due to large thermal gradients; and alloys become nonprintable. For example, although aluminum (Al) alloys are only surpassed by steels in their total usage, only a handful of high-strength aluminum alloys have been shown to be additively manufacturable (see FIGS. 1-3). This challenge exists as well in welding, large-scale rapid casting of, e.g., sub-10-mm thickness structures (referred to as "giga casting"), and splat quenching with the processing conditions leading to rapid solidification. These non-equilibrium processing pathways, however, can also give rise to unique microstructural features, such as metastable phases or extremely refined grains, phases, and dendrite arms, which cannot be achieved easily, if at all, in slow solidification conditions. Metastable phases due to rapid solidification have been reported in nickel (Ni), iron (Fe), titanium (Ti), and aluminum (Al) alloys and contribute to or diminish their mechanical properties. Layer-wise melting in certain additive manufacturing processes also circumvents the challenges of macro-segregation of heavy precipitates in less-dense matrices, which commonly occurs during casting. Exploiting these unique characteristics and microstructural features can unravel new routes for alloy design. For example, there is an opportunity for a new class of coveted high-temperature strength aluminum alloys to emerge and replace the currently limited alloys in high-temperature applications (typically 250-400° C.).

A commonly used alloy design strategy for strengthening, particularly in lightweight and single-crystal alloys, is introducing new phases in the crystal to impede dislocation motion. This strategy is advantageous in additive manufacturing alloys as they do not undergo forging or rolling, which are effective post processing for the enhancement of the strength after casting. It is generally advantageous to minimize the size and maximize the volume fraction of precipitates to hinder dislocation motions and thus enhance the strength based on the Orowan strengthening theory (see Mittemeijer, E. J., Fundamentals of Materials Science: The Microstructure-Property Relationship Using Metals as Model Systems, 754 (2010). However, as the percentage of precipitates goes higher, the size of the precipitates increases; and there is a threshold strength that cannot be surpassed. Here, we show that exploiting nano-scale metastable phases in rapid solidification can overcome this tradeoff, providing new pathways to employ unprecedented contributions of precipitates for strengthening (see FIG. 1). We showcase our approach by designing and realizing a printable high-strength aluminum alloy with microstructural stability at high temperatures.

As shown in FIG. 1, the precursor composition (at left) is heated, e.g., to 1,000° C. (or in some cases, up as high as 1,200° C., to liquefy the composition. Upon rapid cooling (e.g., at a rate, e.g., of at least 100 K/s, which is substantially faster than the cooling rate with conventional metal casting), the composition is rapidly solidified, forming an aluminum matrix 10 having a majority aluminum content of, e.g., at least 80 molar % or even at least 90 molar % (molar % and atomic % are used interchangeably herein); precipitates 12 (e.g., in the form of $Al_3Zr$, and $Al_3NI$); and a metastable ternary phase 14 with the formula, e.g., of $Al_{23}Ni_6M_4$, where M=Er, Zr, Y, and Yb.

A rapid cooling rate of, e.g., 100° C. to 1,000° C. can be achieved when casting thin layers (e.g., 3-10 mm thick) of metals in, for example, the giga casting process performed by Tesla, Inc., wherein the majority of an automobile frame can be rapidly cast as a thin alloy layer as a single unitary cast structure, which enables more efficient fabrication and structural strength. Higher cooling rates can be generated [e.g., 103-106 K/s (or ° C./s)] for other fabrication techniques that can be used, such as laser- or electron-beam powder-bed additive manufacturing, direct energy deposition, welding, wire arc additive manufacturing, wire laser additive manufacturing, and splat quenching.

After cooling the composition to room temperature (e.g., 20-25° C.), the composition can be subject to an aging process. By aging the composition at an elevated temperature (e.g., at 100-550° C. or, more specifically, at 250-400° C.) for, e.g., 8 hours, $L1_2$ crystalline phases 16 having a formula of $Al_3M$, where M is zirconium and/or erbium, are formed from the metastable ternary phases 14. These $L1_2$ phases remain very fine and do not substantially increase in size (in terms of dimensions or diameter) during the aging process or in use at elevated temperatures (e.g., at 250-400° C.) below their solvus temperature.

Forming the metastable ternary phases first and then forming the $L1_2$ phases at lower temperatures therefrom can prevent significant growth and settling of the $L1_2$ phases.

The main precipitates that contribute to strengthening in aluminum alloys are the $L1_2$ phases. In the optimized alloys described herein, the $L1_2$ phases have a formula of $Al_3M$, wherein M in the $L1_2$ precipitate phases comprises at least one of erbium and zirconium, though other compositions can be used in the fabrication of other materials. In exemplifications described herein, we made a model aluminum alloy system by selecting elements from the periodic table based on their potential ability to form $L1_2$ and metastable phases, their solubility and mobility in the aluminum matrix, their cost, and having control properties to which we can compare our design. We thus chose the Al—Er—Zr—Y—Yb—Ni alloy system, for which the room- and high-temperature strengths at different aging times have been reported. We find that rapid solidification during laser-based powder bed fusion of certain compositions of this system triggers nano-scale precipitation of metastable ternary phases (Al—Ni—M, where M=Er, Zr, Y, Yb). These metastable phases enable nanoscale solid-state precipitation of equilibrium $L1_2$ phases during aging at elevated temperatures (FIG. 1), preserving high strength. As seen, slower solidification via induction melting leads to micro-scale ternary or/and $L1_2$ phases and a hardness that is just $1/5^{th}$ of that obtained with rapid solidification.

Figure 3:
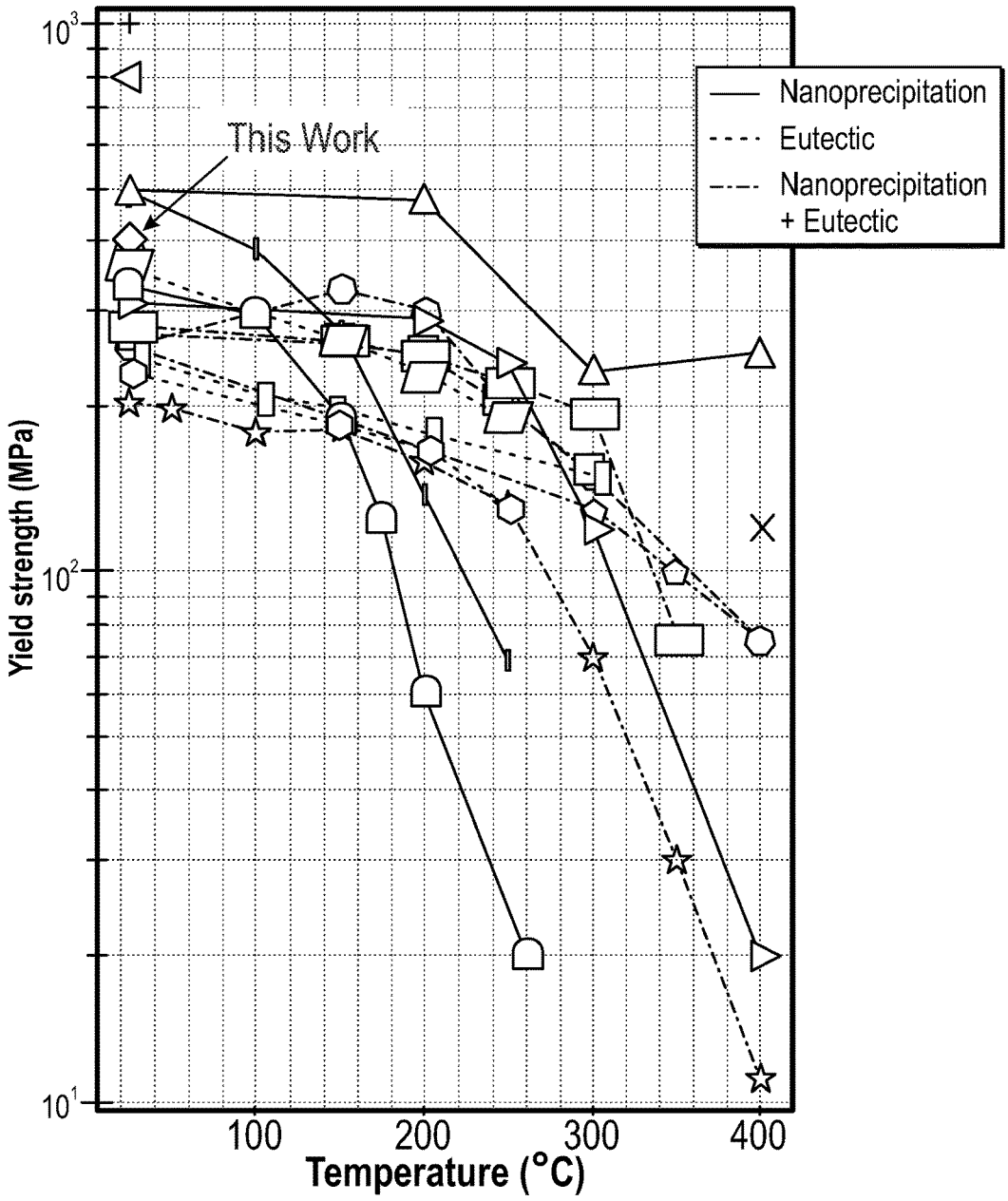
FIG. 3 plots the yield strength-temperature relationship for currently available high-strength cast (wrought 7075 aluminum alloy, Al—Cu, Al—Cu—Si, Al—Ni, Al—Ni—Cr, Al—Ni—Fe, and Al—Ce—Mn) and additive manufacturing [this work, Al—Mg—Zr, Al—Mg—Si—Sc—Zr, Al—Cu—Mg—Ag—Sc, 7075 aluminum alloy+Zr nanoparticles, SCALMALLOY alloy, Al—Er—Zr—Y—Yb, Al—Si—Mg, Al—Cu—Ce—Zr, Al—Ce—Ni—Mn, Al—Cu—Mn—Zr—Fe—Si, and Al—Er—Zr—Y—Yb ("alloy 1")]. Al alloys. The alloys are classified by line type based on the employed strategies for strengthening.
Figure 3:
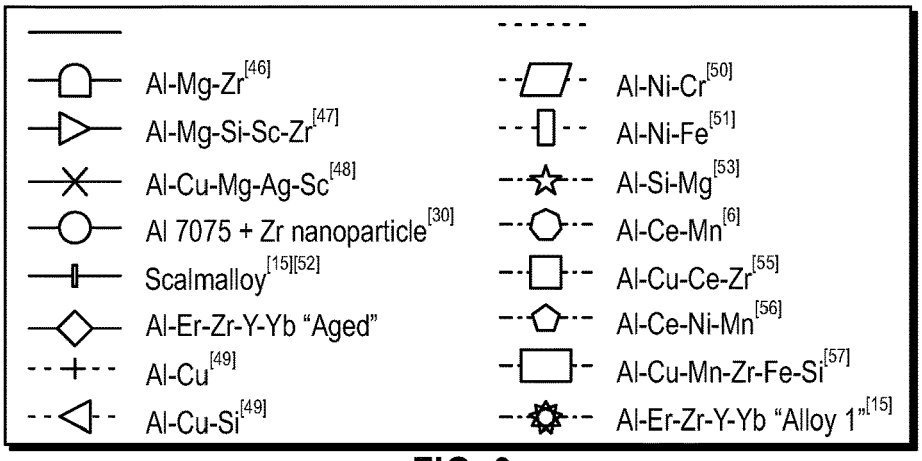
Figure 4:
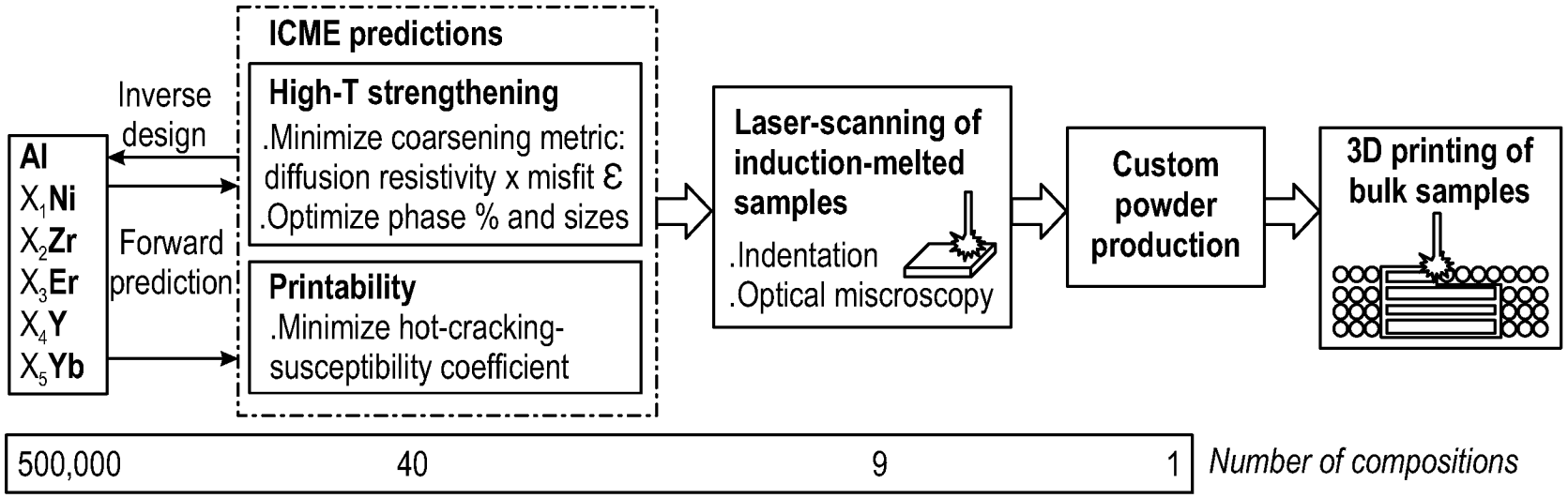
FIG. 4 illustrates the combined numerical and experimental workflow of our design. We started from 500,000 random data. Using various machine-learning and inverse design algorithms and 40 sampling data, we down-selected 9 compositions. The prediction considered both the performance (high-temperature (T) strengthening) and printability of the design. The printability and hardness of nine laser-scanned induction-melted compositions were analyzed in the next step, and one composition was down-selected. A custom alloy from a selected composition was developed, and the sample was 3D-printed. The hardness of the sample was measured at different aging hours.

To devise the alloy, we defined the microstructural features, e.g., the volume fraction and size of phases in the as-built and aged conditions, that contribute to our target properties. We then prioritized the objectives and set the constraints for the elemental composition accordingly (see FIGS. 3 and 4). We combined integrated computational materials engineering and machine-learning (ML) techniques in a hybrid approach and performed an inverse design of the optimal composition respecting all the constraints (FIGS. 6 and 11-16). The use of integrated computational materials engineering (ICME) and ML techniques has enabled significant progress in material design, specifically for additive manufacturing in recent years. For our problem, the combination facilitated exploration of the entire five-dimensional design space of Al—Ni—Zr—Er—Y—Yb and the discovery of a global extremum, which was a composition predicted to undergo crack-free solidification during laser-based powder bed fusion (and other rapid solidification techniques) and for which all $L1_2$ phases precipitate initially in ternary phases; and other phases are optimized as well. In addition, in this compositional space, the $L1_2$ phases have their minimum coarsening rates at 250° C.; and a coarsening rate that is lower than the coarsening rate of the benchmark alloy 1 by a factor of 3.5×. We generated 500,000 data points, and our most-efficient machine-learning algorithm (neural network) needed 40 data samples for this design (FIGS. 31-76). We then down-selected nine compositions for experimental validation (FIG. 4).

Figure 2:
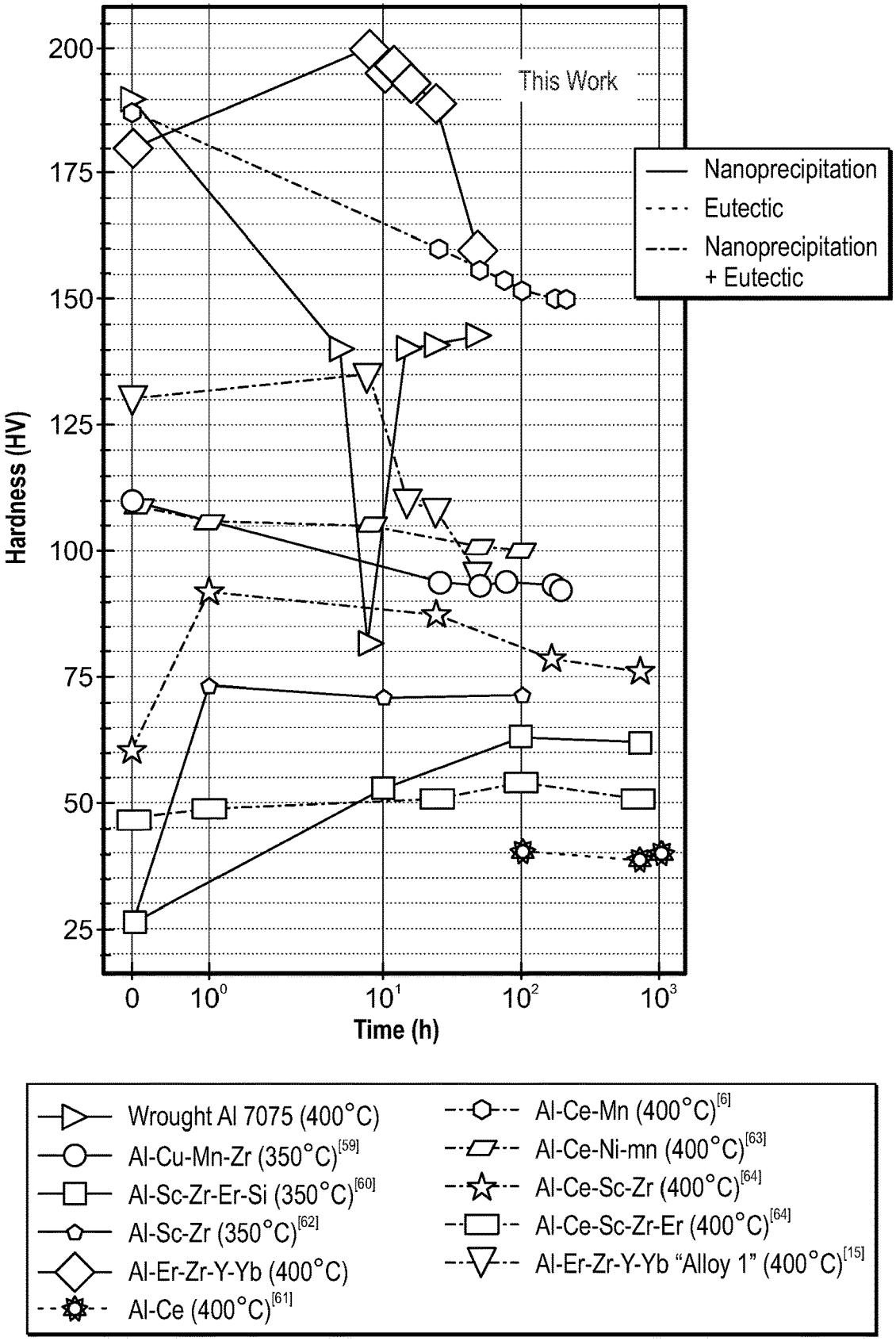
FIG. 2 plots the hardness of our machine-learning-optimized samples at different aging hours (represented as time, along the x axis) at 400° C. The hardness of the benchmark 3D-printed Al alloy ("alloy 1") from Gong, et al., and wrought 7075 aluminum alloy at identical aging conditions are also plotted. Room-temperature hardness tests after various aging hours for currently available high-strength cast [wrought 7075 aluminum alloy (400° C.), Al—Cu—Mn—Zr (350° C.), Al—SC—Zr—Er—Si (350° C.), Al—Sc—Zr (350° C.), Al—Ce—Sc—Zr (400° C.), and Al—Ce—Sc—Zr—Er (400° C.)] and additive manufacturing [this work (described herein), Al—Ce—Mn (400° C.), Al—Er—Zr—Y—Yb ("alloy 1," 400° C.), and Al—Ce—Ni—Mn (400° C.)] Al alloys are also plotted. The alloys are classified by line type based on the employed strategies for strengthening [i.e., solid for nanoprecipitation, dotted for eutectic, and the dash-dot sequence for the combination of nanoprecipitation and eutectic].
Figure 5:
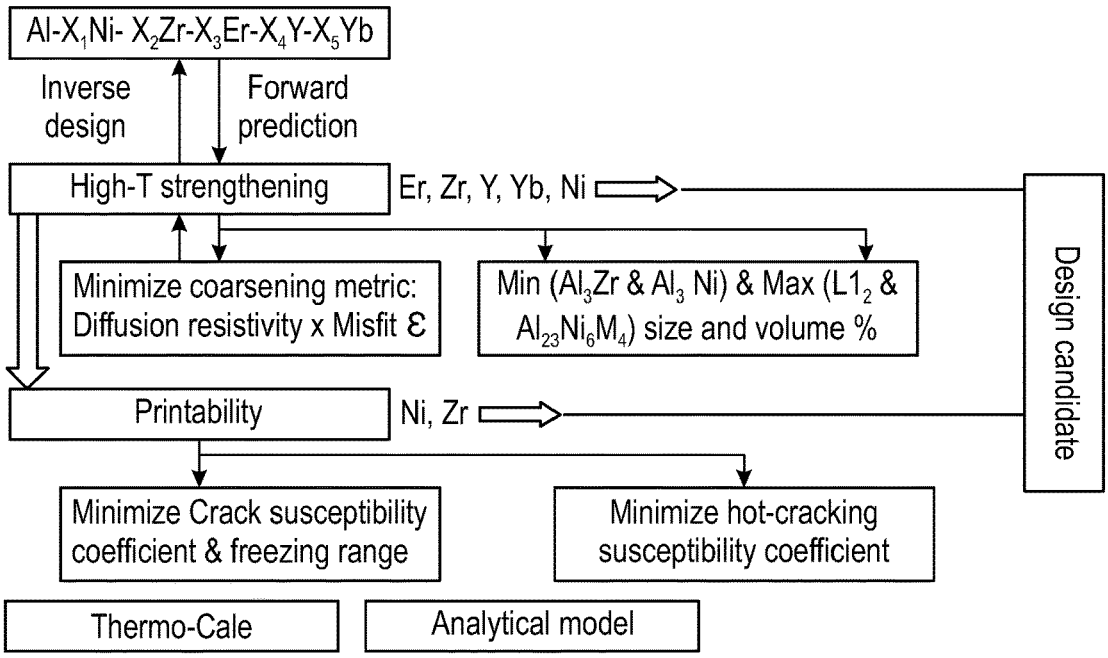
FIG. 5 is a flow diagram with design approaches for measuring structure parameters. The composition is inversely designed for the primary goal of minimizing the coarsening metric of $L1_2$ phases. All other microstructural features are forward predicted and work as constraints for the inversely designed composition.
Figure 6:
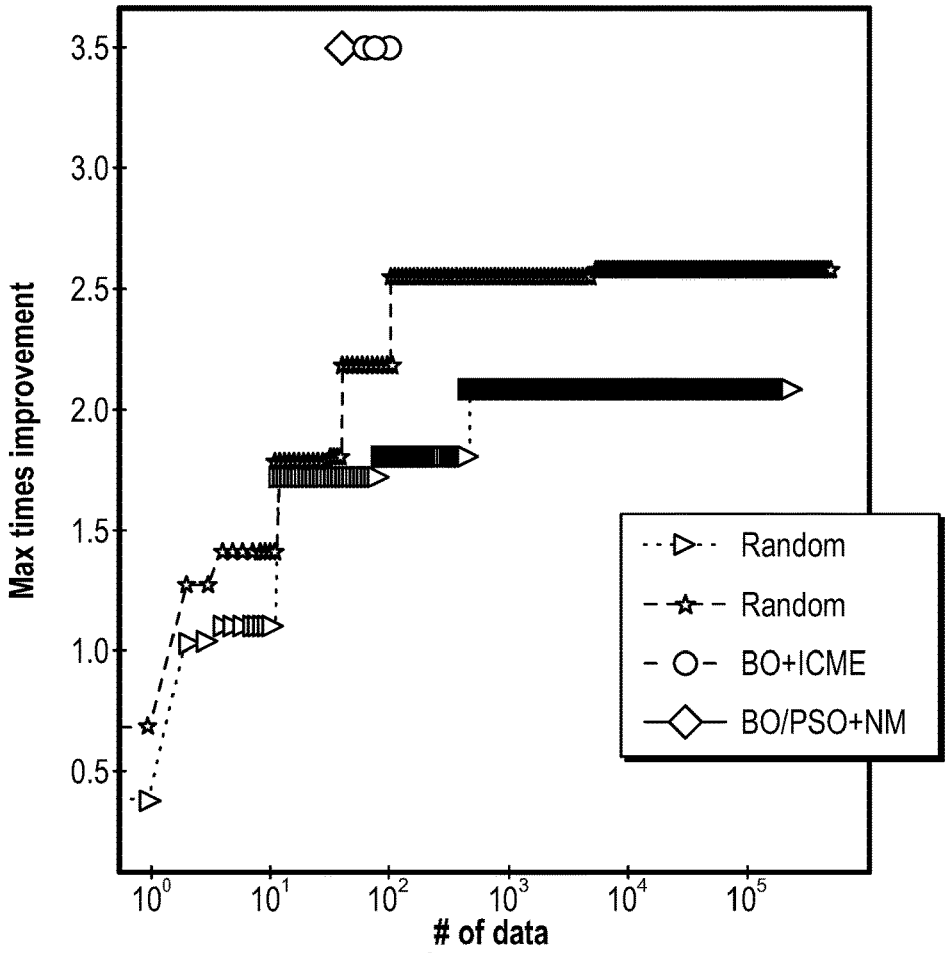
FIG. 6 plots the maximum coarsening resistance achieved by different inverse design techniques and the required amount of data. The average required number for Bayesian optimization+ICME is shown with the circles at the top of the graph. The evolution of maximum coarsening resistance is shown for a random sampling of 500,000 and 240,000 data.
Figure 8:
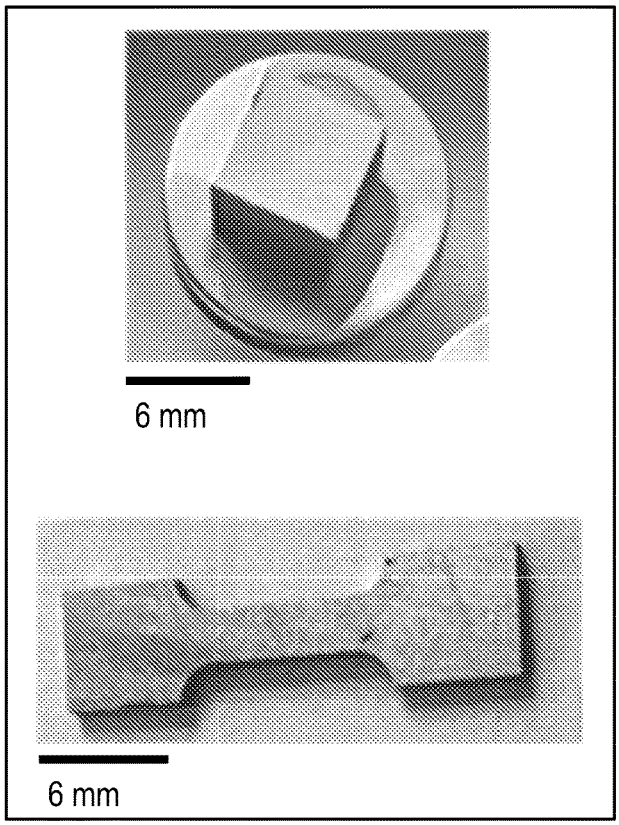
FIG. 8 includes images of a 3D-printed cube sample and a tensile (barbell-shaped) sample formed from the optimized alloy.
Figure 9:
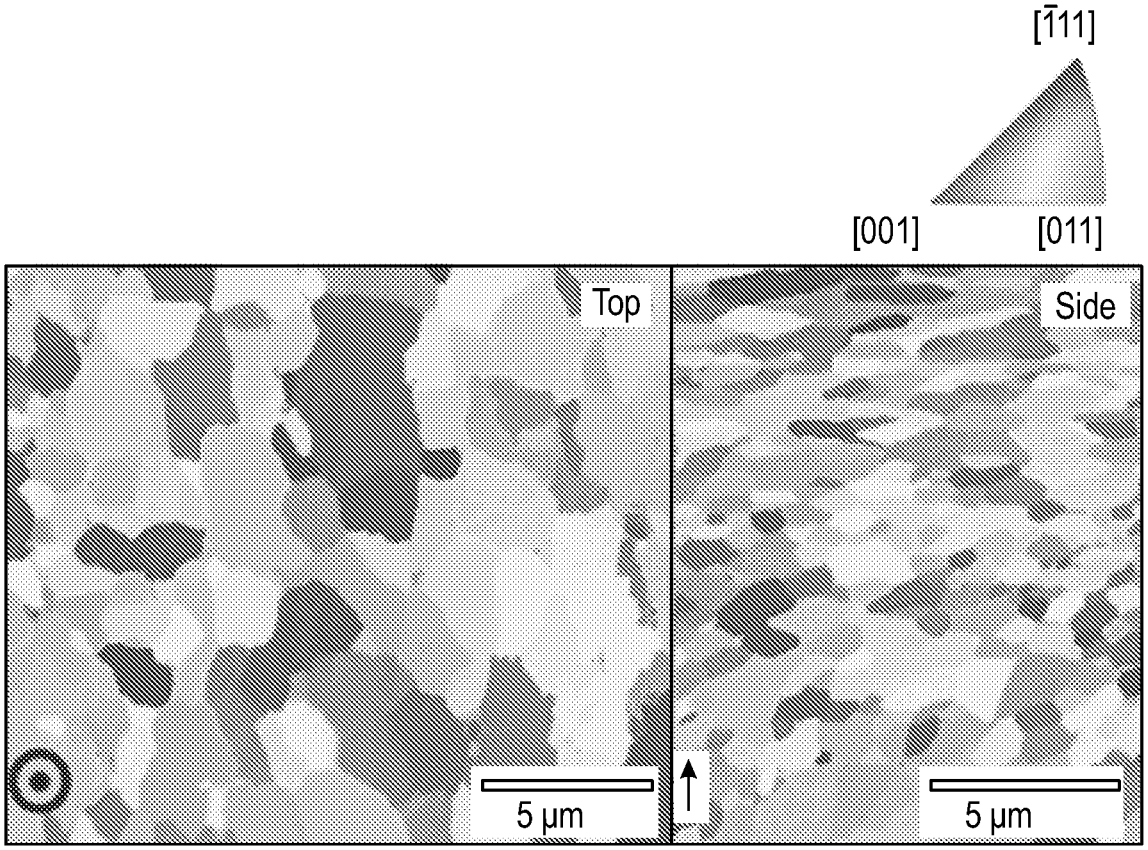
FIG. 9 includes electron backscatter diffraction (EBSD) images from the top and side of the 3D-printed cube. The built directions are shown on the images.
Figure 81:
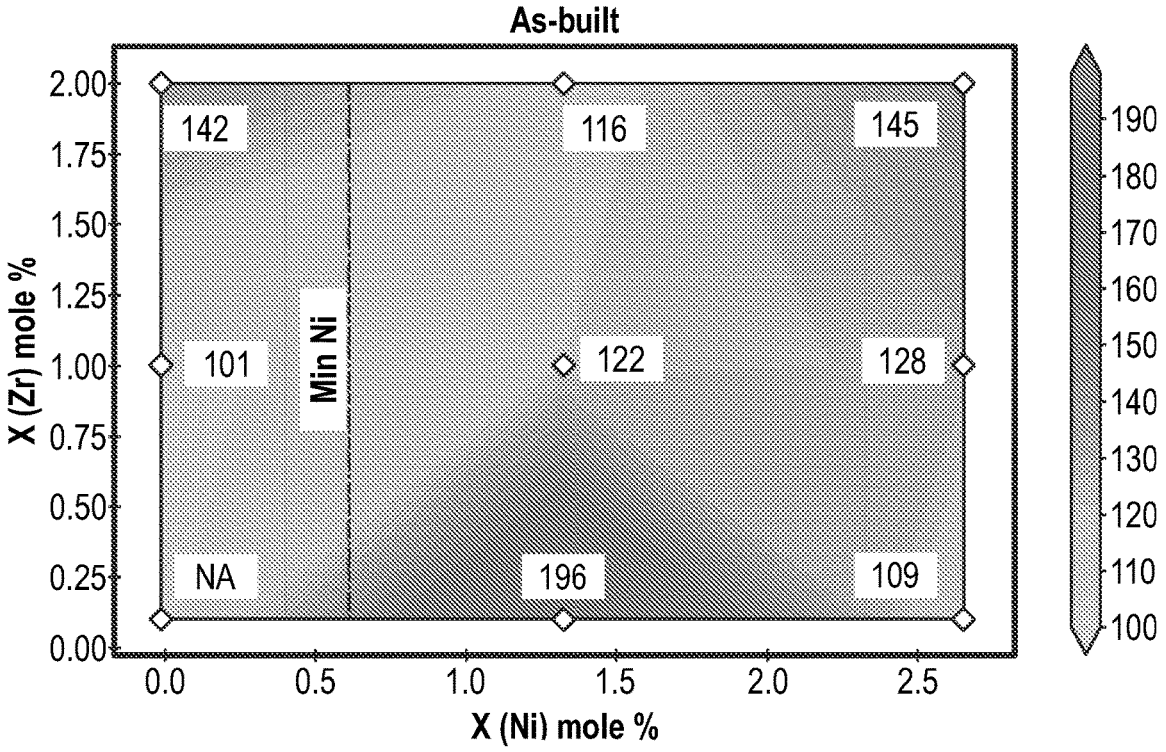
FIG. 81 is a contour plot showing the results of Vickers hardness testing on as-built alloy compositions with the indicated nickel and zirconium molar percentages.
Figure 82:
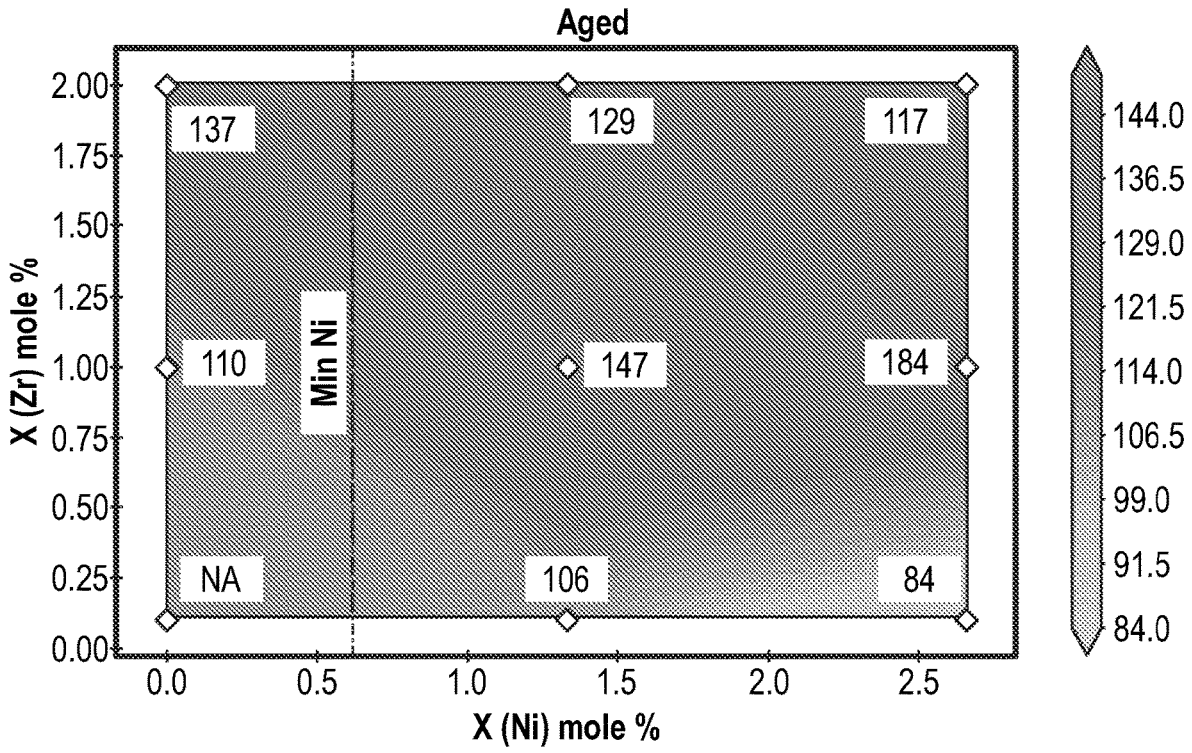
FIG. 82 is a contour plot showing the results of Vickers hardness testing on aged alloy compositions with the indicated nickel and zirconium molar percentages. The dashed line defines the minimum nickel molar percentages to have maximum ternary phase.
Figure 83:
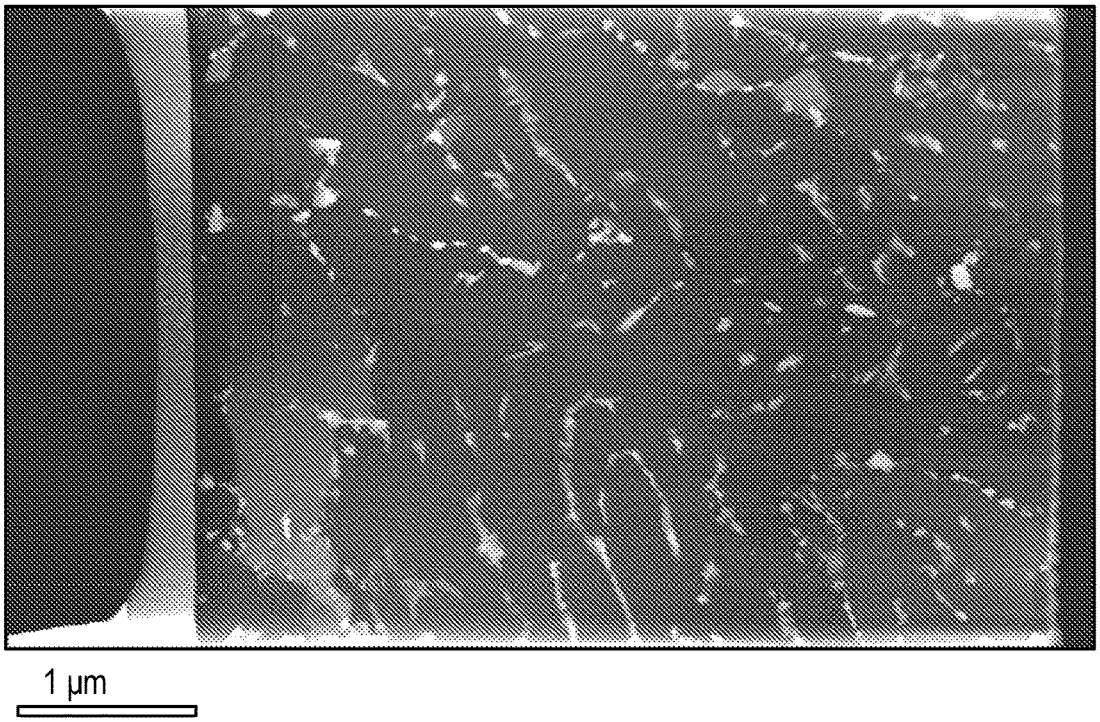
FIG. 83 is a low-magnification HAADF STEM image of an embodiment of an optimized alloy.

To accelerate experimental validation of the prediction, we first fabricated small-scale samples of the nine selected compositions by induction melting and then mimicked the heating and solidification conditions of additive manufacturing on these samples using laser scanning. We verified crack-free solidification, measured hardness, and down-selected the final composition (FIGS. 5, 81, and 82). We manufactured the powder form (precursor) of this alloy and built macroscale specimens via laser-based powder bed fusion using a commercial system (FIG. 8). Electron backscatter diffraction images of the side and top of the cubes show non-textured equiaxed grains without employing the challenging addition of nanoparticles in our powder (FIG. 9). Microstructural analysis via scanning electron microscopy (SEM), scanning transmission electron microscopy (STEM), and atom probe tomography (APT) validated the presence of nanoscale $L1_2$ phases (FIGS. 1, 17-20, 22, 24, 83, and 85). After aging at 400° C. for 8-10 hours, the hardness of the designed aluminum alloy exceeds equivalent tests performed on wrought 7075 aluminum alloy and is 50% higher than the benchmark printable alloy ("alloy 1", Al-2.14Ni-1.15Zr-1.35Er-0.25Y-0.73Yb, wt. %) of Gong, et al. (FIG. 2).

Figure 10:
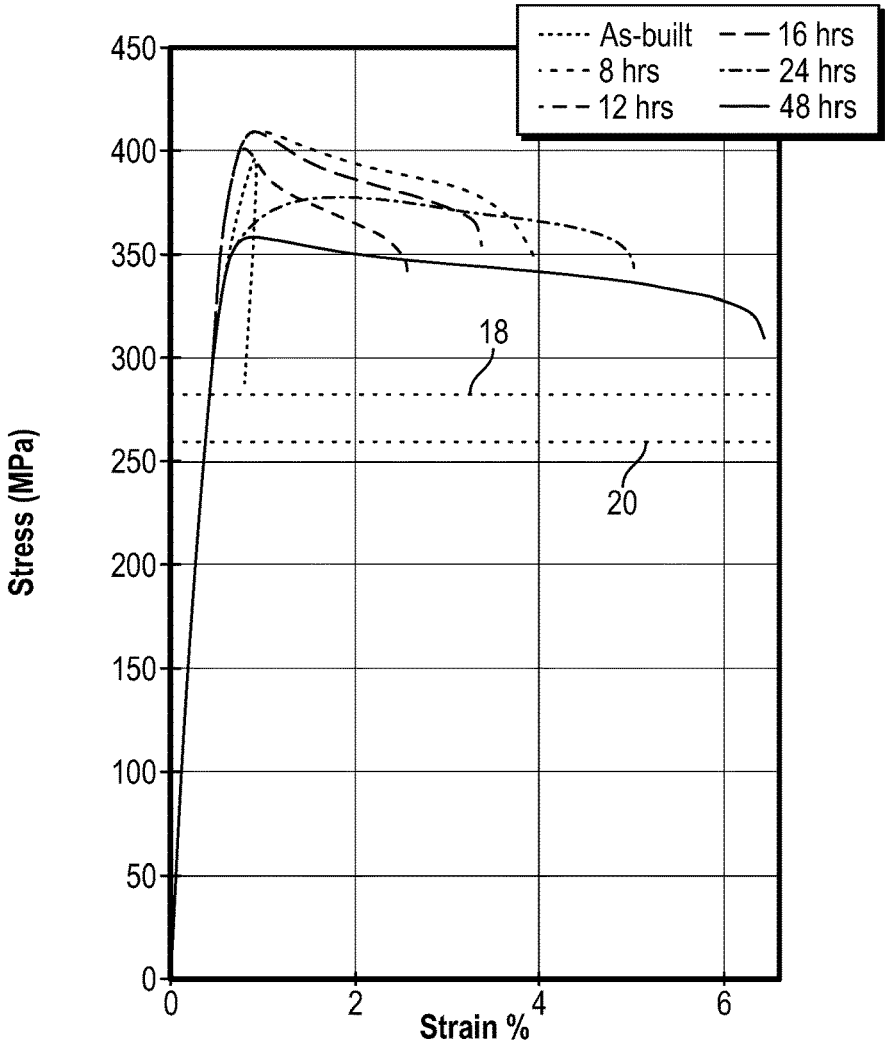
FIG. 10 plots the room-temperature tensile stress-strain curves of as-built and aged samples at different aging hours at 400° C. The yield strength of the benchmark 3D-printed aluminum alloy ("alloy 1") is shown. The strength of Al—Ce—Mn, which has the highest reported hardness in current additive manufacturing and cast alloys, is also shown.
Figure 91:
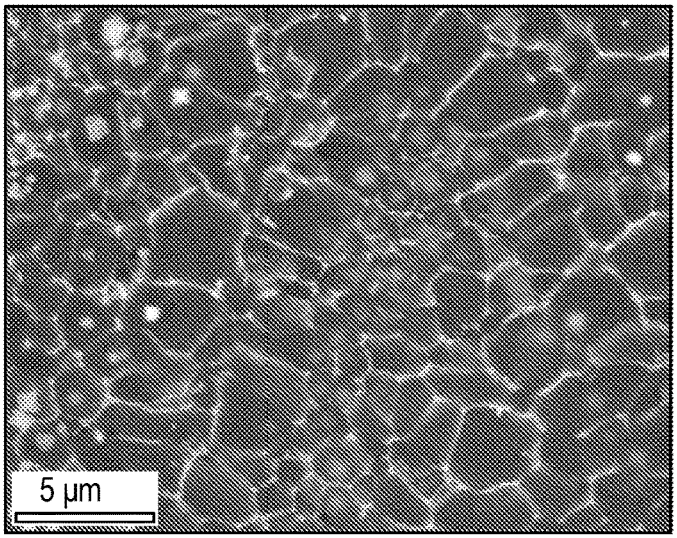
FIG. 91 is an SEM-EDS image of an alloy sample in which Er=0.4 molar %, Zr=1 molar %, and Ni=0 molar %. Micro-scale zirconium-rich areas are seen in some grains of this sample and are also seen in FIG. 92.
Figure 92:
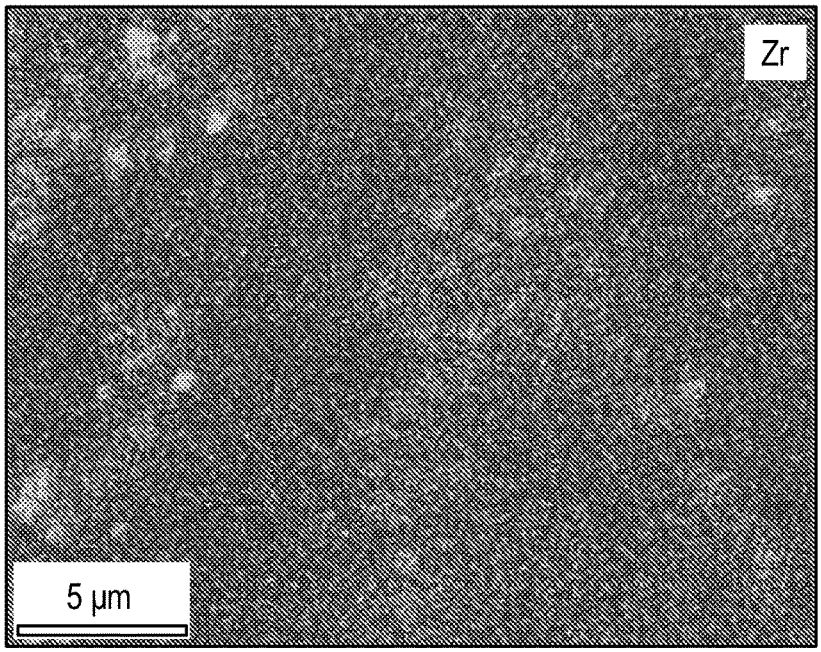
FIG. 92 shows the zirconium content from the SEM-EDS image of the alloy sample shown in FIG. 91.
Figure 93:
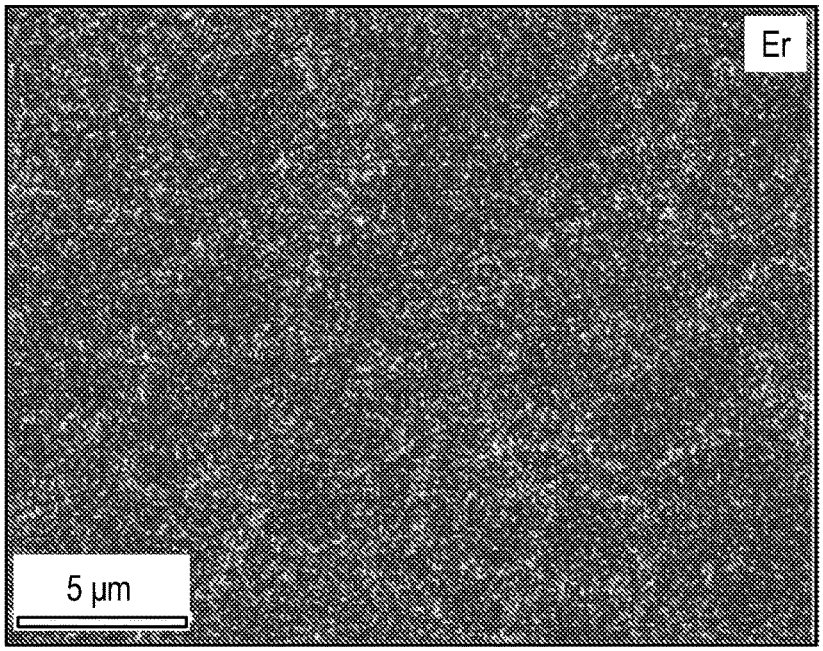
FIG. 93 shows the erbium content from the SEM-EDS image of the alloy sample shown in FIG. 91.

In comparison to our printed and aged optimized aluminum alloy, induction-melted specimens show micro-scale ternary phases (FIGS. 87-90) and have five-fold lower hardness. As the second control model, the laser-scanned induction-melted sample with identical erbium and zirconium mole % but without nickel was analyzed (FIGS. 81 and 82). The SEM-energy dispersive spectroscopy (EDS) characterization shows micro-scale hardening phases inside grains (FIGS. 91-93). The hardness of this sample is 34% lower than the designed composition containing nanoscale ternary phases processed in an identical procedure (FIGS. 81 and 82). We further confirmed the high value and the stability of the strength of our optimized alloy by performing room-temperature tensile tests on as-built and aged samples (FIG. 10). The peak strength after 8 hours of aging is once more 50% higher than the benchmark printable Al alloy 1 and does not drop even after 48 hours of aging at 400° C.

Results and Discussion

Figure 12:
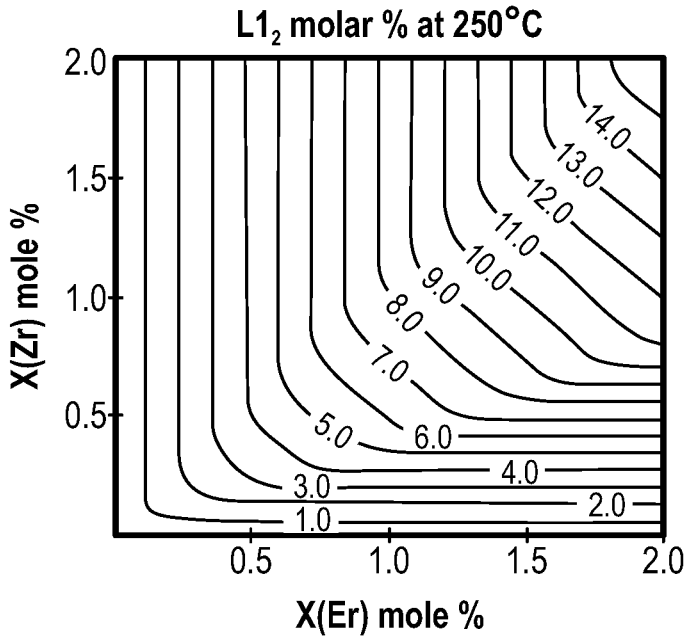
FIG. 12 is a plot of the $L1_2$ molar percent at 250° C. as a function of the molar concentration of erbium and zirconium in the aluminum alloy precursor composition.
Figure 13:
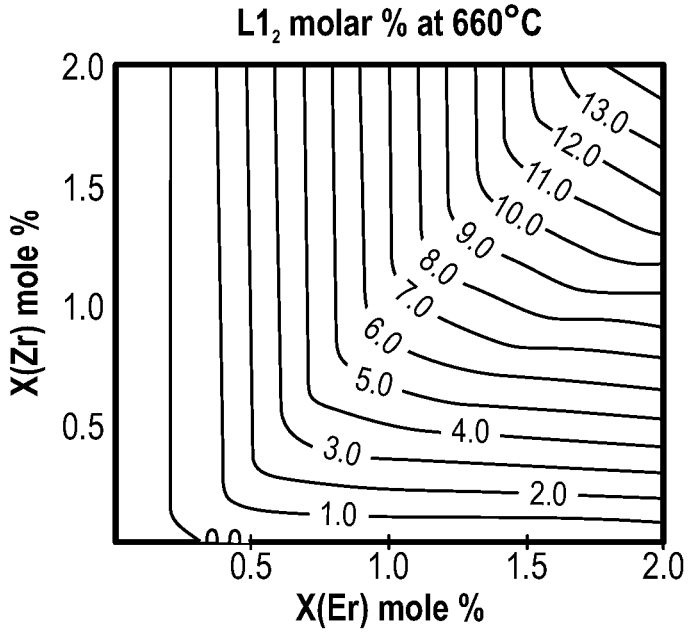
FIG. 13 is a plot of the $L1_2$ molar percent at 660° C. as a function of the molar concentration of erbium and zirconium in the aluminum alloy precursor composition.
Figure 14:
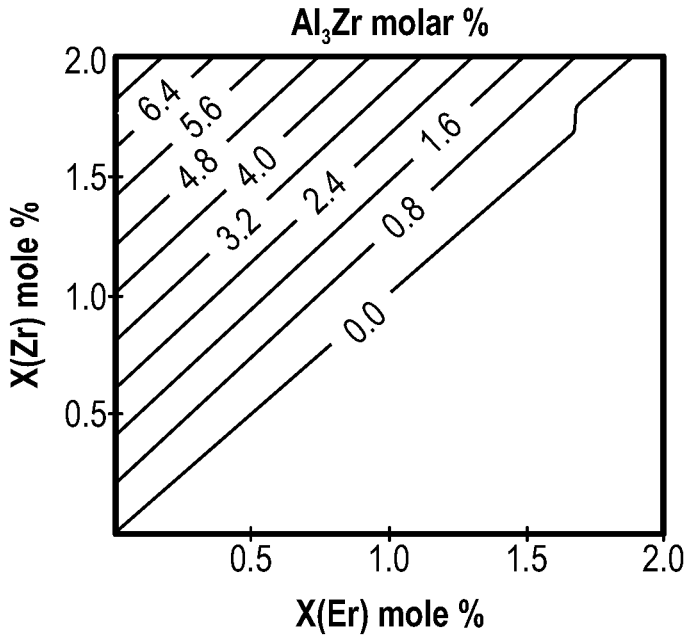
FIG. 14 is a plot of the $Al_3Zr$ molar percent as a function of the molar concentration of erbium and zirconium in the aluminum alloy precursor composition.
Figure 15:
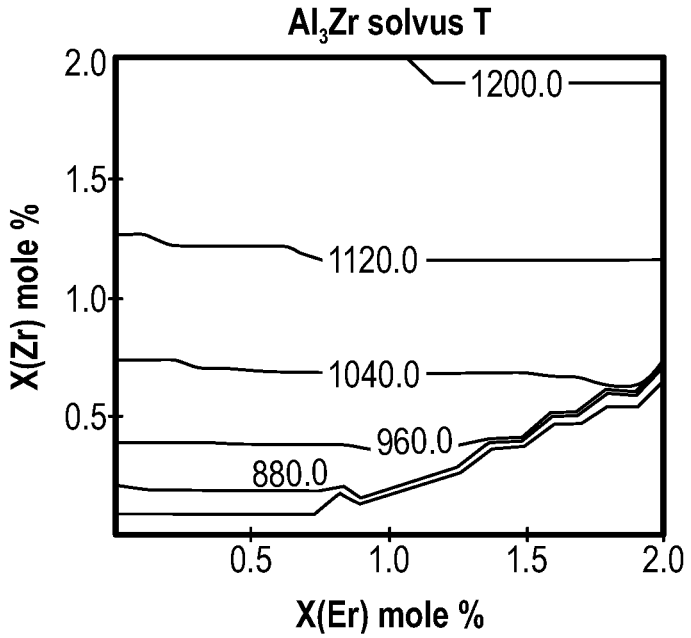
FIG. 15 is a plot of the $Al_3Zr$ molar percent as a function of the molar concentration of erbium and zirconium in the aluminum alloy precursor composition.

Design Criteria: High-Temperature Strengthening and Printability:

During solidification of our optimized aluminum alloy system (Al—Ni—Zr—Er—Y—Yb), several precipitates can form, including $Al_3Zr$, $L1_2$, $Al_3Ni$, and metastable ternary phase $Al_{23}Ni_6M_4$. $Al_3Zr$ is brittle and undermines strengthening; its lower solvus temperature and phase fraction minimize this phase. These quantities are microstructural features that can be quantified from single equilibrium calculations (FIGS. 14 and 15). $L1_2$ is stable at high temperatures and contributes to strengthening by impeding dislocations. At low temperatures, based on the Orowan strengthening mechanism, dislocations bow around precipitates and leave behind dislocation loops. Based on Equation 1, infra, the shear stress required for these mechanisms is inversely proportional to the precipitate size, above the shear to bypass the critical size of ~2 nm. The goal is to achieve such a nanoscale dispersion for aged samples. A high molar % of the $L1_2$ phase at 250° C. without formation during solidification (low $L1_2$ molar % at 660° C., which is the melting temperature of pure aluminum) maximizes this phase at small radii. These percentages are calculated from single equilibrium calculations (FIGS. 12 and 13). It is noteworthy that metastable precipitates, such as $Al_{23}Ni_6M_4$, in which M can potentially be Er, Zr, Y, or Yb, may form at small scales during rapid solidification, working as efficient reactant reservoirs for the $L1_2$ precipitates during aging. The volume fractions of these precipitates after solidification are maximized and are calculated from non-equilibrium Scheil solidification simulations (FIG. 16).

Figure 11:
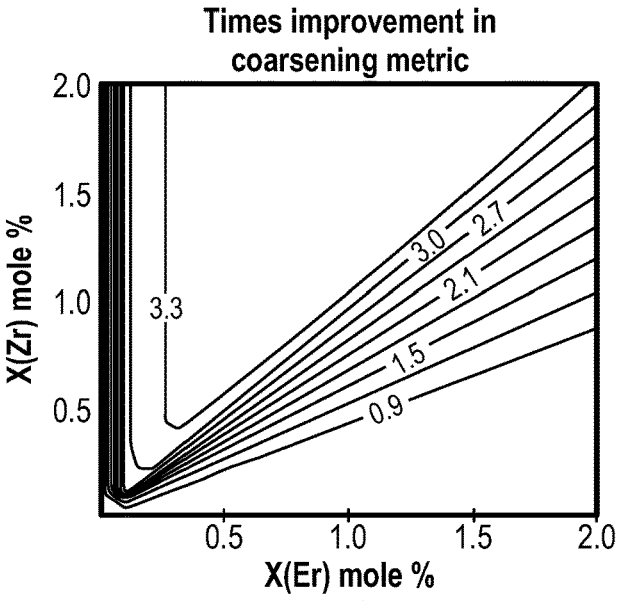
FIG. 11 is a plot of the multiple of (times) improvement in the coarsening metric in comparison with "alloy 1" as a function of the molar concentration of erbium and zirconium in the aluminum alloy precursor composition.
Figure 16:
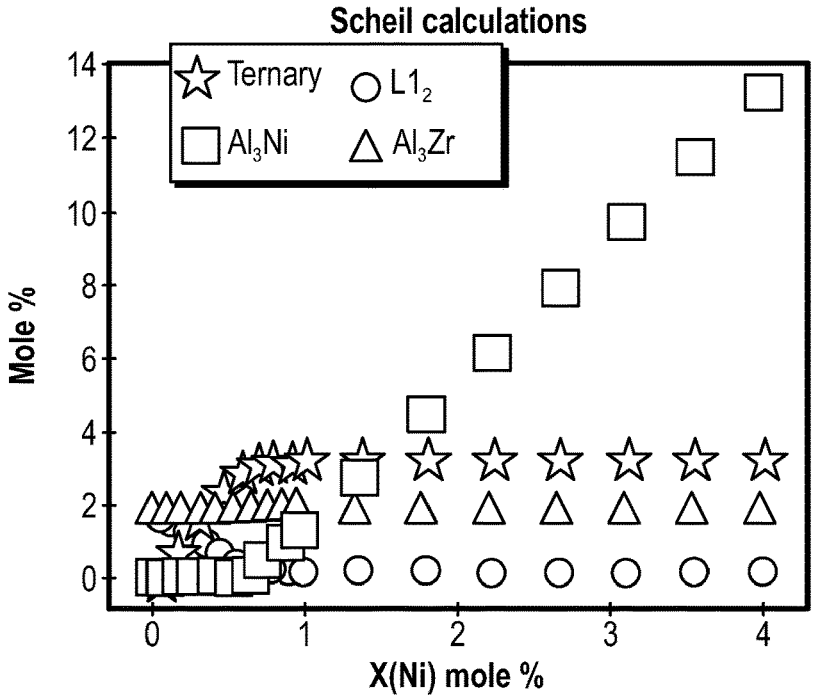
FIG. 16 is a plot of the molar percentage of different phases produced by changing the Ni molar percentage in Scheil simulations (Er=0.4 molar % and Zr=0.5 molar %) for the aluminum alloy.
Figure 17:
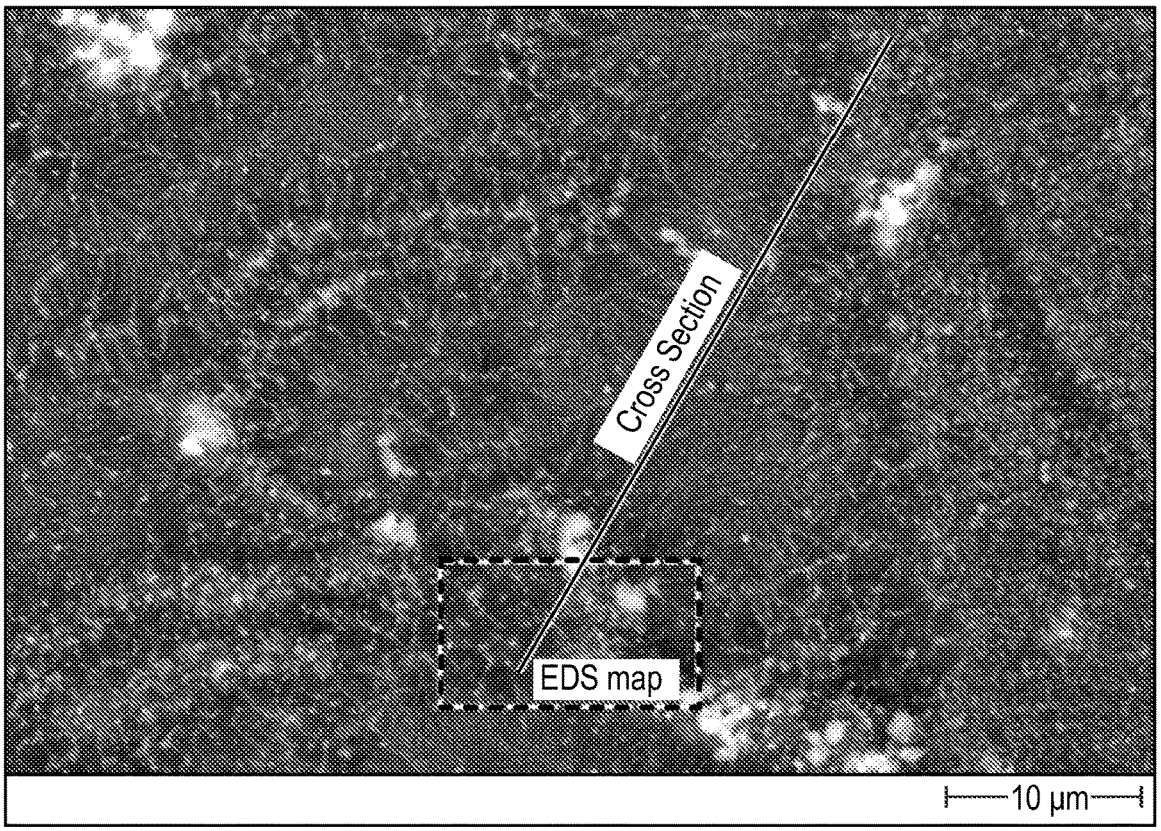
FIG. 17 is an SEM image of our optimized 3D-printed sample alloy (aged at 400° C. for 8 hours), which shows various shading (phases) in the microstructure.
Figure 18:
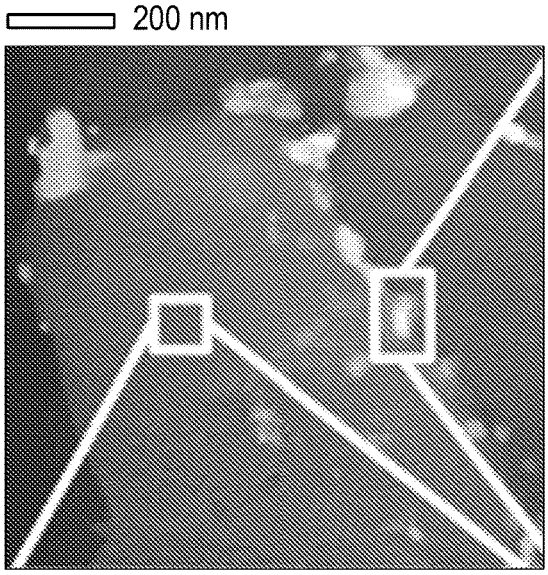
FIG. 18 provides a high-angle annular dark-field imaging scanning transmission electron microscopy (HAADF STEM) overview of the imaged grain along a <110>-type zone of the optimized 3D-printed sample.

To maintain strength at higher temperatures, the coarsening of $L1_2$ precipitates and the volume fraction of rapidly coarsening $Al_3Ni$ must be minimized (FIGS. 11 and 16). Based on Equation 2, infra, to decrease the coarsening rate, we employ low diffusivity elements, reduce interfacial energy through coherency, and enhance the partitioning of slow-diffusing alloying elements between the matrix and the precipitates. Reducing the interphase misfit strain, $\varepsilon$ (Equation 3, infra), is crucial for minimizing the interfacial energy of semi-/coherent $L1_2$ phases. A previous study of $L1_2$ strengthened Al alloys has shown that long-term creep strength controlled by interfacial climb is defined with a threshold stress of 40% of Orowan strength (Equation 1, infra) for particles with an optimum size of 17-nm diameter. Therefore, it is important to achieve an initial dispersion below this optimum size.

Figure 78:
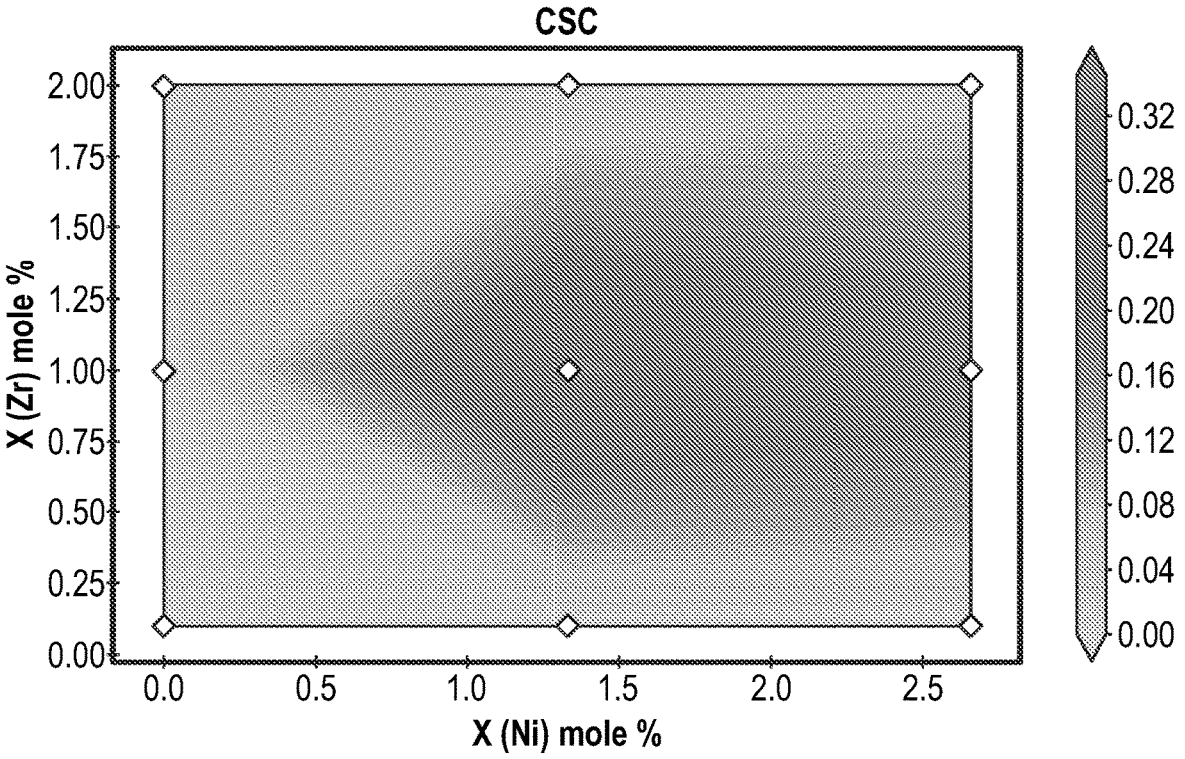
FIG. 78 is a contour plot of the cracking susceptibility coefficient (CSC) of alloy compositions formed from the random precursor sample compositions with the indicated nickel and zirconium molar percentages.
Figure 79:
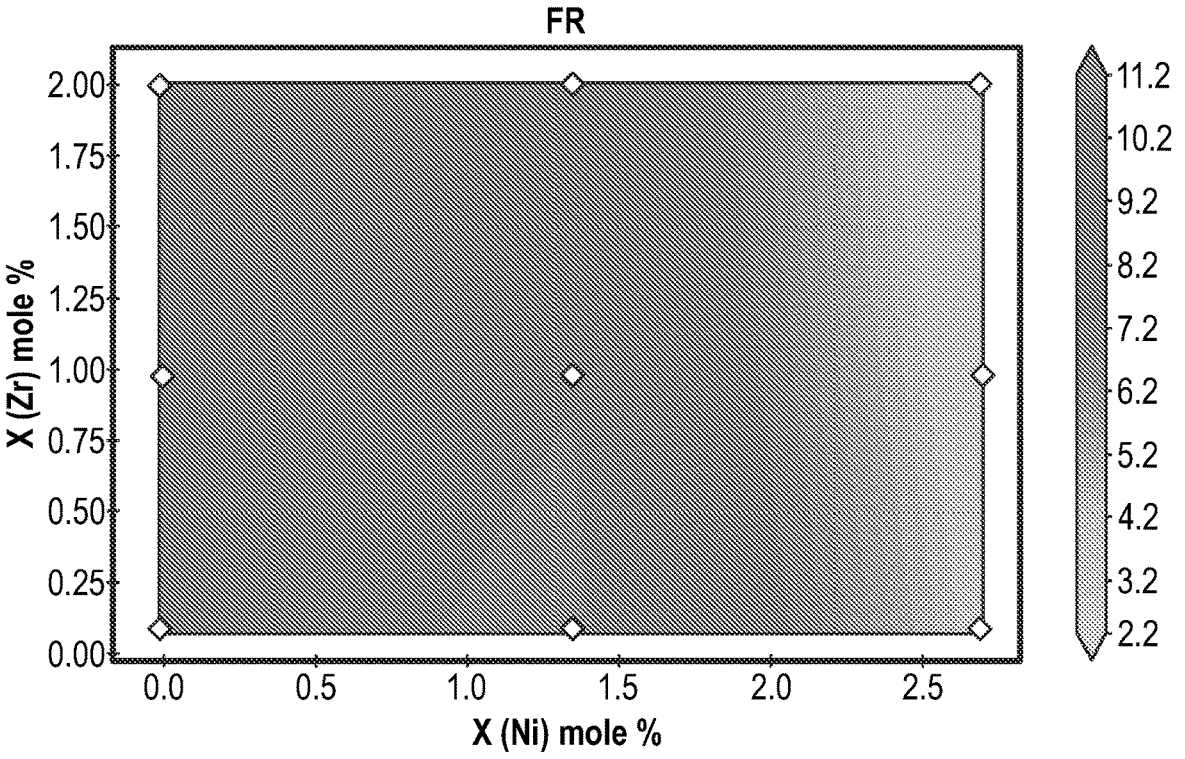
FIG. 79 is a contour plot of the freezing range (FR) of alloy compositions formed from the random precursor sample compositions with the indicated nickel and zirconium molar percentages.
Figure 80:
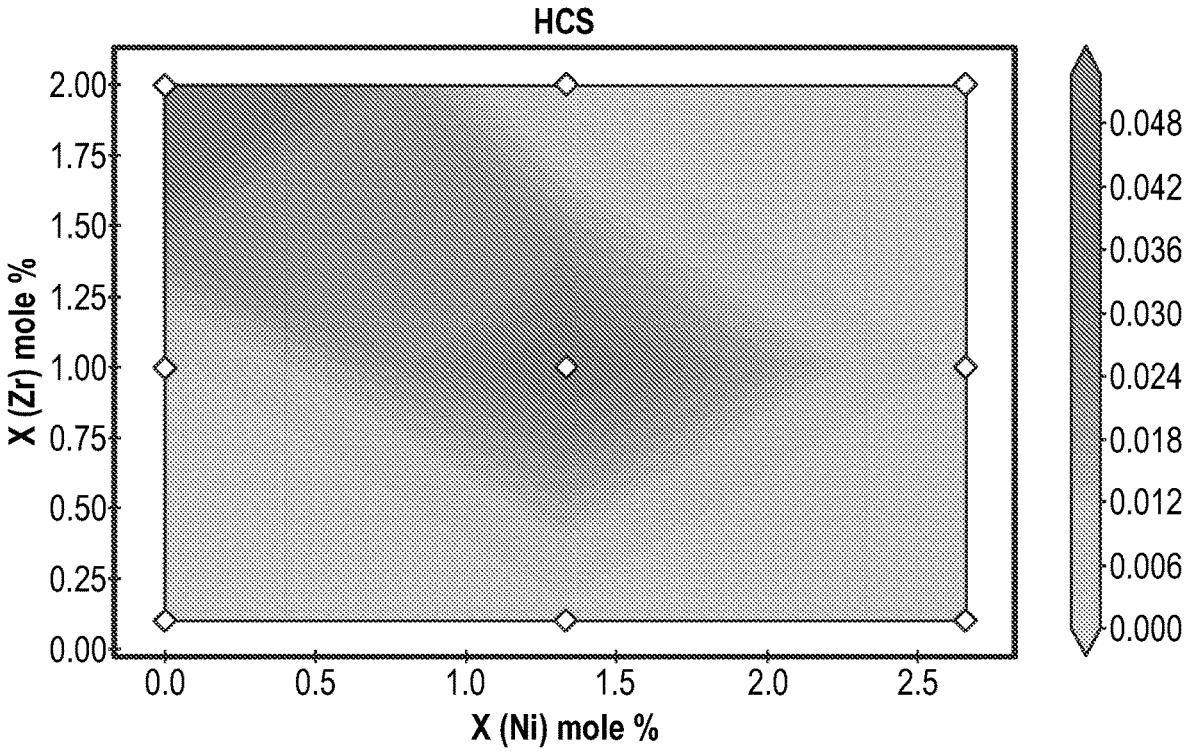
FIG. 80 is a contour plot of the hot cracking susceptibility coefficient (HCS) of alloy compositions formed from the random precursor sample compositions with the indicated nickel and zirconium molar percentages.

The laser-based powder bed fusion process can be considered a multi-layer micro-welding process. The main mode of fracture during solidification of aluminum alloys is hot tearing (cracking), which limits the printability and weldability of many aluminum alloys, such as Al 7000 and 6000 series. Our strategy to avoid hot cracking is to constrain solidification characteristics. This strategy includes limiting the freezing range (FR) and the cracking susceptibility coefficient (CSC) defined by the solidification time ratio, Clyne, T. W. & Davies, G. J., "Solidification and Casting of Metals," in The Metals Society 275-78 (1979) (FIGS. 78 and 79). The cracking susceptibility coefficient is best limited by introducing a small fraction of eutectic solidification. The overall hot cracking susceptibility (HCS)

was taken as the product of the freezing range and cracking susceptibility coefficient, both obtained from Scheil calculations (FIG. 80).

Computational Approach:

Considering all of the above microstructural and solidification criteria, design goals and constraints are set and prioritized (FIGS. 4, 5, and 11-16). The primary microstructural features to be minimized are the combined diffusion resistivity (the denominator of Equation 2, infra) and misfit strain (8) of the $L1_2$ phases (the product is considered as the coarsening metric). We thus inversely designed the composition minimizing the coarsening metric as an objective function. We generated two sets of 250,000 and 500,000 random compositions using the Latin hypercube sampling (LHS) method (FIGS. 33-41), with constraints on molar % of {Er, Zr, Y, and Yb}=[5×10-3, 1], and {Ni}=[0, 4]. FIGS. 33-41 show the diffusion resistivity, misfit strain (8), and coarsening metric at 250° C., all normalized by the associated values from the benchmark alloy 1. Among 250,000 sampled compositions, 28.8% have a lower coarsening metric than alloy 1. Compared with the lowest predicted coarsening metric among this population, the coarsening metric of the benchmark alloy is 2.08× higher (FIG. 6), and among the population of 500,000, the maximum is 2.50×.

Figures 30, 31:
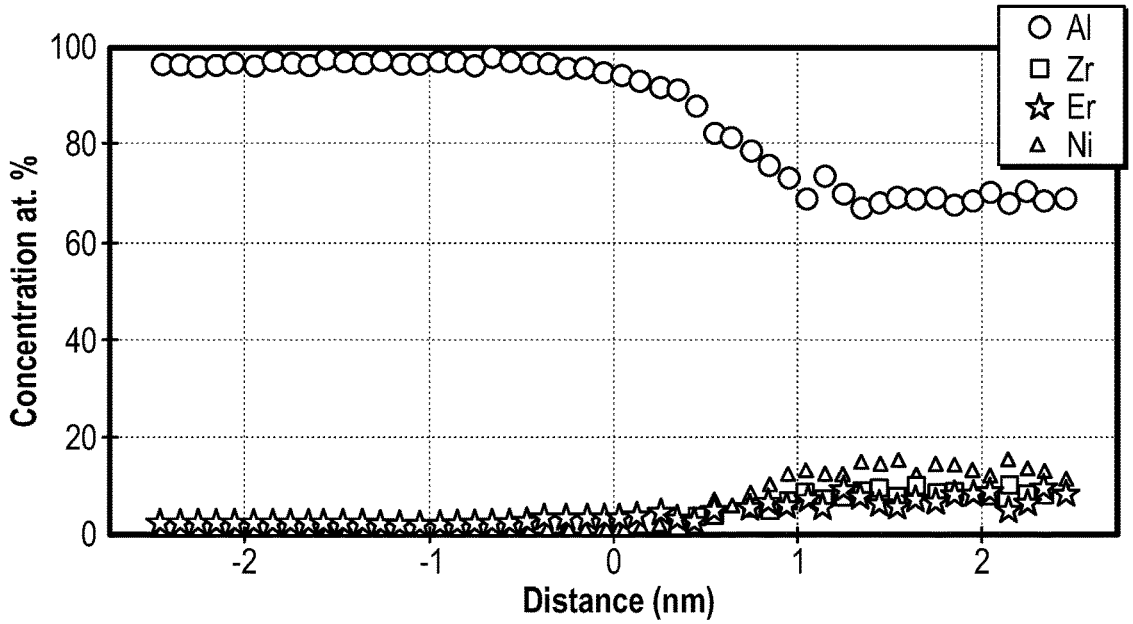
FIG. 30 is a proximity histogram for isosurface interfaces where Ni=2.5 atomic %, showing enrichment in nickel, erbium, and zirconium.
FIG. 31 indicates the Spearman coefficient between each pair of parameters in the design space.

We find that zirconium and erbium are the most influential elements on the coarsening metric (see FIGS. 42-65 and discussion re Spearman Coefficient and Parallel Plots of Coarsening Metric, infra). This qualitative analysis was confirmed by the Spearman coefficient, an index indicating the linear correlation for each ranked pair of parameters (FIG. 31). These trends were also observed in the presentation of data in parallel plots in FIGS. 66-68, confirming a direct correlation of the coarsening rate to the zirconium concentration. Strength is also correlated to the $L1_2$ molar % (see Equation 1, infra); we thus plotted the $L1_2$ molar % with respect to the studied parameters. As shown in FIGS. 69-77, erbium is the most influential element for increasing the $L1_2$ molar %. Spearman coefficient analysis also confirms the significant contribution of erbium, as shown in FIG. 31.

Figure 32:
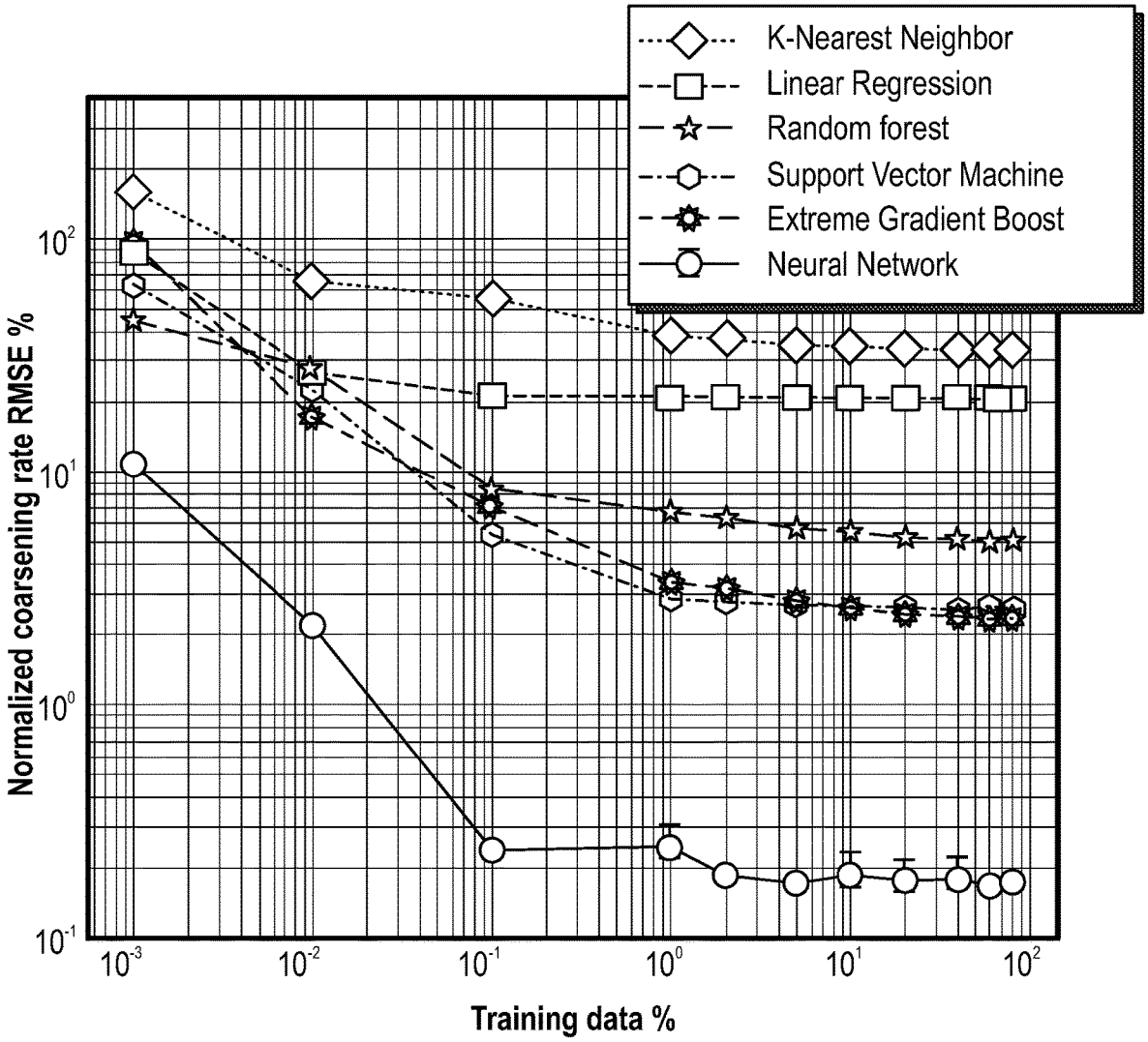
FIG. 32 plots the root mean square error (RMSE) of the normalized coarsening metric with respect to the training data percentage for the following six applied machine-learning techniques: convolutional neural network (NN), K-nearest neighbor (KNN), random forest (RF), support vector machine (SVM), gradient boost (GB), and linear regression (LR) techniques. A minimum of 40 samples is required to achieve<3% of error to predict the entire compositional space for the most efficient algorithm, NN.
Figure 33:
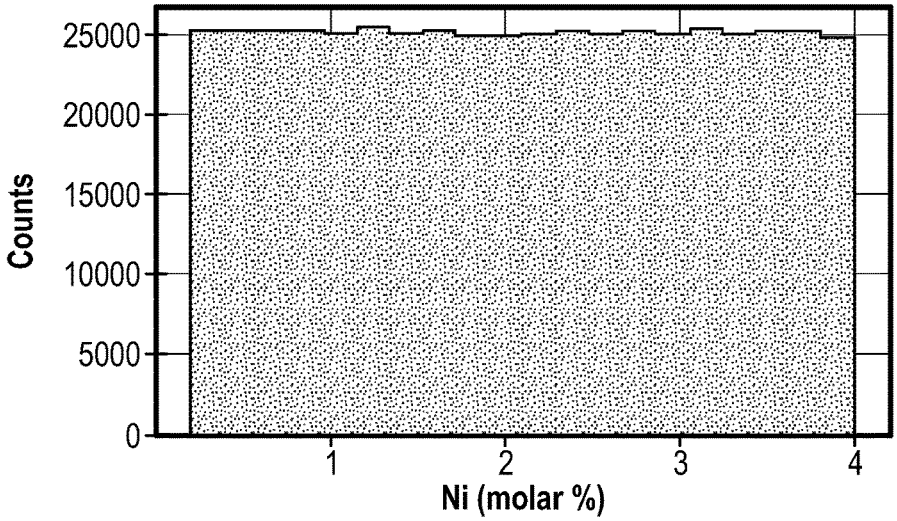
FIG. 33 is a plot of counts of nickel molar concentrations generated for 500,000 random precursor sample compositions using a Latin hypercube sampling method.
Figure 34:
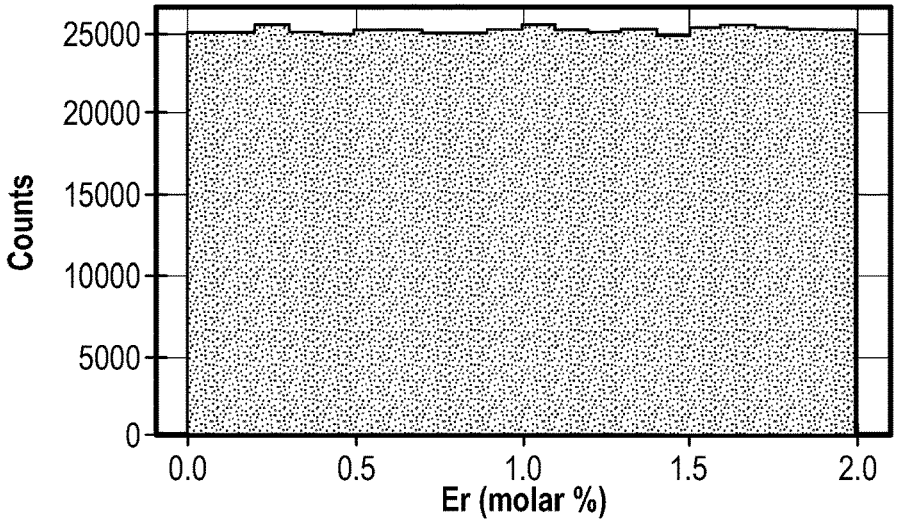
FIG. 34 is a plot of counts of erbium molar concentrations generated for the random precursor sample compositions using the Latin hypercube sampling method.
Figure 35:
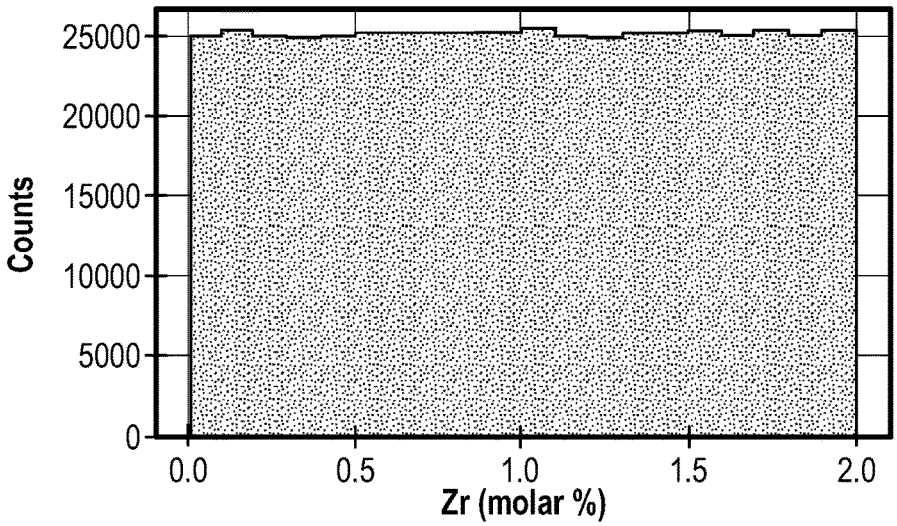
FIG. 35 is a plot of counts of zirconium molar concentrations generated for the random precursor sample compositions using the Latin hypercube sampling method.
Figure 36:
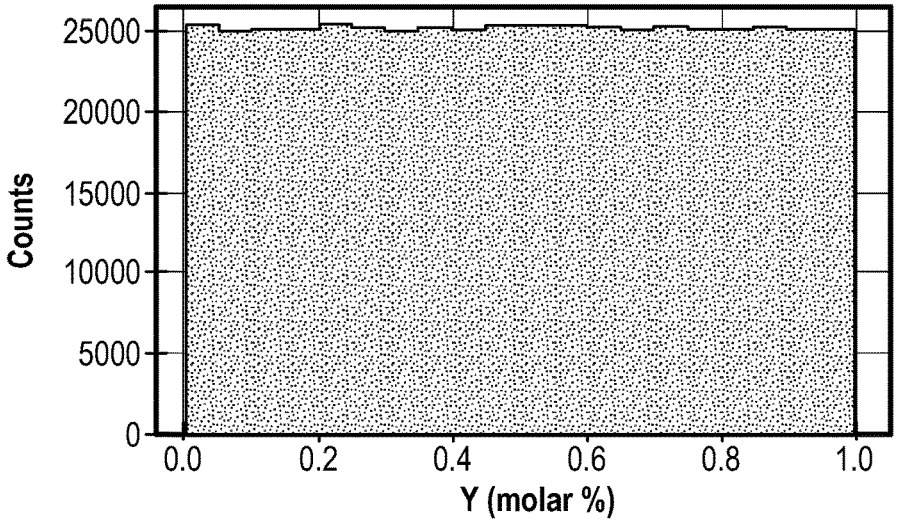
FIG. 36 is a plot of counts of yttrium molar concentrations generated for the random precursor sample compositions using the Latin hypercube sampling method.
Figure 37:
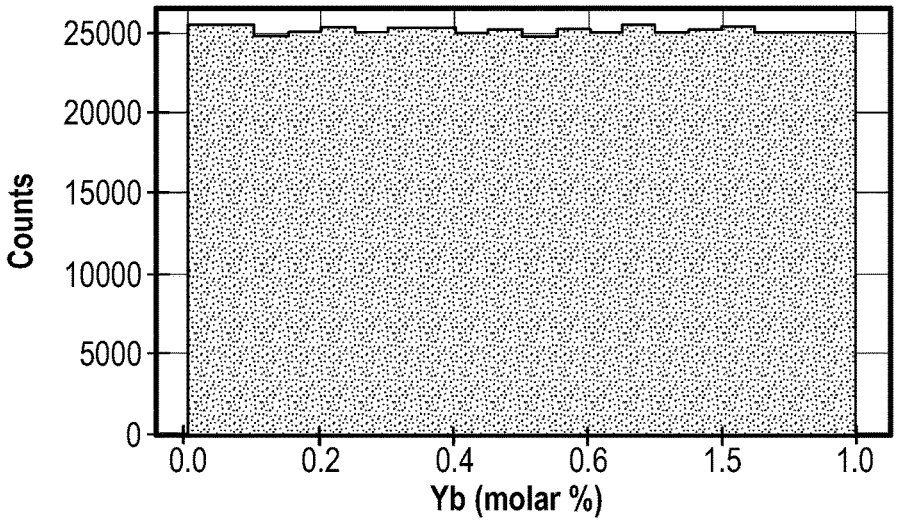
FIG. 37 is a plot of counts of ytterbium molar concentrations generated for the random precursor sample compositions using the Latin hypercube sampling method.
Figure 38:
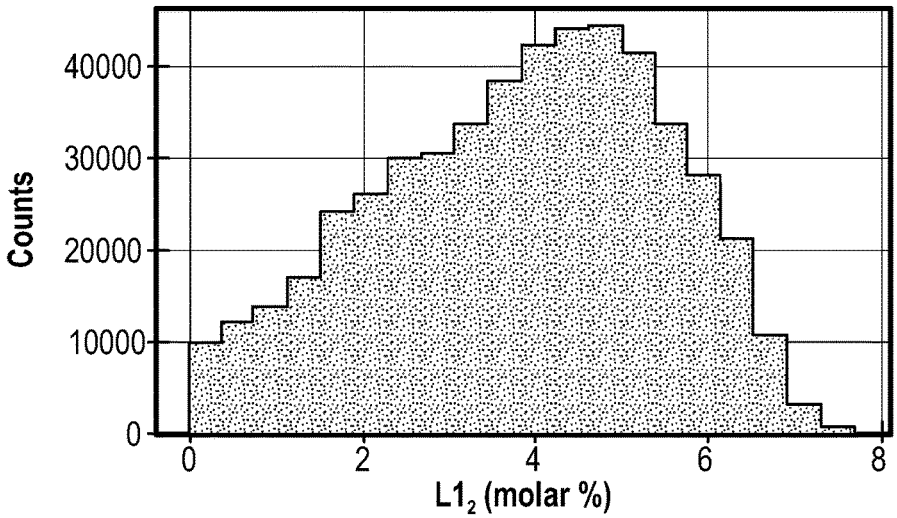
FIG. 38 is a plot of counts of the molar concentrations of the $L1_2$ phase formed from the random precursor sample compositions.
Figure 39:
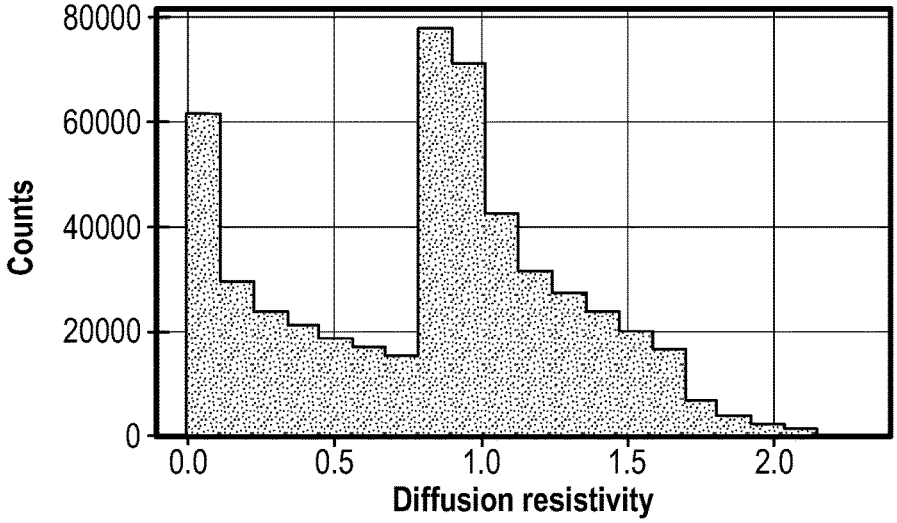
FIG. 39 is a plot of counts of the diffusion resistivity of the alloy compositions formed from the random precursor sample compositions.
Figure 40:
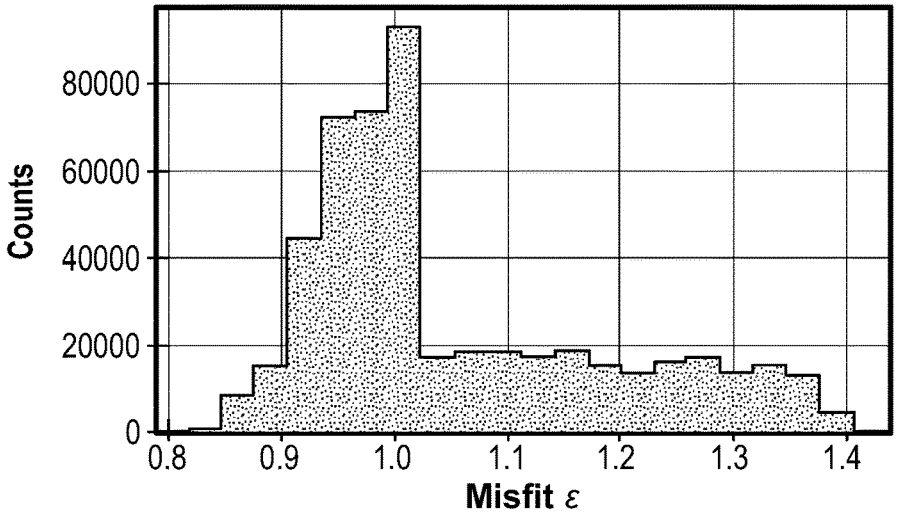
FIG. 40 is a plot of counts of the misfit strain at the phase boundaries of the alloy compositions formed from the random precursor sample compositions.
Figure 41:
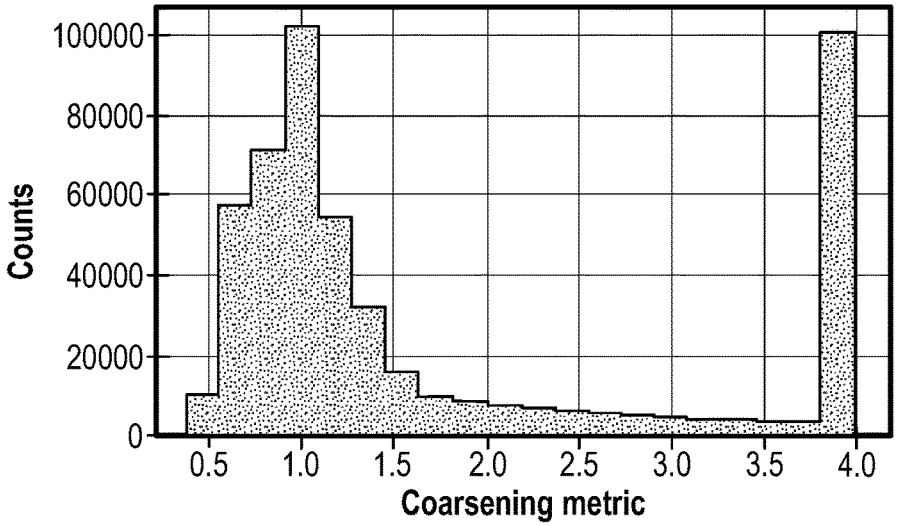
FIG. 41 is a plot of counts of the coarsening metric of the $L1_2$ phase in the alloy compositions formed from the random precursor sample compositions.

To develop a surrogate model, we compared the following six regression techniques: a convolutional neural network (NN), K-nearest neighbor (KNN), random forest (RF), support vector machine (SVR), gradient boost (GB), and linear regression (LR) (FIG. 32). The input vector for our regressors contains the molar % of five alloying elements. The process of optimizing the hyperparameters for each technique is described infra. We analyzed the test data root mean square error (RMSE) for different training data percentages. As shown in FIG. 32, the normalized prediction error for our most efficient algorithm, NN, decreases to 3% as the training set comprises 40 compositions (0.01%).

We compared two inverse design techniques to find the global minimum of the coarsening metric. For our first approach, we used particle swarm optimization (PSO), a constrained optimization technique, using data from the NN surrogate model. The minimum coarsening metric is for the composition with XNi2Er2Zr molar %. X for Ni indicates Ni does not influence the coarsening metric. The search converged after eight steps of 10 sampling data (80 sample data). As the second approach, we used Bayesian optimization (BO) with a Gaussian process as the surrogate model. We obtained the data using two methods, i.e., through the NN surrogate model and from direct integrated computational materials engineering techniques (calculating the coarsening metric after running THERMO-CALC software (from Thermo-Calc Software AB) through TC-python script (also from Thermo-Calc Software AB). For the Bayesian optimization, the sampling was done using Latin hypercube sampling at each step. To balance exploration and exploitation, we chose expected improvement (EI) as our acquisition function. For the first method, the algorithm converged after 100 samples from the NN surrogate model. It is noteworthy that for this method and particle swarm optimization, the 40 samples to train the NN model were the main computational cost. For the second method in which the Bayesian optimization algorithm was connected directly to integrated computational materials engineering techniques, the optimal composition emerged after four rounds of sampling with 20 samples in a single batch (80 data). Interestingly, the optimal composition proposed by two Bayesian optimization methods is identical to that from particle swarm optimization. Compared with the normalized coarsening metric of this optimal composition, the coarsening metric of the benchmark alloy 1 is 3.5× greater, which shows the power of inverse design techniques compared to high-throughput calculations with random sampling (see FIG. 6). Further details regarding the inverse design techniques appear infra.

The contour plot of the normalized coarsening metric with respect to the two most influential elements, erbium, and zirconium (FIG. 11), shows that both provide for improvement in the coarsening metric. Zirconium contributes to lower coarsening metrics due to its high solubility and relatively low diffusivity in aluminum and also due to its misfit strain, ε (see Equation 2, infra). Erbium does not contribute linearly to the coarsening metric through Equation 2. The presence of erbium in the composition has non-linear effects by increasing the $L1_2$ molar % (see FIG. 11). Therefore, the erbium contributions could not be captured by the Spearman coefficient, which can only capture linear correlations. The nonlinearity in machine-learning algorithms can reveal this dependency of the coarsening metrics on both zirconium and erbium.

Advantageous concentrations for erbium and zirconium are those that are inside the 2.7× coarsening metric improvement plot (and even more so, within the 3.0× and 3.3× improvement plots. Accordingly, the precursor composition will advantageously include a molar percentage of zirconium, $x_{Zr}$, and a molar concentration of erbium, $x_{Er}$, that will fall with an approximate triangle extending to the right of about 0.1 molar % erbium and to the upper left of the diagonal where $x_{Zr} \approx x_{Zr}$. The upper bounds for zirconium and erbium can be respectively set at 1.5 molar % and at 1 molar %, also ensuring that $x_{Er} \leq x_{Zr}$. Note that production of the precursor composition may be subject to a margin of error, where a component concentration may differ from the specified composition by, e.g., 10%. Consequently, selection of a composition with a particular concentration of erbium and zirconium can account for this margin of error by being safely within a desired region of the plot of FIG. 11.

Having established that the coarsening metric depends on the zirconium and erbium content, we can also present the contour plots of other microstructural features with respect to these two elements. The contour plots of $Al_3Zr$ molar % and $Al_3Zr$ solvus temperature, which limit the maximum zirconium content, appear in FIGS. 14 and 15. The maximum molar % of erbium limits the $L1_2$ molar % and the $L1_2$ molar % during solidification and thus increases its volume percentage while the radii remain low through solid-state precipitation (see FIGS. 12 and 15). We chose the maximum erbium molar % equal to 0.4 to limit the molar % during solidification to 1 (FIG. 15).

The above single equilibrium calculations provide microstructural features after aging. However, consistent with our experimental observations, non-equilibrium Scheil solidification simulations with our database revealed that the stabilizing $L1_2$ precipitates can appear as a nanoscale metastable ternary phase $Al_{23}Ni_6M_4$ during solidification. The ternary phase acts as a reservoir for the solid-state precipitation of nanoscale $L1_2$ during the aging process. Therefore, we optimize the Ni content to have higher percentages of the ternary phase for a given erbium and zirconium content. For a zirconium content=0.5 molar %, we plotted all of the phases previously mentioned from Scheil calculations with respect to the nickel molar %. FIG. 16 shows that initially, at nickel=0 molar %, the ternary and $L1_2$ molar % are zero and a maximum of 1.63 molar %, respectively. As the nickel content increases, the ternary phase increases to a maximum value of 3.21 molar % at 0.64 molar % of nickel. Thus, nickel is set to >0.64 molar % while further addition of nickel increases the amount of unnecessary eutectic $Al_3Ni$. Maintaining a low molar concentration of nickel prevents formation of much of the rapidly coarsening $Al_3Ni$ and can prevent precipitation of $L1_2$ phases without first transitioning through the ternary phase.

In the next stage, the above-mentioned printability constraints of our design are examined in detail. With erbium=0.4 molar %, for the variation range of zirconium and nickel, we plotted the cracking susceptibility coefficient (CSC), freezing range (FR), and hot cracking susceptibility (HCS) product (FIGS. 78-80). The hot cracking susceptibility product was very low (<0.05) for all compositions (compared to 1.13 for 7075 aluminum alloy), indicating good printability within our composition constraints.

Figure 7:
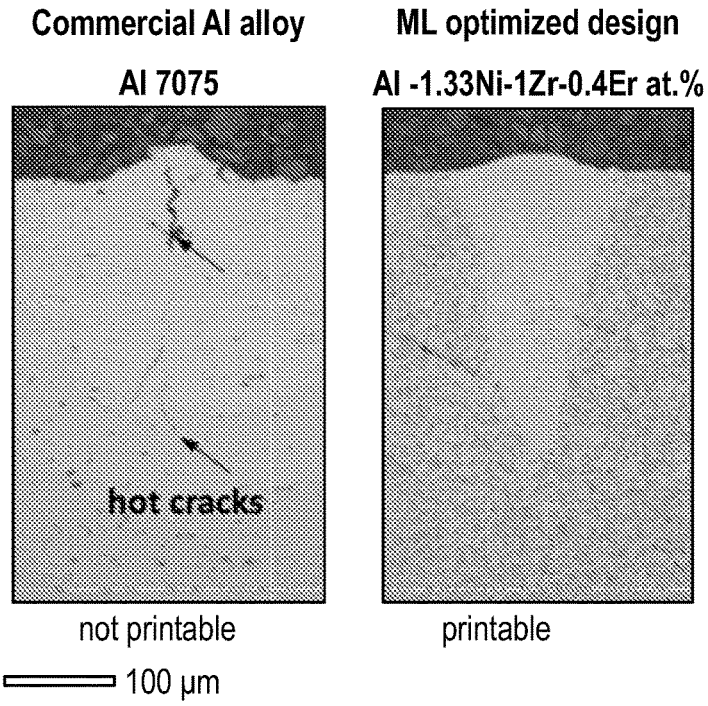
FIG. 7 includes optical images of laser-scanned induction-melted samples of 7075 aluminum alloy and our optimized alloy, which show that the latter does not suffer from hot-cracking.

Additive Manufacturing:

We developed a rapid experimental workflow to validate our predictions for performance and printability in the context of rapid solidification. We thus performed screening experiments by mixing substantially pure elements, induction melting, and casting, followed by rapid melting and solidification using a scanning laser (see the section entitled, Experiments on Laser-Scanned Induction-Melted Samples to Validate Printability and Precipitation Hardening, infra). We chose a matrix of nine compositions surrounding the predicted optimum (indicated by diamond points in FIGS. 78-80) and searched for evidence of hot cracks by metallography. We also performed laser scanning on 7075 aluminum alloy showing clear hot cracking in association with its known poor printability (FIG. 7). Our prediction was validated with no hot cracks observed for all nine samples; the sample with nickel=1.33 molar % and zirconium=1 molar % is shown in FIG. 7.

Figure 84:
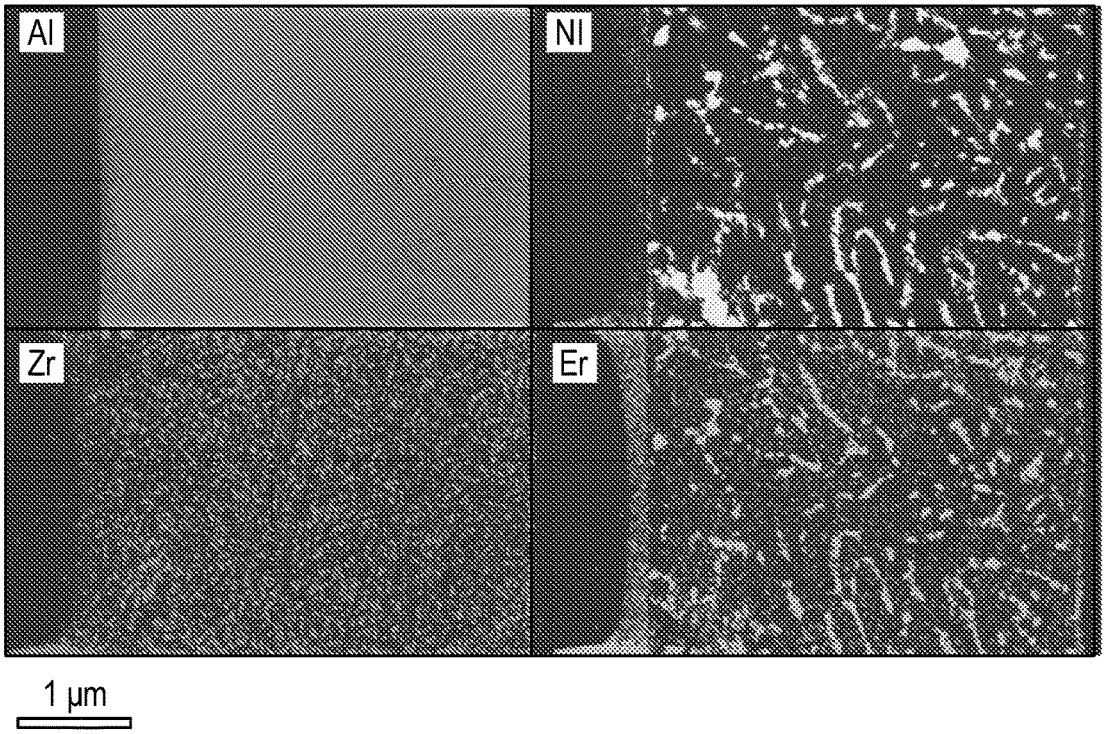
FIG. 84 includes energy dispersive spectroscopy (EDS) maps showing distributions of aluminum, nickel, zirconium, and erbium in the alloy microstructure.
Figure 85:
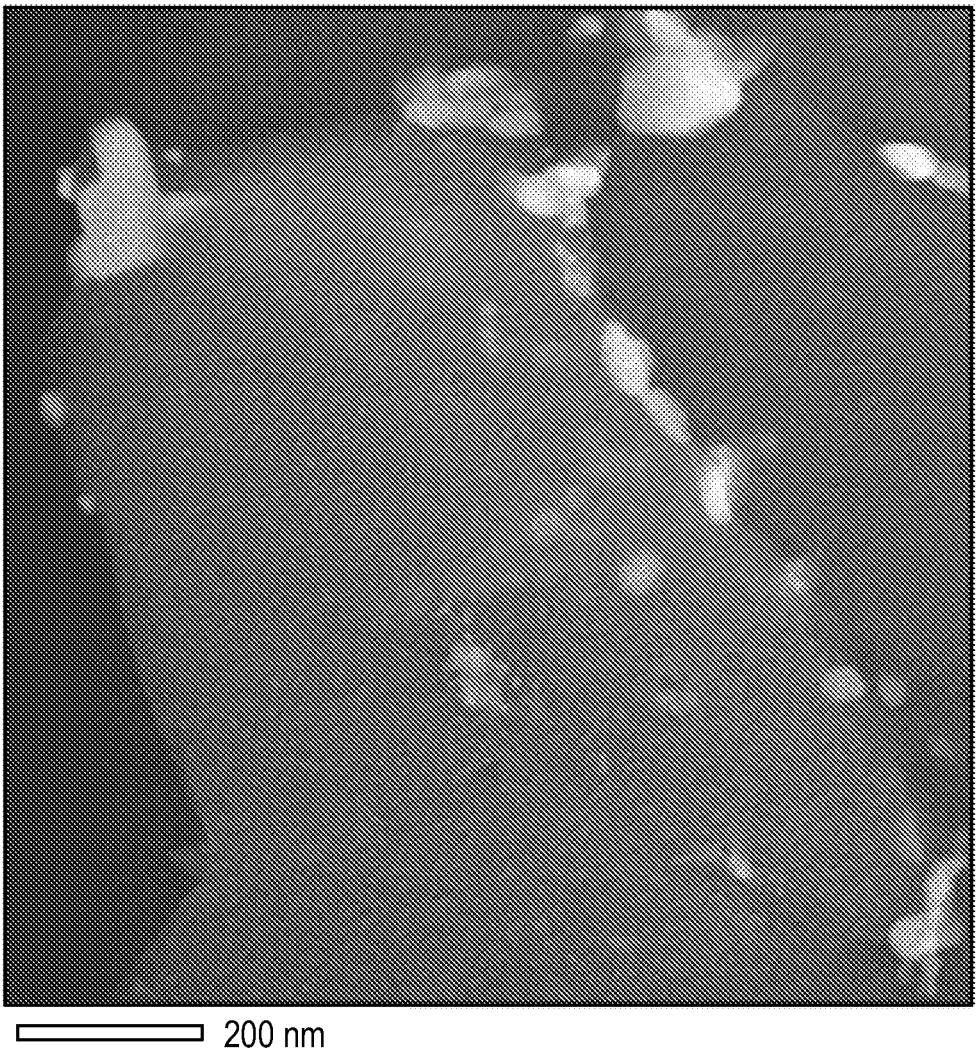
FIG. 85 is a HAADF STEM overview of the imaged grain along a <110>-type zone of the alloy.
Figure 86:
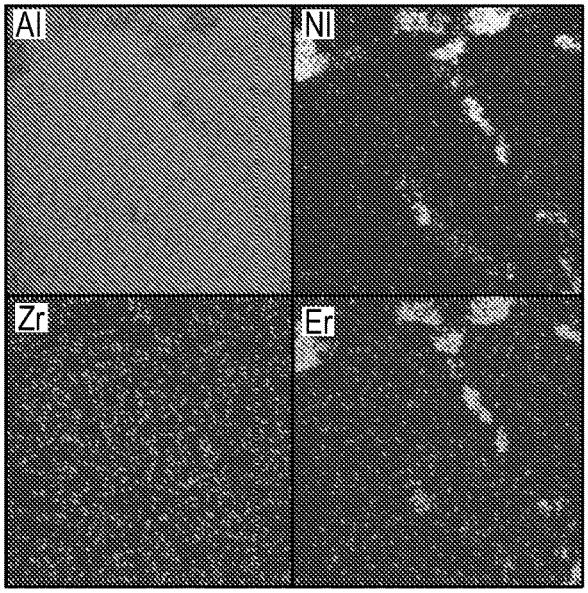
FIG. 86 includes corresponding EDS elemental maps showing distributions of aluminum, nickel, zirconium, and erbium.
Figure 88:
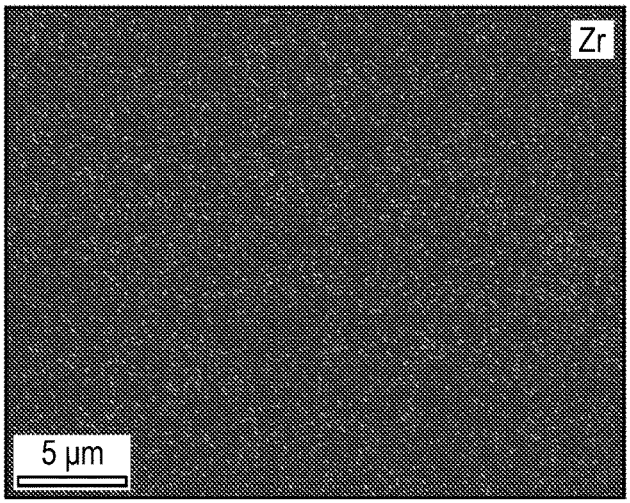
FIG. 88 shows the zirconium content from the scanning electron microscopy/energy dispersive spectroscopy (SEM-EDS) image of an induction-melted sample with the optimized composition.

Next, to assess the strengthening behavior, we performed Vickers' hardness measurements on these nine samples in both the as-built condition and after aging for 8 hours at 400° C. FIGS. 81 and 82 show the contour plots of hardness for these nine samples at these conditions. Consistent with our predicted optimum composition, the sample with nickel=1.33 molar % and zirconium=1 molar % showed the highest increase in hardness with aging, as expected from the $L1_2$ phase precipitation replacing the metastable ternary phase. The aged hardness of 147 HV is 50% higher than that of benchmark alloy 1, which was processed and tested under identical conditions. Moreover, this hardness is 34% higher than with zirconium=1 molar % and nickel=0 molar %, which does not contain ternary phases due to the lack of nickel. The SEM-EDS image of this sample shows microscale zirconium-rich areas inside grains, which are not present in the sample with nickel=1.33 molar % (FIGS. 84, 86, and 88). Based on this validation, we chose Al-2.73Ni-3.19Zr-2.33Er weight % for ultrasonic atomization of the powder. It is noteworthy that as seen in FIG. 11, the coarsening metric of this composition is relatively stable even if the erbium or zirconium contents change 50%. This confirms that the design will be robust even in the case of inherent variability and uncertainty of laser-based powder bed fusion during processing that might lead to the slight compositional change at the voxel size printing of the sample.

The 3D-printing process parameters, namely the power and scan speed, were optimized to achieve the highest density, as discussed in the section entitled, 3D Printing of Custom Alloys, infra. Samples (28 or 6×6×6 $mm^3$, FIG. 8) were verified to be crack-free. The electron backscatter diffraction (EBSD) images from the side and top of the samples show non-textured equiaxed grains (FIG. 9). Vickers hardness tests parallel to the built direction and on top of the samples were conducted in the as-built condition and after isothermal aging at 400° C. These values are compared in FIG. 2 with the benchmark aluminum alloy 1 and 7075 aluminum alloy aged under identical conditions. In the as-built condition, the optimized sample exhibits a hardness of 180 HV, comparable to wrought 7075 aluminum alloy. At peak hardness after 8-10 hours of aging, our optimized alloy has a higher strength than 7075 aluminum alloy and ~50% higher hardness than the benchmark alloy 1. The hardness has similar gradual overaging at 400° C. to the benchmark alloy 1, while the hardness of the benchmark alloy remains significantly below the designed alloy, confirming the high thermal stability of the optimized alloy. The hardness also surpasses values from wrought 7075 aluminum alloy at all times, and is known to be incompatible with laser-based powder bed fusion.

Figure 87:
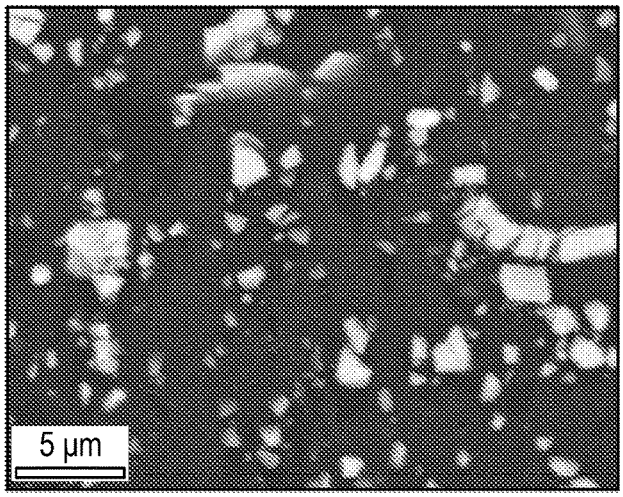
FIG. 87 is a scanning electron microscopy/energy dispersive spectroscopy (SEM-EDS) image of an induction-melted sample with the optimized composition; micro-scale phases that are rich in erbium and nickel contents are seen in this image and in FIGS. 89 and 90.
Figure 89:
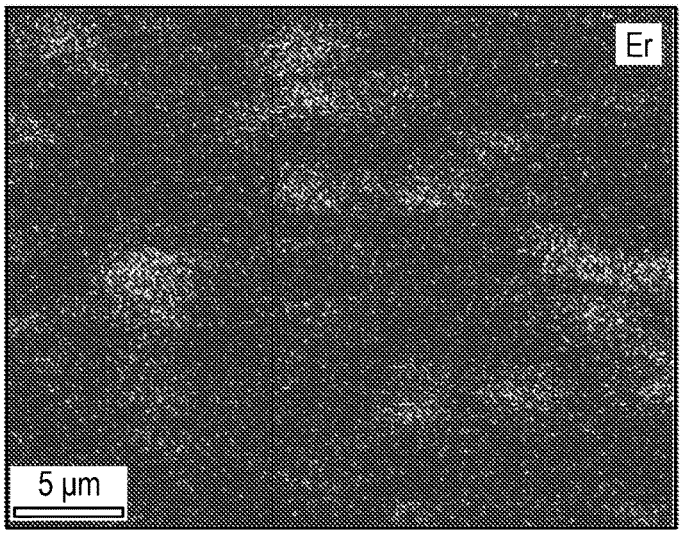
FIG. 89 shows the erbium content from the SEM-EDS image of the induction-melted sample with the optimized composition.
Figure 90:
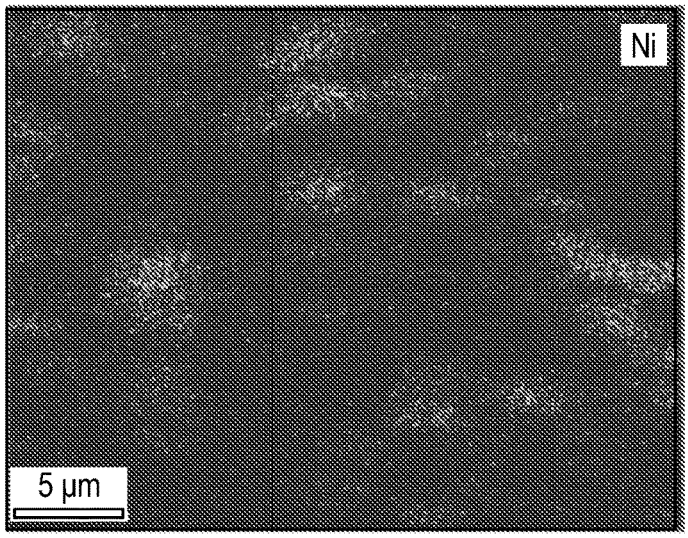
FIG. 90 shows the nickel content from the SEM-EDS image of the induction-melted sample with the optimized composition.

We induction melted the optimized composition. A scanning electron microscopy/energy dispersive spectroscopy (SEM-EDS) image of this sample shows large micro-size ternary phases (FIGS. 87-89). The hardness of this optimized sample is much smaller than ($1/5^{th}$) that of the aged 3D-printed sample, which confirms our concept of designing it to exploit nanoscale ternary phases for the enhancement of strength (FIG. 1). We also compared our hardness data with current cast and additive manufacturing aluminum alloys in the literature. Besides precipitation strengthening, the main strategy that is used in aluminum alloys is exploiting eutectic phases (dendrite arms) to partition grains. This strategy significantly contributes to the strengthening, especially as additive manufacturing processing decreases the size of the dendrite arms to nanoscale (e.g., less than 10 nm). As seen in FIG. 1, our optimized alloy, which only exploits precipitation hardening, has comparable as-built strength to a sample that gets the benefit from both mechanisms. To further confirm our enhanced strength, we performed tensile tests at room temperatures on samples aged for different aging durations at 400° C. As shown in FIG. 10, the high strength and stability are also confirmed in these experiments. Once more, our optimized alloy sample has 50% higher yield strength than the benchmark alloy 1.

Figure 19:
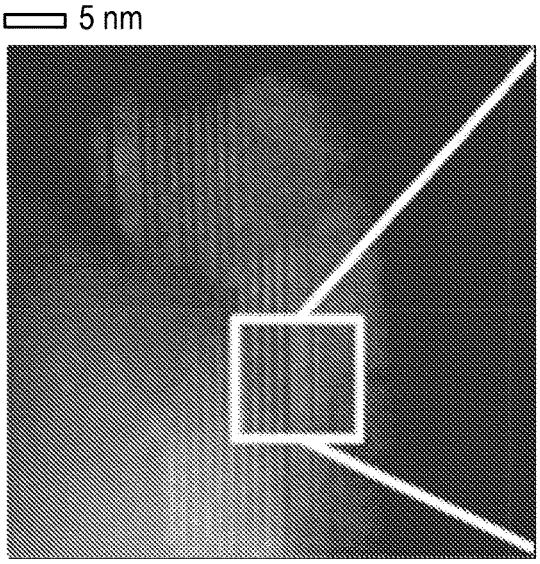
FIG. 19 is a higher-magnification image of a grain boundary precipitate coherent with the parent grain of the optimized 3D-printed sample.
Figure 20:
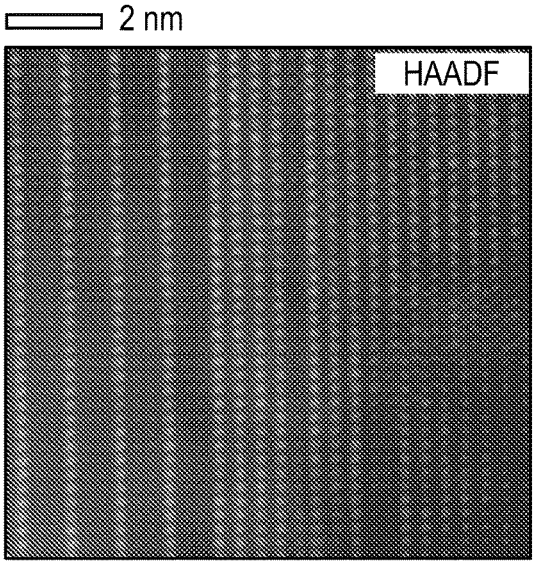
FIG. 20 is an atomic-resolution HAADF STEM image of this precipitate.
Figure 21:
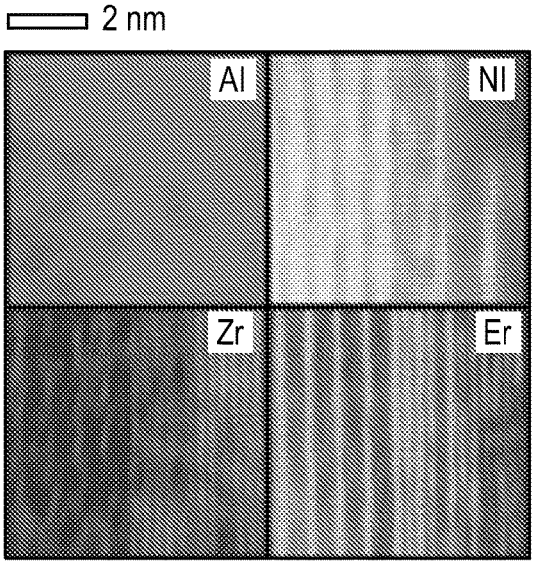
FIG. 21 includes corresponding de-noised energy dispersive spectroscopy (EDS) elemental maps for aluminum, nickel, zirconium, and erbium in the precipitate.
Figure 22:
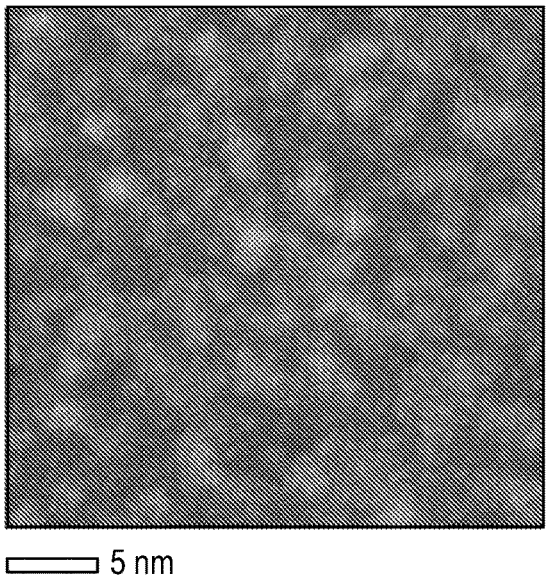
FIG. 22 is a HAADF STEM image of the grain interior showing $L1_2$ nanoprecipitates.
Figure 23:
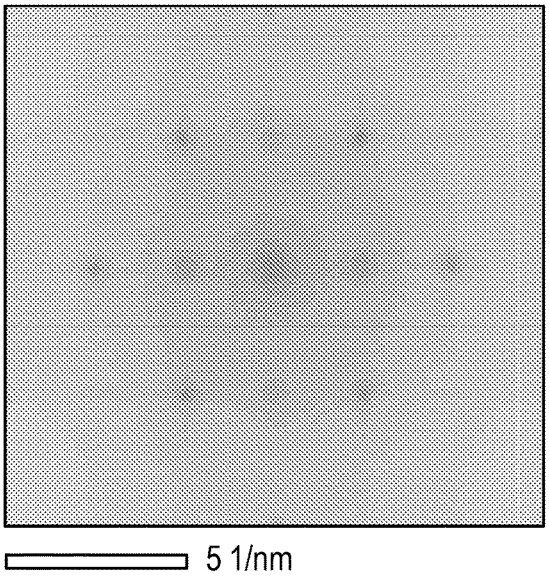
FIG. 23 shows {001}-type superlattice reflections present and circled in the Fast Fourier Transform (FFT).
Figure 24:
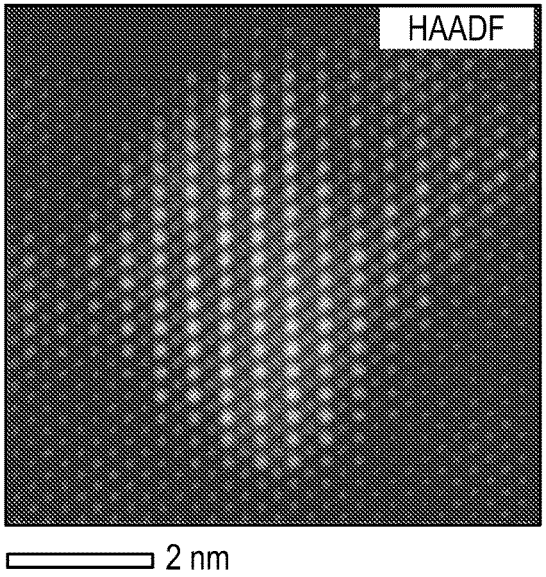
FIG. 24 is an atomic-resolution HAADF STEM image for an example $L1_2$ nanoprecipitate in the interior of the grains of the optimized 3D-printed sample.
Figure 25:
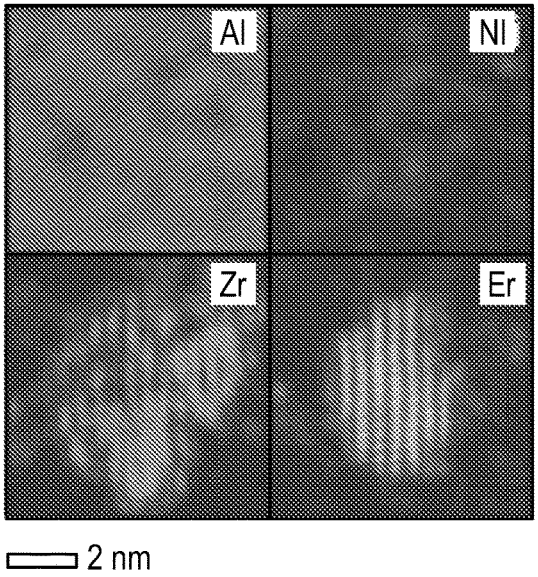
FIG. 25 shows corresponding de-noised EDS Al/Ni/Zr/Er elemental maps for an example $L1_2$ nanoprecipitate in the interior of the grains of the optimized 3D-printed sample.
Figure 26:
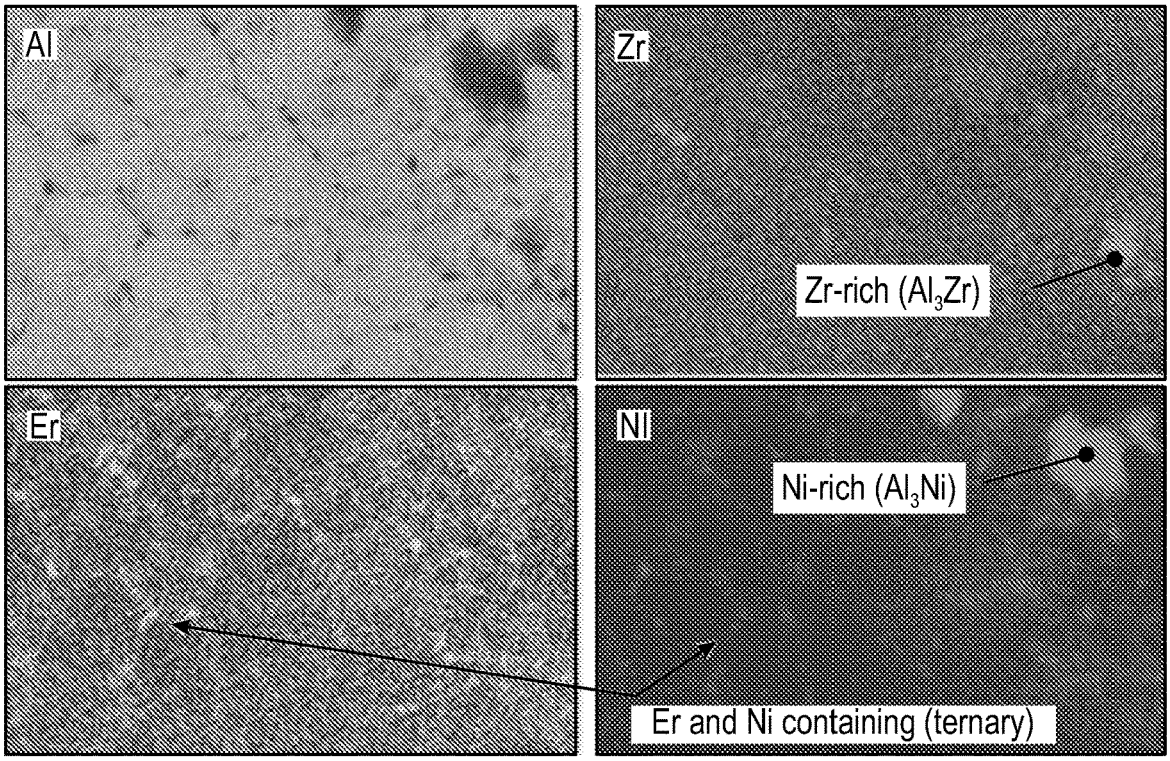
FIG. 26 includes EDS images of an SEM image showing the elemental distribution of (a) at upper left, aluminum; (b) at upper right, zirconium; (c) at lower left, erbium; and (d) at lower right, nickel.
Figure 27:
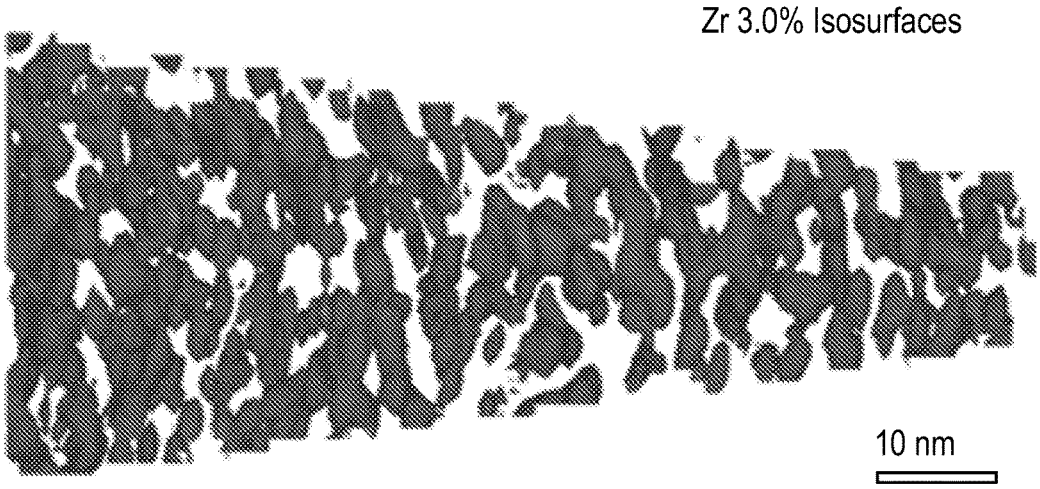
FIG. 27 is a reconstruction of a local electrode atom probe (LEAP) dataset containing a fine dispersion of Zr-rich precipitates. The isosurfaces where Zr=3.0 atomic % are shown in gray.
Figure 28:
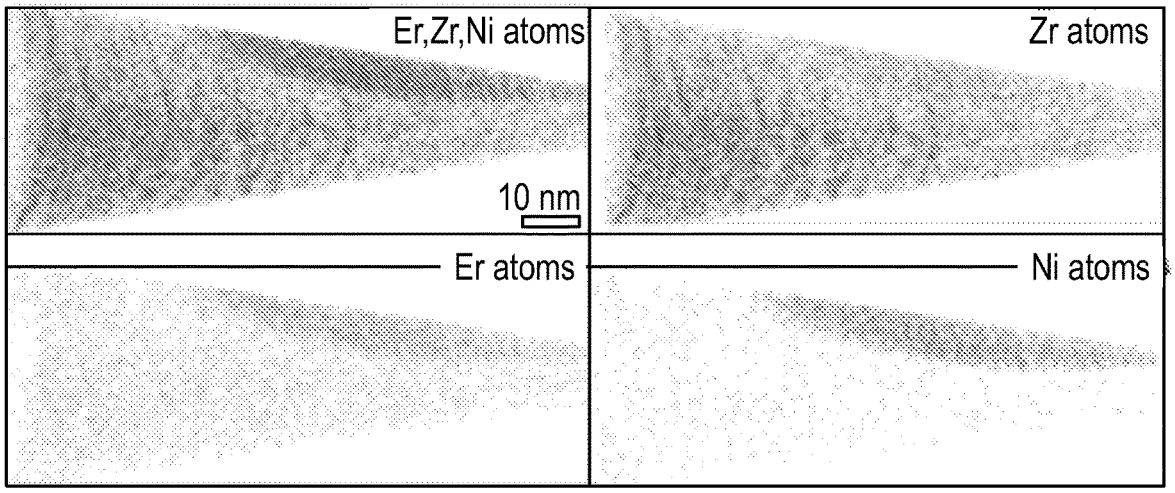
FIG. 28 provides an elemental segregation of erbium and nickel to a large secondary phase in the optimized 3D-printed sample.
Figure 29:
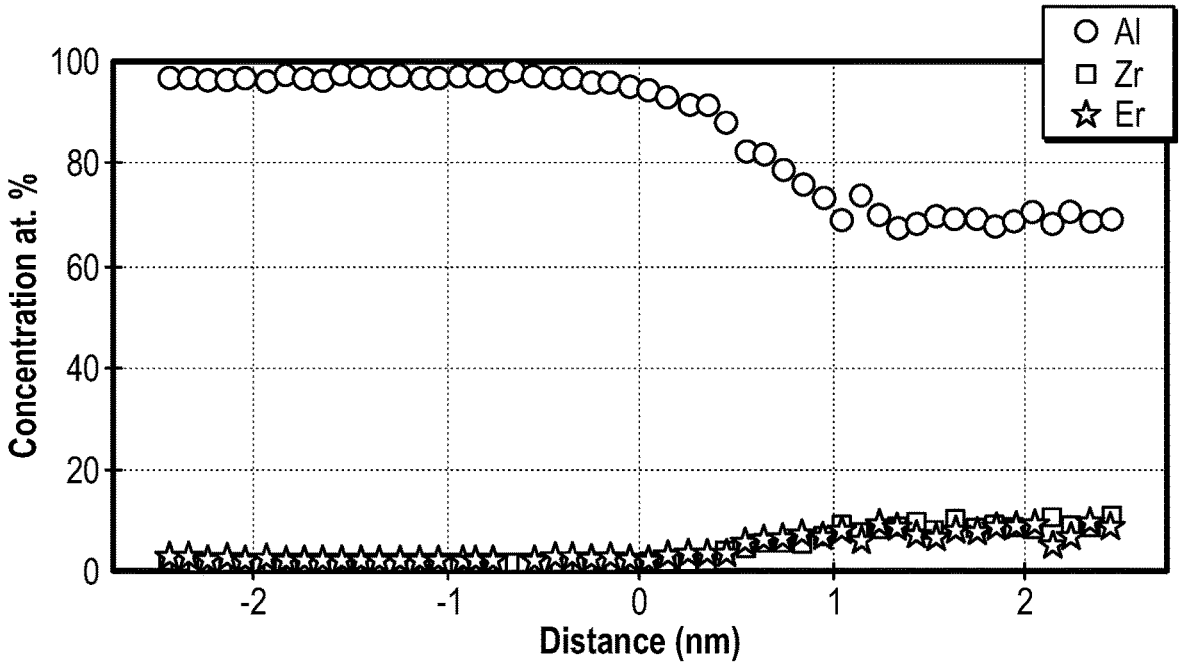
FIG. 29 is a proximity histogram for isosurface interfaces where Zr=3.0 atomic %, showing enrichment in both zirconium and erbium in the optimized 3D-printed sample.

Microstructural characterization was performed by scanning electron microscopy (SEM), scanning transmission electron microscopy (STEM), and local electrode atom probe tomography (LEAP APT) on the printed material aged for 8 hours, representing the peak hardness condition. The energy-dispersive x-ray spectroscopy (EDS) map (FIG. 26) corresponds to the SEM image (FIG. 17) and indicates large-scale Ni- and Zr-rich areas consistent with predicted primary $Al_3Ni$ and $Al_3Zr$ phases, respectively. The scanning transmission electron microscopy high-angle annular dark-field (STEM-HAADF) image of precipitates located at the grain boundary (FIGS. 18 and 19) shows the following two distinct structures: the predicted Al—Ni—M ternary phase and Al—Zr/Er $L1_2$ phase (FIGS. 19 and 20). Here, the region corresponding to the ternary phase contains Ni- and Er-rich atomic planes, while the $L1_2$ region is primarily erbium- and zirconium-rich (FIGS. 20 and 21). Atomic-resolution STEM-HAADF images of the grain interior show 1-5 nm regions with ordered bright and dim {100}-type planes, corresponding with $L1_2$ coherent precipitates (FIGS. 22 and 24). The Fourier transform of the image shows superlattice reflections consistent with an $L1_2$ structure, and atomic-resolution EDS maps indicate the segregation of aluminum versus erbium/zirconium in the $L1_2$ phase (FIGS. 23 and 25). Atom probe tomography (APT) results taken from the grain interior clearly confirm the $L1_2$ $Al_3$ (Er,Zr) precipitation, corresponding with the ~1-5 nm $L1_2$ precipitates seen from STEM characterization (FIGS. 27 and 29). This size scale meets our target of starting finer than an optimized particle diameter of 17 nm for creep resistance. The atom probe tomography (APT) of a sample containing a ternary phase also confirms a composition near the predicted $Al_{23}Ni_6M_4$ ternary compound (FIGS. 28 and 30).

Going forward, nanoprecipitation of metastable phases can be employed to enhance the strength of various alloys. The designed metastable phase may be used to strengthen nickel-based superalloys beside aluminum alloys. Moreover, this strengthening mechanism can be used for samples manufactured with various rapid solidification processes. The developed hybrid computational workflows can be applied to various multi-objective alloy design problems, incorporating manufacturing constraints, economic and environmental implications of the alloy composition, and employing accelerated experimental workflows [see DebRoy, T., et al., "Scientific, technological and economic issues in metal printing and their solutions," 18 Nature Materials, 1026-1032 (2019) and Fare, C., et al., "A multi-fidelity machine learning approach to high throughput materials screening," 8 NPJ Comput Mater 1-9 (2022). This is especially valuable to leverage the inherent non-equilibrium conditions imposed by rapid solidification in additive manufacturing, and the opportunity provided by additive manufacturing for spatially tailored and multi-material component design in concert with structural optimization methods [see Pollock, T. M., et al., "Design and Tailoring of Alloys for Additive Manufacturing," 51 Metall Mater Trans A Phys Metall Mater Sci 6000-6019 (2020); Qin, J., et al., "Research and application of machine learning for additive manufacturing," 52 Addit Manuf 102691 (2022); and Andersson, J. O., et al., "Thermo-Calc & DICTRA, computational tools for materials science," 26 CALPHAD 273-312 (2002)].

Methods and precipitation strengthening: In the Orowan strengthening mechanism, the shear stress required for looping around the precipitate is inversely proportional to the distance between precipitates, λ (see Equation 1, below). In this equation, M is the Taylor factor; G and v are the shear modulus and Poisson ratio, respectively; b is the magnitude of Burgers' vector; and $\bar{R}$ is the mean planar precipitate radius. Both $$\bar{R} = \sqrt{\frac{2}{3}} < R > \text{ and } \bar{\lambda} = \left(\sqrt{\frac{\pi}{4f}} - 1\right)\bar{R}$$

depend on the mean radius, <R>. Here, f is the volume fraction of the precipitates. Therefore, under a certain precipitate volume fraction, the Orowan strength decreases significantly as the precipitate size increases.

$$\sigma_{or} = M\frac{0.4Gb}{\pi\sqrt{1-\upsilon}} \cdot \frac{\ln\left(\frac{2\bar{R}}{b}\right)}{\bar{\lambda}} \tag{1}$$

Microstructure Stability at High Temperatures (Precipitate Coarsening Rates):

The optimized sample with minimized coarsening of precipitates maintains the strengthening at higher temperatures. The kinetics of this process are controlled by the volume diffusion of solute elements in small precipitates to adjacent larger ones. Therefore, the coarsening rate depends first on whether the alloying elements in the matrix and precipitates are contributing to bulk diffusion and second on how the interface between precipitate and matrix allows this growth of precipitates. The interfacial contribution depends on the interfacial energy. Equation 2 explains the contribution of the bulk diffusion resistivity (denominator) and interfacial energy (numerator) to the coarsening rate in multi-component alloying systems. In this equation, the mobility matrix (M) is assumed to be diagonal. $1/M_i$ is thus the inverse of diagonal coefficients. σ is the interfacial energy of precipitate-matrix boundaries, and $$V_m^\beta$$

is the partial molar volume $$\bar{C}_i^\beta - \bar{C}_i^\alpha$$

refers to the temporal average solubility difference of the elements in the precipitates and the matrix at equilibrium and at the target temperature.

$$k \propto \frac{V_m^\beta \sigma}{\Sigma_{i=2}^N \left(C_i^\beta - C_i^\alpha\right)^2 / M_i} \tag{2}$$

Herein, we refer to $$\Sigma_{i=2}^N \left(C_i^\beta - C_i^\alpha\right)^2 / M_i$$

as diffusion resistivity. Reducing the mismatch of the lattice parameters between a matrix and precipitates is crucial for minimizing the interfacial energy between the phases in both coherent and semi-coherent boundaries. The absolute lattice parameter mismatch for the precipitate and matrix structures is calculated by Equation 3 as follows:

$$\varepsilon = 100\left|1 - \frac{a}{a_0}\right|. \tag{3}$$

Here, α is a lattice parameter for the precipitate, and $\alpha_o$ is the aluminum lattice parameter. In fact, the lattice parameters depend on both the alloying elements and the thermal expansion resulting from increasing temperature at the target service temperature. We consider the product of misfit strain (ε) and the inverse of diffusion resistivity as our coarsening metric.

Printability:

The freezing range (FR) is the interval between the temperature at which the alloy is completely liquid and the temperature at which it is 99% solidified $$(FR = T_0^S - T_{0.99}^S).$$

As this temperature interval gets larger, the solidification dendrites are not fed with liquid, leading to shrinkage and thermal contractions and finally cavities and hot cracking. Therefore, minimizing the freezing range is advantageous to evaluate the hot cracking susceptibility. Here, we also analyze the hot cracking susceptibility of the developed aluminum alloy via the model developed by Clyne and Davis to evaluate the cracking susceptibility coefficient [Clyne, T. W. and Davies, G. J., "Solidification and Casting of Metals," in The Metals Society 275-78 (1979)]. According to this model, mass and liquid feeding start from a normalized time, $t_R$ (0.6 to 0.1 volume fraction of liquid), in which stresses at the mushy zone can be relaxed. However, the cracking-vulnerable time, $t_v$, is defined from 0.1 to 0.01 volume fraction of liquid. Consequently, the ratio, $t_v/t_R$, results in the cracking susceptibility coefficient parameter. We obtained data for the freezing range and cracking susceptibility coefficient parameters by conducting nonequilibrium Scheil solidification simulations. To measure the cracking susceptibility coefficient parameter, we assumed that heat flow is proportional to the square root of time. Note that the high-melting precipitation of rare earth elements significantly increases the freezing range. However, based on experiments, these initial precipitations do not increase hot cracking susceptibility. Thus, these precipitates are ignored during the freezing range and cracking susceptibility coefficient calculations. Therefore, to ensure printability of our aluminum alloy, we aim to minimize the hot cracking susceptibility, which is the product of the freezing range and the cracking susceptibility coefficient.

Machine-Learning (ML) Analysis:

Using the Latin hypercube sampling (LHS) random sampling technique, we generated 250,000 and 500,000 data points. We then used the THERMO-CALC software to perform single equilibrium calculations at 250° C. The molar % of the elements in the $L1_2$ phases and in the aluminum matrix were extracted using the TC-python interface and fed into Equation 2. The molar % of the five elements in the composition constitutes our feature/input vector. We normalized the input values by deducing the mean and scaling to the variance. We used the cuML library (with machine-learning algorithms) from the RAPIDS machine-learning library developed by NVIDIA for the KNN, RF, SVR, GB, and LR techniques, and the TENSORFLOW machine-learning platform for the NN regression technique. We divided the data into training (varying %) and test datasets (20%). The hyperparameters associated with the ML techniques are presented in Table 1, below.

TABLE 1

Hyperparameters that were parametric-studied for each regressor to develop the manifold

| Regression technique | Hyperparameters |
|---|---|
| Neural network (NN) | FC neuron # = 32, 32, 64, 64; # of FC layers = 2, 3, 4; Batch size = 32, 64, 128, 256, 512, 1024, 2048; Training loop number = 100, 1000, 10,000, 150,000, 200,000; Learning rate = $10^{-4}$, $10^{-3}$, and $10^{-2}$; Regularization factor $L_1 = 10^{-6}$, $10^{-5}$; Regularization factor $L_2 = 10^{-2}$, $10^{-3}$ |
| K-nearest-neighbors (KNN) | n_neighbors = 1, 2, 3, 4, 5, 6, 7, 8 |
| Support vector machine (SVM) | kernel = 'rbf'; C = 1, 10, 100, 1000 |
| Random forest (RF) | Max_depth = 2, 4, 6, 8, 10; n_estimators = 2, 4, 6, 8, 10 |
| Extreme gradient boost (XGB) | Max_depth = 2, 4, 6, 8, 10; num_boost_round = 20, 40, 60, 80, 100, 120 |
| Linear regression (LR) | |

The hyperparameters were optimized using grid search and five-fold cross validation (80% for training and 20% for validation) of the root mean square error (RMSE). The target predicted value was the coarsening metric of $L1_2$ phases. After defining the optimum set of hyperparameters for each technique, we measured the prediction error on the test data set for different percentages of the training data. NN regression showed the minimum RMSE compared to other techniques at different percentages. The lower RMSE of NN is partially due to the available hyperparameters in the cuML 3.2 library being currently limited and the whole spectrum of hyperparameters being not fully implemented. The NN regressor was thus used to forward predict coarsening metrics used in inverse design techniques. We applied two inverse design approaches. First, we used Bayesian optimization (BO) with Gaussian processing (GP) as a surrogate model and generated data using the NN regressor. As a second method in this approach, we also calculated the labels of the data directly using the TC-python interface of the THERMO-CALC software. In the second approach, we used particle swarm optimization for the inverse design technique and generated the labels of data from the NN regressor. GP was chosen as the surrogate model for the Bayesian optimization as it has a relatively low number of hyperparameters; our objective function is continuous, and the uncertainty of the fitted model is known. The uncertainty defines the tradeoff between exploration and exploitation in the acquisition function of Bayesian optimization.

Sem Characterization:

Scanning-electron-microscopy backscattered electrons (SEM-BSE) and scanning-electron-microscopy energy dispersive spectroscopy (SEM-EDS) data were collected on a JSM7900F field-emission scanning electron microscope (FE-SEM) from JEOL Ltd. equipped with an ULTIM MAX 100 $mm^2$ detector from Oxford Instruments. Backscattered-electron (BSE) images were collected at 5 kV and 20 kV to optimize surface sensitivity and contrast, respectively. SEM-EDS data were also collected at 5 kV and at 15-20 kV in order to prioritize spatial resolution of surface features at the lower voltage and to permit detection of the full suite of elements including erbium at the higher voltage. EDS spectra and maps were collected and processed using AZTEC 5.1 software from Oxford Instruments.

SEM-BSE and SEM-EDS data of zero-nickel and induction-melted alloys were collected on an APREO HIVAC SEM (from Thermo Fisher Scientific) equipped with an EDAX ELITE 150 silicon drift detector (SDD) EDS detector. The BSE-EDS data were obtained at 15 kV in order to measure the presence of all elements and to give the optimal spatial resolution on EDS maps. The EDS spectra and maps were processed using APEX software from Gatan EDAX.

Scanning electron microscopy electron backscatter diffraction (SEM-EBSD) data of the top and side surface of our designed alloy were collected on an APREO HIVAC SEM (from Thermo Fisher Scientific) equipped with an HIKARI EBSD detector from Gatan EDAX. The EBSD data were collected at 15 kV, and the step size was set to 0.045 μm to secure the spatial resolution. The raw Kikuchi diffractograms were post-analyzed in OIM ANALYSIS software from Gatan EDAX and using home-developed Sphinx software.

STEM characterization:

Standard lift-out transmission electron microscope (TEM) samples were prepared using a HELIOS NANOLAB 660 focused ion beam microscope (from Thermo Fisher Scientific). After selecting a sample region containing a representative collection of features of interest via backscatter electron imaging, we extracted a lamella and attached it to a molybdenum OMNIPROBE TEM grid using an OMNIPROBE 400 micromanipulator (from Oxford Instruments). Due to the large ion range of gallium ions in aluminum, which can cause significant damage and corresponding artifacts during TEM imaging, we reduced the ion beam energy from 30 kV to 16 kV at a sample thickness of 300 nm and then halved it again at corresponding half thicknesses. Final polishing was performed at 750 V using a Model 1040 NANOMILL system (from Fischione Instruments) until a thickness of approximately 50 nm was reached. To remove the effects of Ga-ion damage, the TEM lamella was further cleaned using a Model 1051 TEM Mill from Fischione Instruments. Light Ar-ion milling was performed at 0.3 and 0.1 kV for 3 and 1 minutes, respectively.

Scanning transmission electron microscope (STEM) images were captured with a probe-corrected THEMIS Z 60-300 kV probe aberration-corrected TEM/STEM (from Thermo Fisher Scientific) using an accelerating voltage of 300 kV, a beam current of 40 pA, and a probe convergence semi-angle of 18.8 mrad. High-angle annular dark-field (HAADF) images were collected with a collection semi-angle range of 78-200 mrad. Atomic resolution HAADF images were drift-corrected using the revolving STEM (RevSTEM) method, in which an 8-frame image series was acquired with a 90° rotation between each consecutive frame [see Sang, X., et al., "Revolving scanning transmission electron microscopy: Correcting sample drift distortion without prior knowledge," 138 Ultramicroscopy 28-35 (2014)]. Position-averaged convergent beam electron diffraction (PACBED) patterns were used to determine the sample thickness, which was approximately 30 nm for the imaged region [LeBeau, J. M., et al., "Position averaged convergent beam electron diffraction: Theory and applications," 110 Ultramicroscopy 118-125 (2010)]. Energy dispersive spectroscopy (EDS) was performed using a SUPER X detector from Thermo Fisher Scientific and processed using *VELOX* software from Thermo Fisher Scientific. Low-magnification EDS was performed using a beam current of 200 pA and filtered using a 5 px averaging filter. Atomic-resolution EDS maps were acquired using a beam current of 50 pA and filtered using non-local principal component analysis (NLPCA) [see Yankovich, A. B., et al., "Non-rigid registration and non-local principle component analysis to improve electron microscopy spectrum images," 27 Nanotechnology 264001 (2016)].

Atom Probe Tomography (APT) of 3D-Printed Samples:

We prepared specimens for atom probe tomography (APT) following standard lift-out methods, using a HELIOS 660 dual-beam focused ion beam (FIB)/SEM from FEI Company. APT was performed with a LEAP 4000X HR atom probe microscope from CAMECA, operated in voltage-pulsing mode with the following experimental conditions: base temperature=40 K, pulse rate=100 kHz, pulse fraction=15%, and detection rate=0.5%.

Each LEAP dataset was reconstructed and analyzed using IVAS software version 3.6.14 from CAMECA. We used SEM images of each LEAP tip to measure the shank half angle and tip radius; these images were incorporated into the shape of the reconstruction. Two of the LEAP tips showed a fine dispersion of zirconium-rich precipitates, and one LEAP tip showed a large phase rich in erbium and nickel. The zirconium-rich precipitates were segmented using isosurfaces set to 3.0% zirconium (FIG. 27). The erbium- and nickel-rich phase was segmented using an isosurface set to 2.5% nickel, as shown in FIG. 28. The reconstructions shown here illustrate the zirconium=3.0% isosurfaces and the collection of erbium and nickel in second phases, respectively. A proximity histogram concentration profile was applied to both second phases and for all interfaces set by the isosurfaces (FIGS. 29 & 30). A bin size of 0.1 nm was used for both histograms.

The compositions of the matrix and fine precipitates were measured using two LEAP tips segmented with zirconium=0.3 atomic % isosurfaces, and the composition of the large second phase was measured from the third LEAP tip (see Table 2, below). These measurements indicate that the fine precipitates are the $L1_2$ phase, and the large second phase is the ternary Al—Ni—Er/Zr phase.

TABLE 2

Measured compositions for the matrix, $L1_2$, and ternary phases:

| Composition (mass fraction) | Al | Er | Zr | Ni |
|---|---|---|---|---|
| Matrix | 0.9947 | 8.2e–05 | 0.009272 | 0.000543 |
| $L1_2$ | 0.79776 | 0.006912 | 0.193834 | 0.000475 |
| Ternary | 0.68717 | 0.91445 | 0.079137 | 0.138222 |
| Bulk | 0.9218 | 0.0237 | 0.029 | 0.0255 |

High-Throughput Study of Coarsening Rate:

To study the coarsening rates of our precipitates, we first performed high-throughput calculations on diffusion resistivity $$\left(\sum_{i=2}^{N}\left(\bar{C}_i^{\beta}-\bar{C}_i^{\alpha}\right)^2/M_i\right),$$

misfit ε, and the coarsening metric, which is $$\left(\frac{\text{misfit } \varepsilon}{\sum_{i=2}^{N}\left(\bar{C}_i^{\beta}-\bar{C}_i^{\alpha}\right)^2/M_i}\right).$$

FIGS. 33-41 shows the distribution of the input elements for all generated data, which have a good uniform distribution in the studied range. The three target parameters were calculated; the values were normalized with the associated values from aluminum alloy 1 [see Gong, J., et al., WO 2019/108596 A1 (2019)], which has the same alloying elements and is designed for the same combination of properties.

Figure 42:
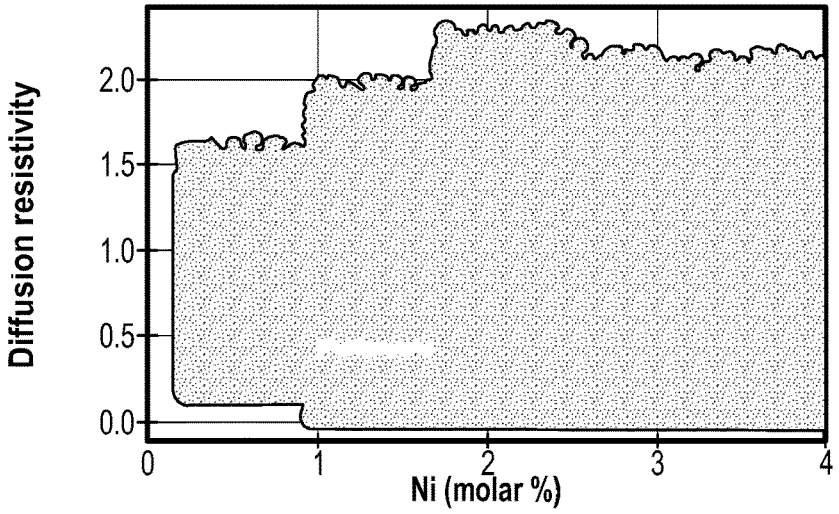
FIG. 42 is a plot of diffusion resistivity of the alloy compositions formed from the random precursor sample compositions with the indicated nickel molar percentages.
Figure 43:
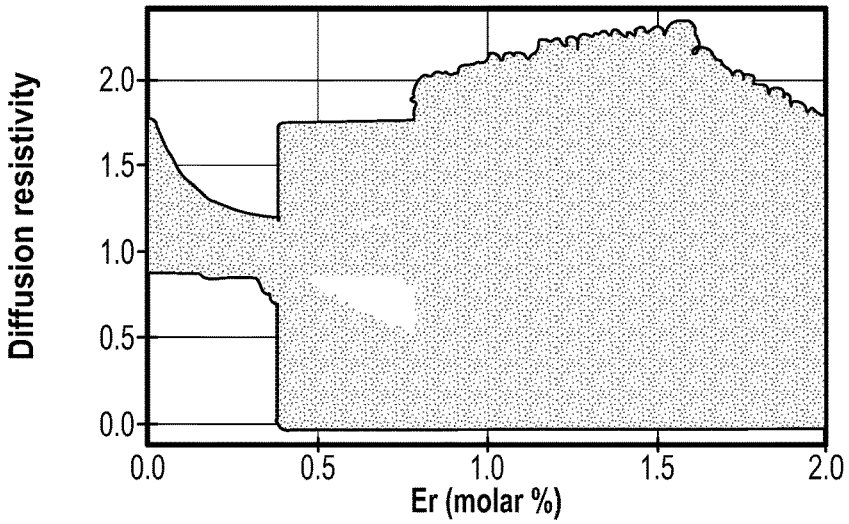
FIG. 43 is a plot of diffusion resistivity of the alloy compositions formed from the random precursor sample compositions with the indicated erbium molar percentages.
Figure 44:
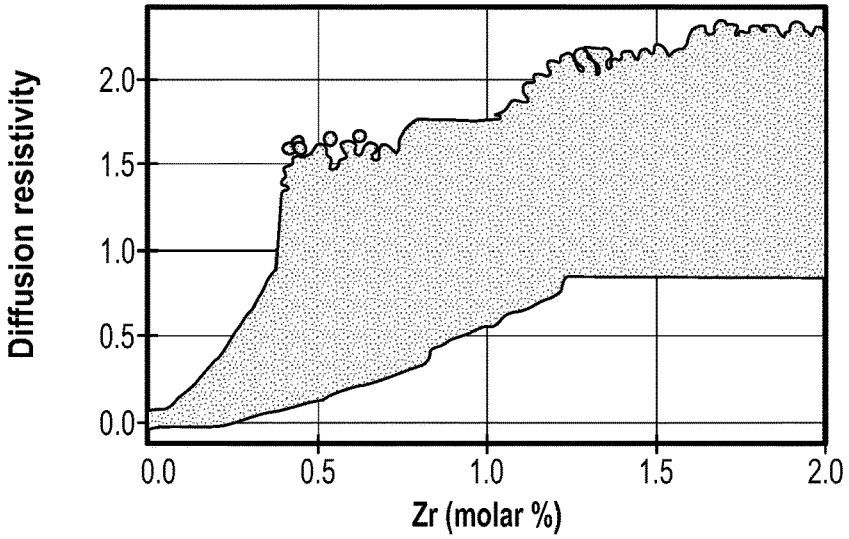
FIG. 44 is a plot of diffusion resistivity of the alloy compositions formed from the random precursor sample compositions with the indicated zirconium molar percentages.
Figure 45:
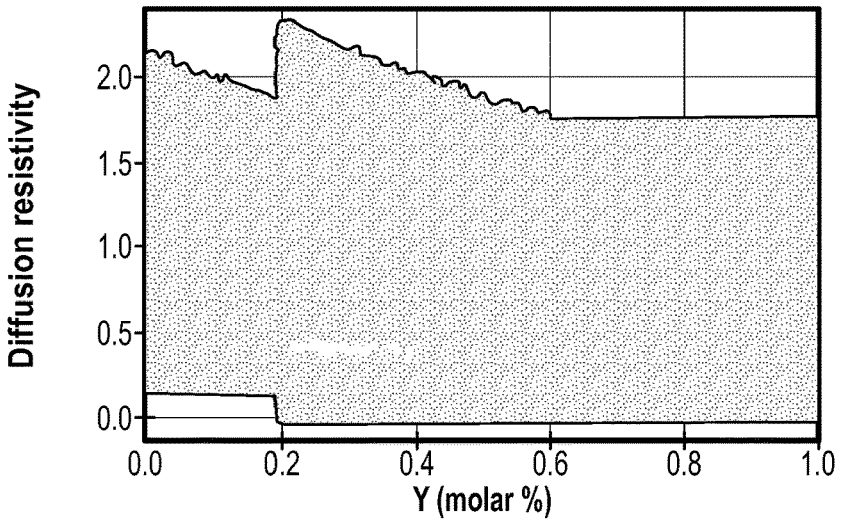
FIG. 45 is a plot of diffusion resistivity of the alloy compositions formed from the random precursor sample compositions with the indicated yttrium molar percentages.
Figure 46:
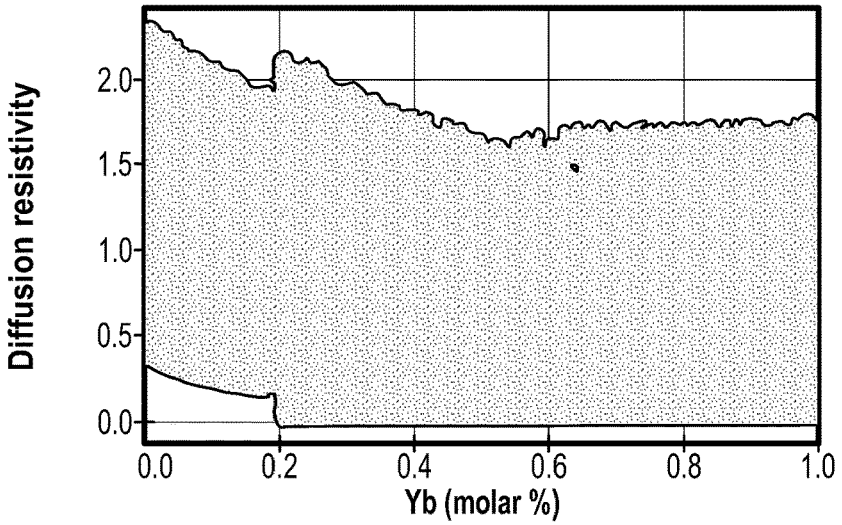
FIG. 46 is a plot of diffusion resistivity of the alloy compositions formed from the random precursor sample compositions with the indicated ytterbium molar percentages.
Figure 47:
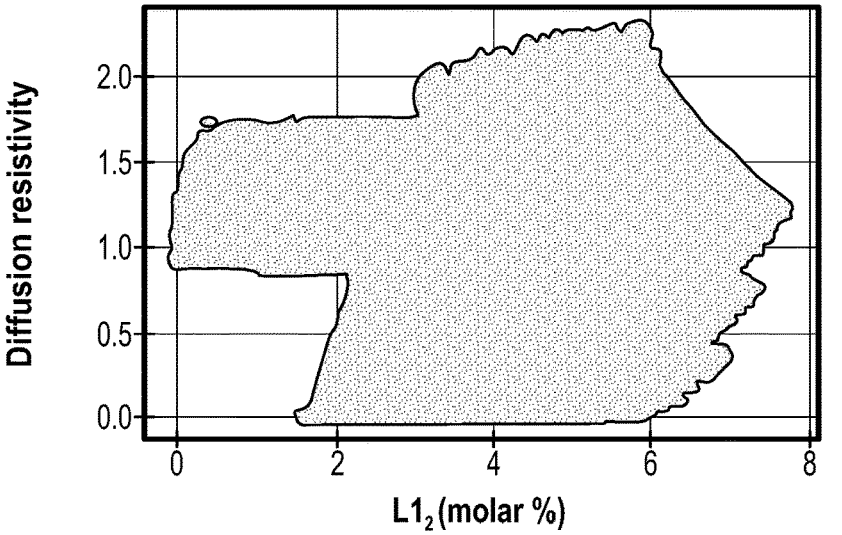
FIG. 47 is a plot of diffusion resistivity for different molar percentages of the $L1_2$ phase formed from the random precursor sample compositions.
Figure 48:
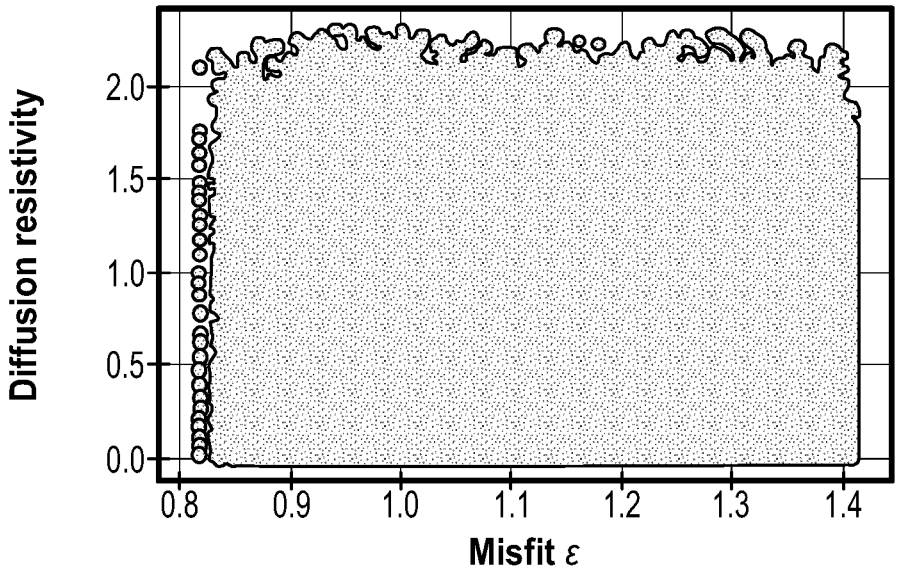
FIG. 48 is a plot of diffusion resistivity for the different misfit strain values at the phase interfaces in the alloy compositions formed from the random precursor sample compositions.
Figure 49:
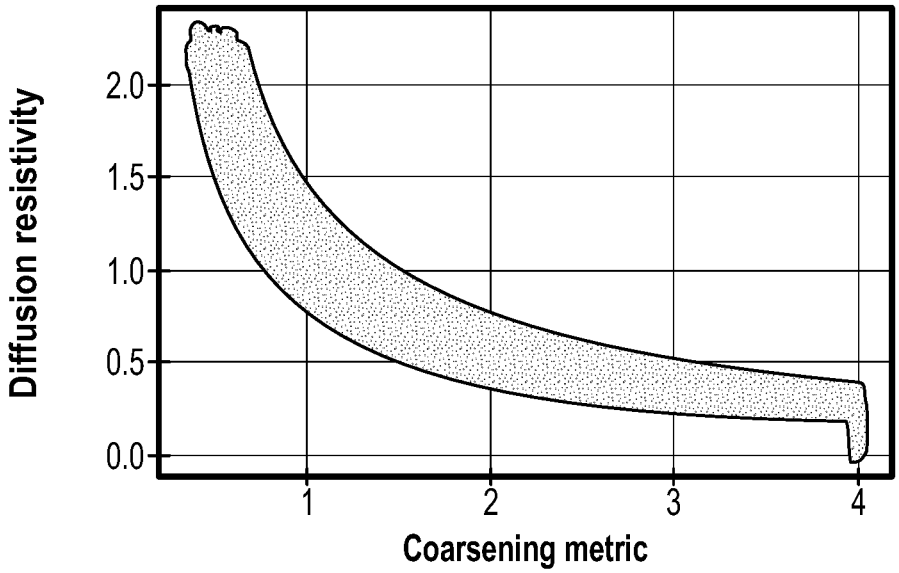
FIG. 49 is a plot of diffusion resistivity for the different coarsening metrics of the $L1_2$ phase formed from the random precursor sample compositions.
Figure 50:
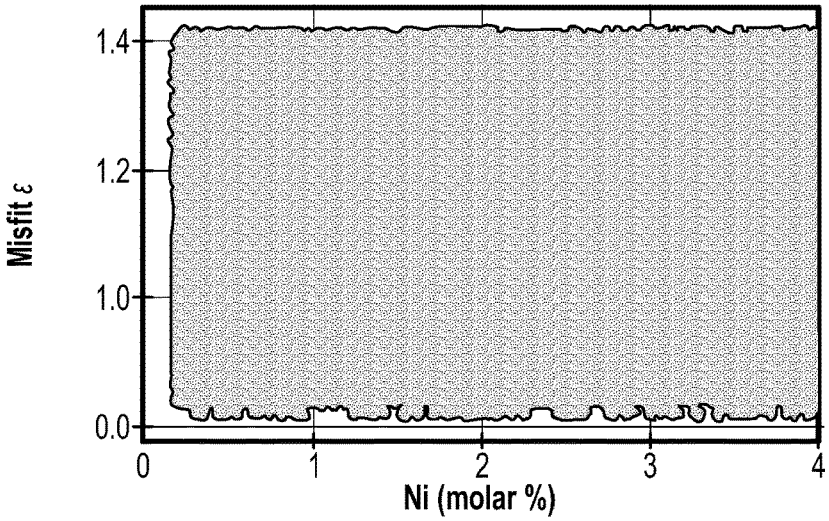
FIG. 50 is a plot of misfit strain values at the phase interfaces in alloy compositions formed from the random precursor sample compositions with the indicated nickel molar concentrations.
Figure 51:
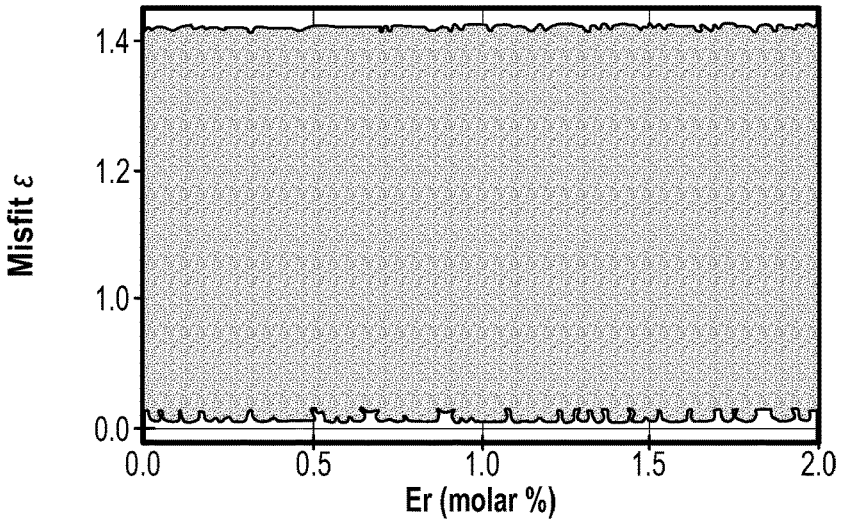
FIG. 51 is a plot of misfit strain values at the phase interfaces in alloy compositions formed from the random precursor sample compositions with the indicated erbium molar concentrations.
Figure 52:
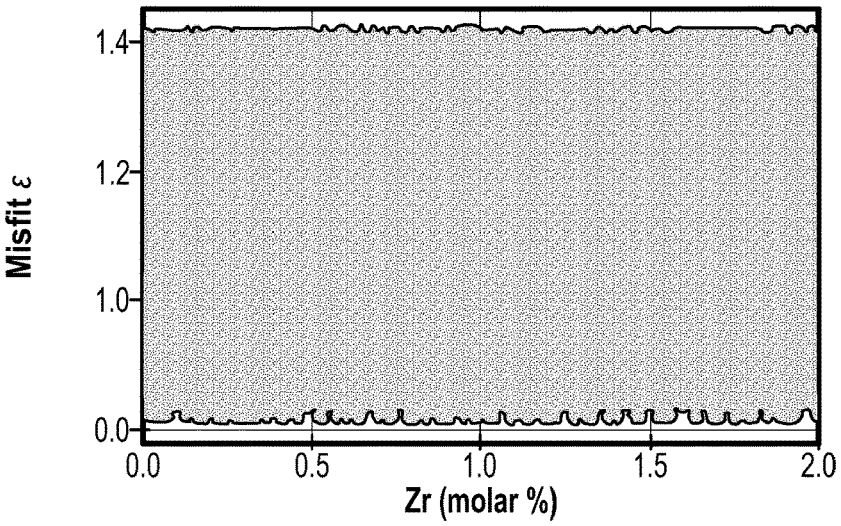
FIG. 52 is a plot of misfit strain values at the phase interfaces in alloy compositions formed from the random precursor sample compositions with the indicated zirconium molar concentrations.
Figure 53:
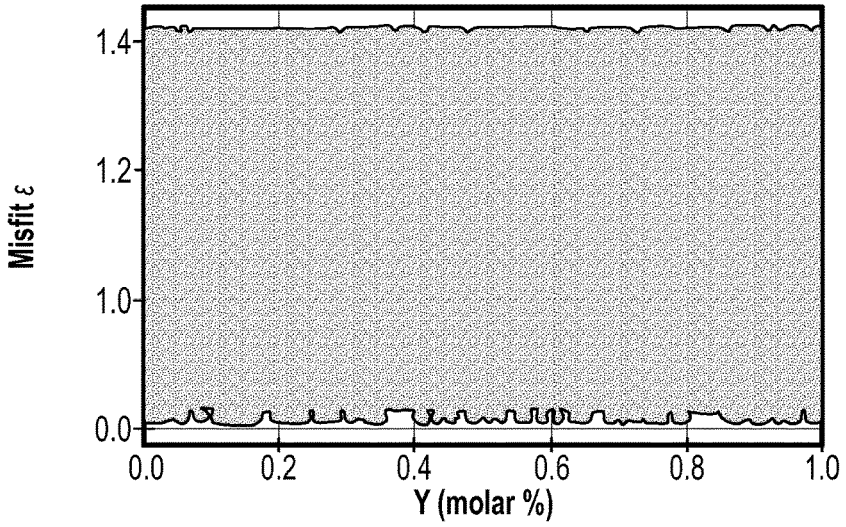
FIG. 53 is a plot of misfit strain values at the phase interfaces in alloy compositions formed from the random precursor sample compositions with the indicated yttrium molar concentrations.
Figure 54:
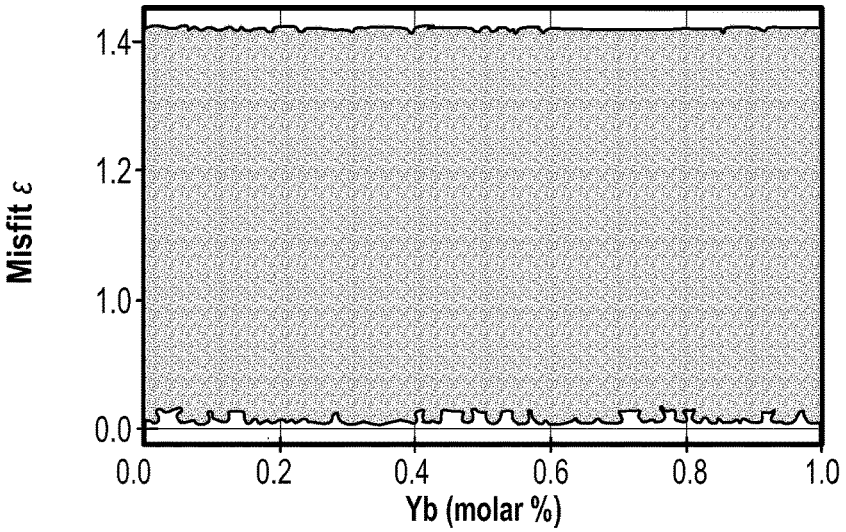
FIG. 54 is a plot of misfit strain values at the phase interfaces in alloy compositions formed from the random precursor sample compositions with the indicated ytterbium molar concentrations.
Figure 55:
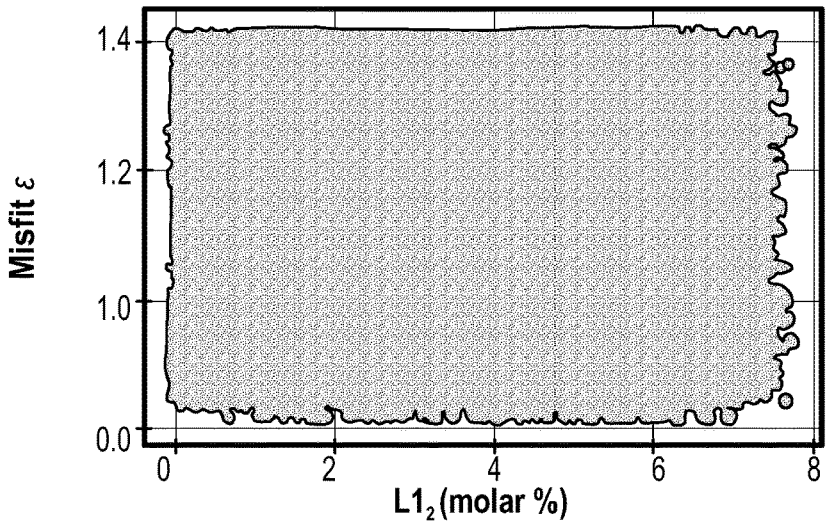
FIG. 55 is a plot of misfit strain values at the phase interfaces in the alloy compositions with the indicated molar concentrations of the $L1_2$ phase formed from the random precursor sample compositions.
Figure 56:
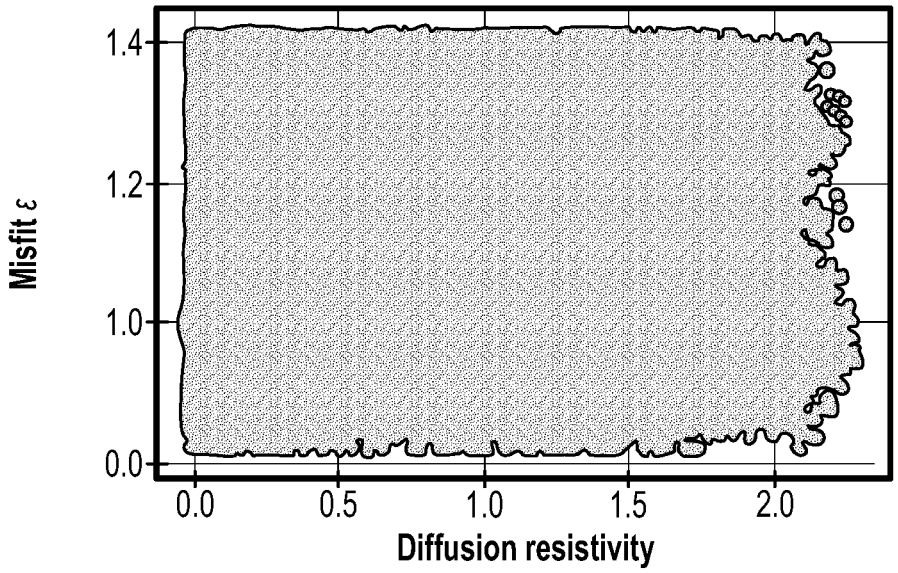
FIG. 56 is a plot of misfit strain values at the phase interfaces in the alloy compositions with the indicated diffusivity resistivity values.
Figure 57:
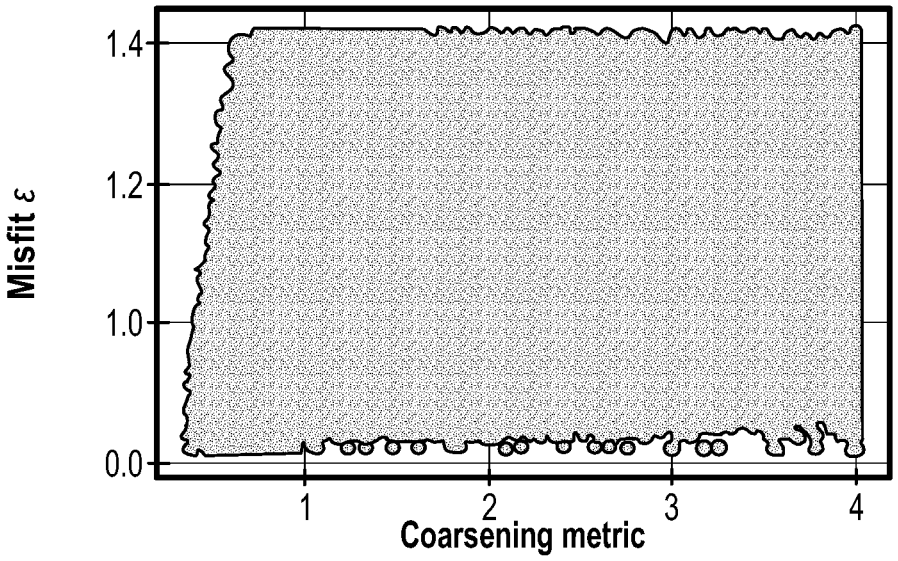
FIG. 57 is a plot of misfit strain values at the phase interfaces in the alloy compositions with the indicated coarsening metrics for the $L1_2$ phase.
Figure 58:
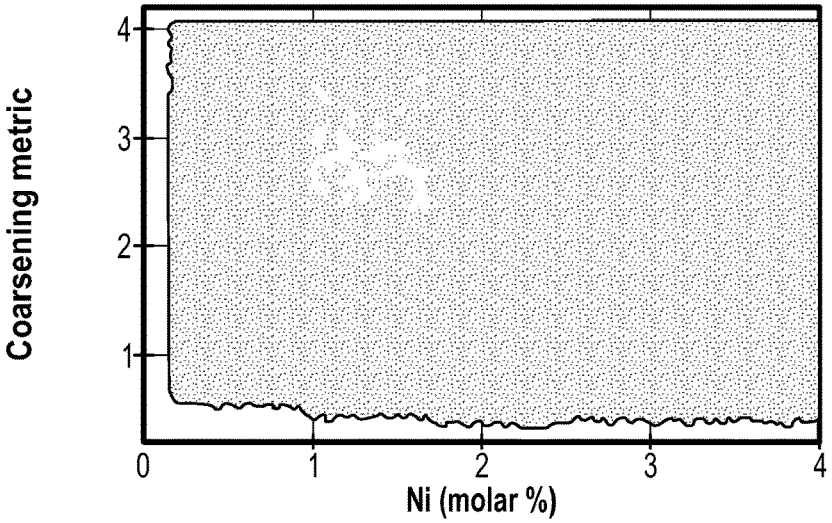
FIG. 58 is a plot of the coarsening metric for the $L1_2$ phase in the alloy compositions formed from the random precursor sample compositions with the indicated nickel molar percentages.
Figure 59:
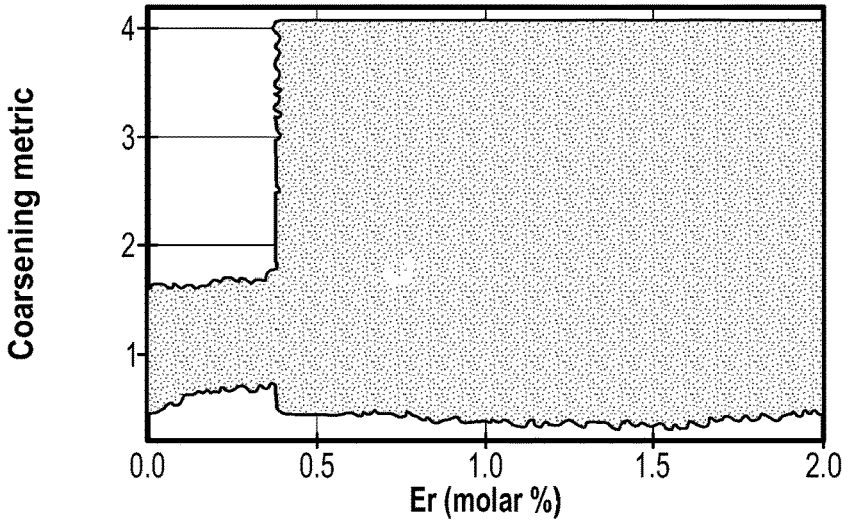
FIG. 59 is a plot of the coarsening metric for the $L1_2$ phase in the alloy compositions formed from the random precursor sample compositions with the indicated erbium molar percentages.
Figure 60:
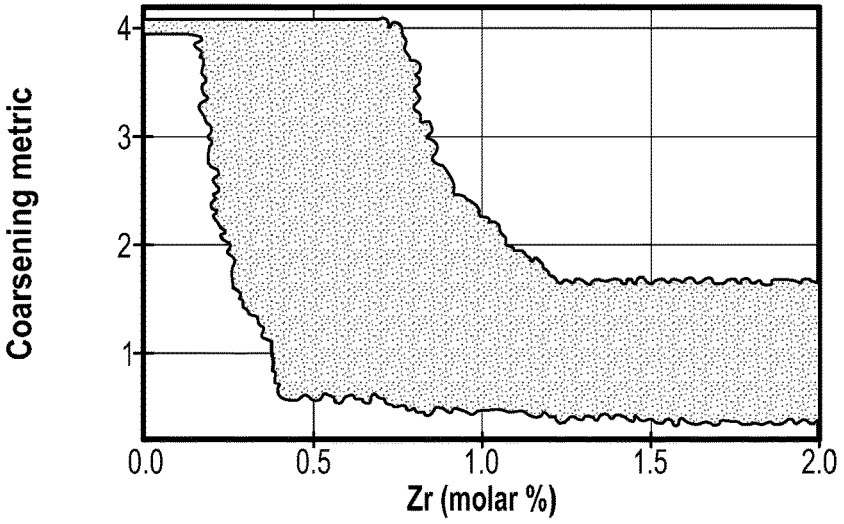
FIG. 60 is a plot of the coarsening metric for the $L1_2$ phase in the alloy compositions formed from the random precursor sample compositions with the indicated zirconium molar percentages.
Figure 61:
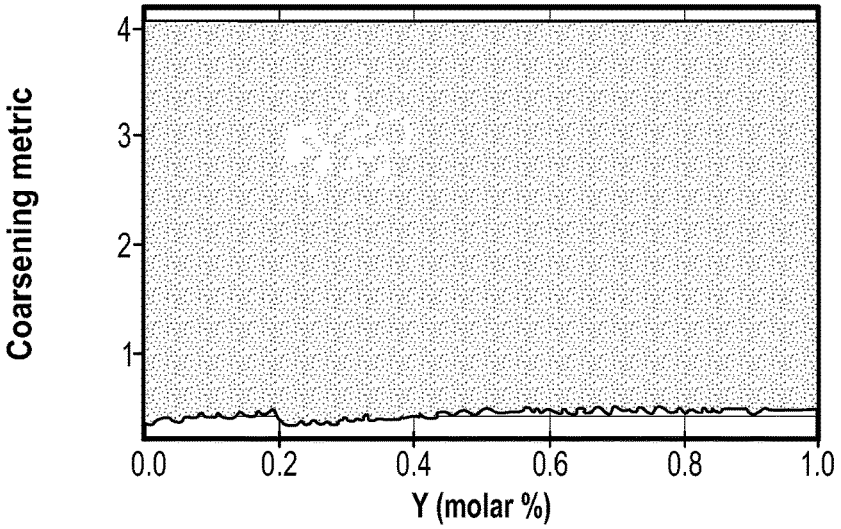
FIG. 61 is a plot of the coarsening metric for the $L1_2$ phase in the alloy compositions formed from the random precursor sample compositions with the indicated yttrium molar percentages.
Figure 62:
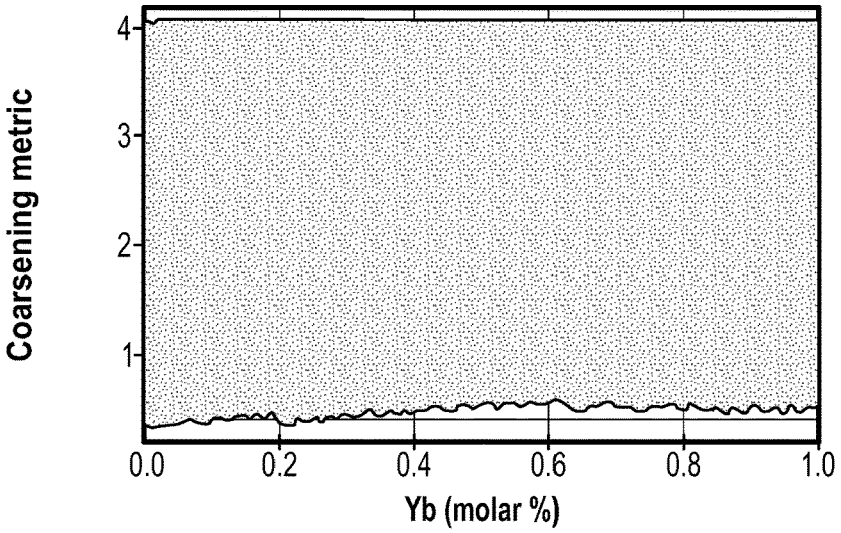
FIG. 62 is a plot of the coarsening metric for the $L1_2$ phase in the alloy compositions formed from the random precursor sample compositions with the indicated ytterbium molar percentages.
Figure 63:
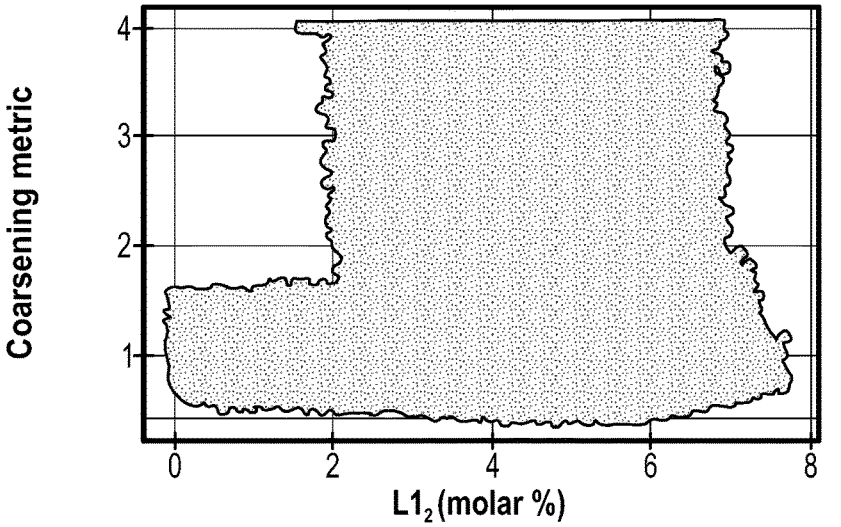
FIG. 63 is a plot of the coarsening metric for the $L1_2$ phase in the alloy compositions with the indicated molar concentrations of the $L1_2$ phase formed from the random precursor sample compositions.

FIGS. 42-49 show the distribution of diffusion resistivity with respect to the studied parameters: Ni, Er, Zr, Y, and Yb molar percentages; diffusion resistivity; misfit strain (ε); and the coarsening metric. FIG. 42 shows that lowering the amount of nickel suppresses normalized diffusion resistivity above 1.6 and below 0.1. Moreover, erbium decreases the diffusion resistivity when increased to 0.35 molar %. Further, high diffusion resistivities are found for erbium in 1.2-1.6 molar %. Moreover, it is evident that zirconium has a notable contribution to the increase in diffusion resistivity. Analysis of the diffusion resistivity with respect to the yttrium molar % shows that the highest values are achieved when the yttrium molar % ranges between 0.2 and 0.3. When ytterbium is increased, the diffusion resistivity decreases initially from the maximum values throughout the range and appears to distribute uniformly in the 0-1.65 range. FIGS. 50-57 show the distribution of misfit strain (ε) with respect to the studied parameters. The distributions do not indicate a specific correlation between the molar % of alloying elements and the misfit strain (ε). The distribution of misfit strain (c) with respect to the coarsening metric shows that at lower coarsening metrics, the misfit strain (ε) also achieves low values, as expected.

Figure 64:
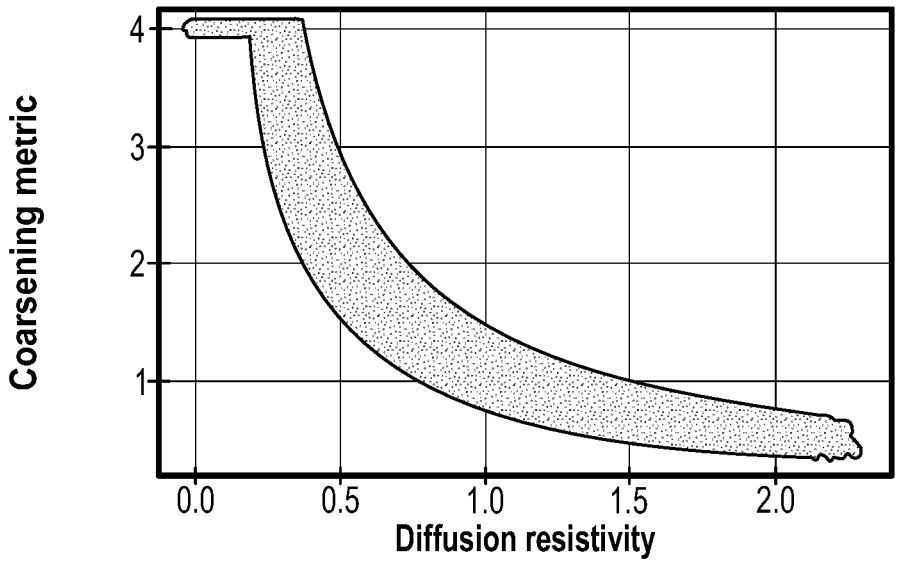
FIG. 64 is a plot of the coarsening metric for the $L1_2$ phase in the alloy compositions with the indicated diffusivity resistivity values.
Figure 65:
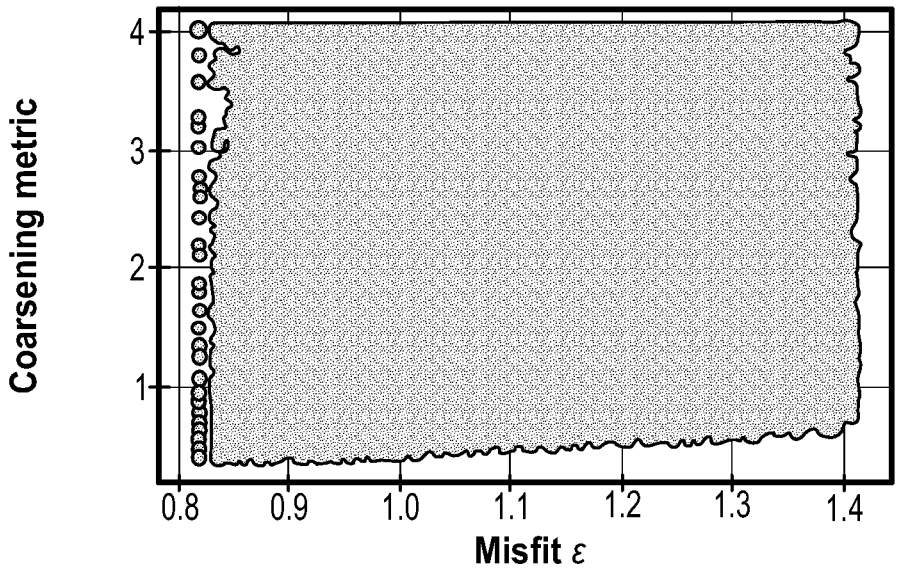
FIG. 65 is a plot of the coarsening metric for the $L1_2$ phase in the alloy compositions with the indicated misfit strain values at the phase interfaces in the alloy compositions.

FIGS. 58-65 show the coarsening metrics with respect to the studied parameters: Ni, Er, Zr, Y, and Yb molar %; diffusion resistivity; and strain (ε). These subplots reveal that among alloying elements, zirconium plays the most significant role in decreasing the coarsening metric. Moreover, the initial increase of erbium concentration from 0 to 0.4 molar % seems to increase the range in the variation of coarsening metrics remarkably. FIGS. 64 and 65 show that the coarsening metric is highly influenced by diffusion resistivity and is less influenced by misfit strain (ε).

Spearman Coefficient and Parallel Plots of Coarsening Metric:

The correlations between the studied parameters are shown in the heat map in FIG. 31. The heat map represents the Spearman coefficient and indicates a linear correlation for each ranked pair of parameters. The Spearman coefficient values are also presented in FIG. 31. The parameters show that, as expected, zirconium has the greatest influence on the diffusion resistivity, increasing it by 0.78; ytterbium has the inverse effect, decreasing it by 0.35. Erbium and yttrium rank second and third, respectively, in terms of their influence on decreasing the bulk resistivity. Nickel seems to have no influence on this parameter. The fluence of these elements on the coarsening metric is the same but in a reverse trend of their diffusion resistivity index. Finally, as can be seen from the distributions in FIGS. 64 and 65, the diffusion resistivity is more influential, decreasing the coarsening metric (by 0.96) than the misfit strain (ε), which decreases the coarsening metric by 0.22.

Figure 66:
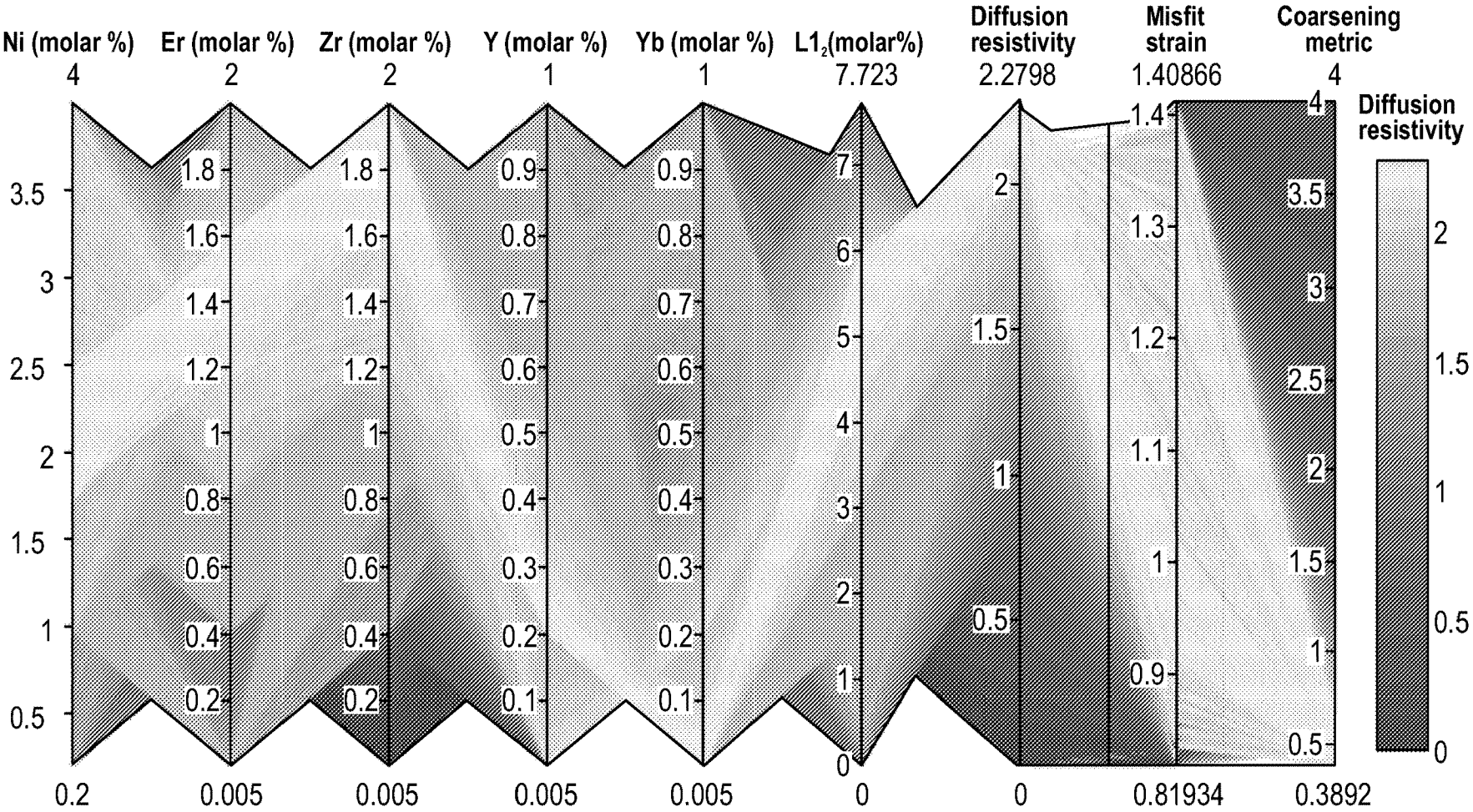
FIG. 66 is a parallel plot of design parameters, including molar values for the various elemental constituents and the $L1_2$ phase, the diffusion resistivity, the misfit strain, and the coarsening metric, wherein the diffusion resistivity is indicated by the shading.
Figure 67:
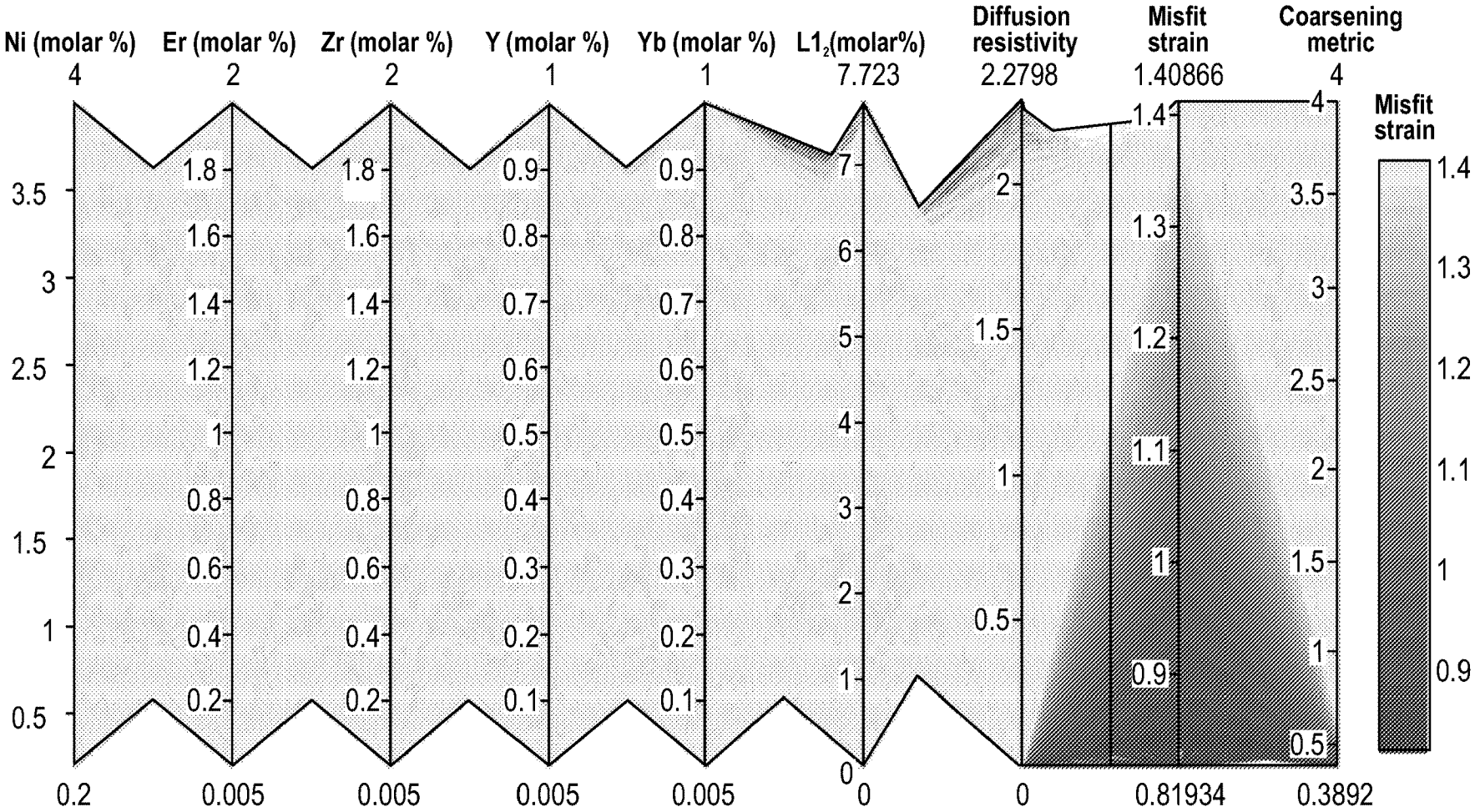
FIG. 67 is a parallel plot of design parameters, including molar values for the various elemental constituents and the $L1_2$ phase, the diffusion resistivity, the misfit strain, and the coarsening metric, wherein the misfit strain is indicated by the shading.
Figure 68:
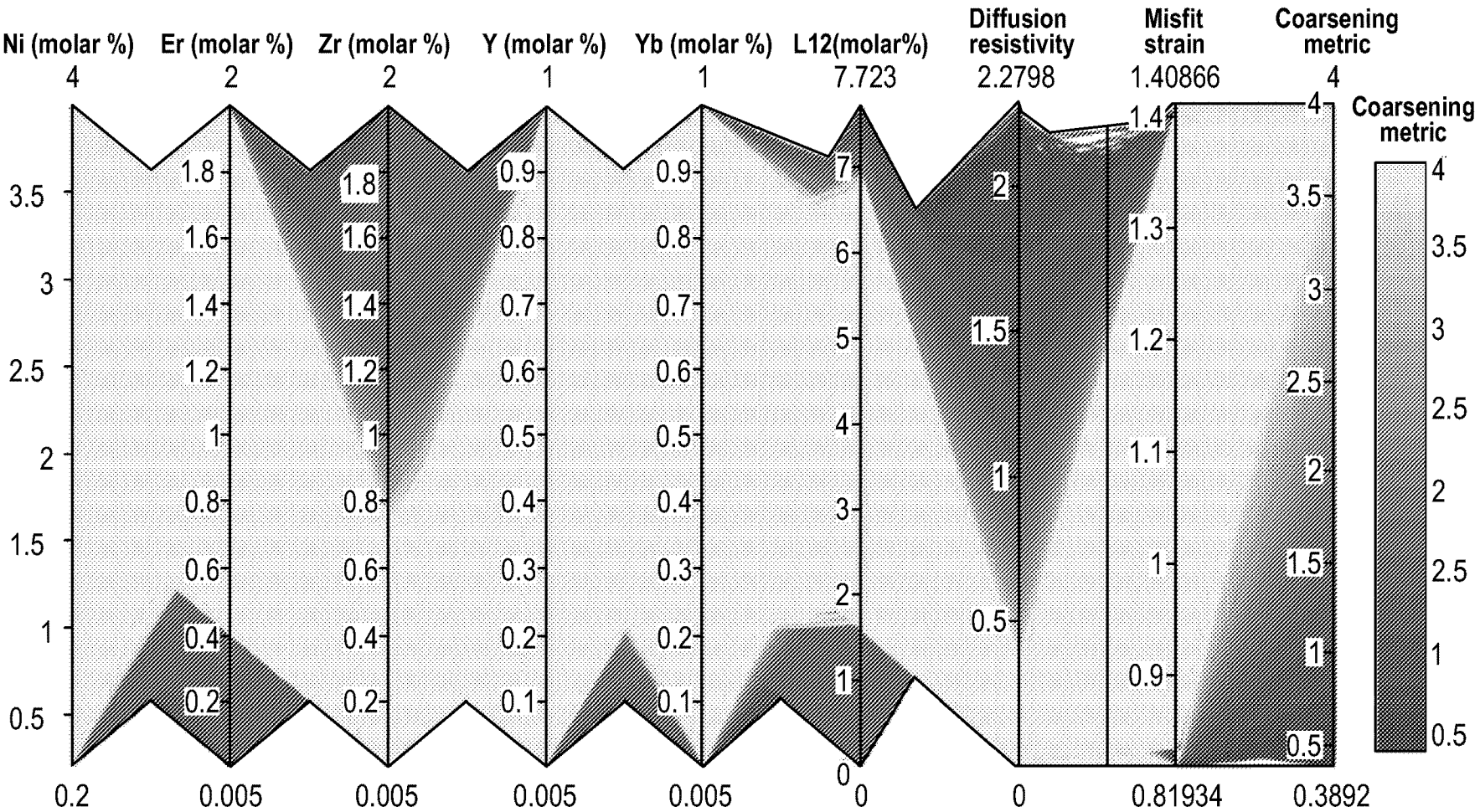
FIG. 68 is a parallel plot of design parameters, including molar values for the various elemental constituents and the $L1_2$ phase, the diffusion resistivity, the misfit strain, and the coarsening metric, wherein the coarsening metric is indicated by the shading.
Figure 69:
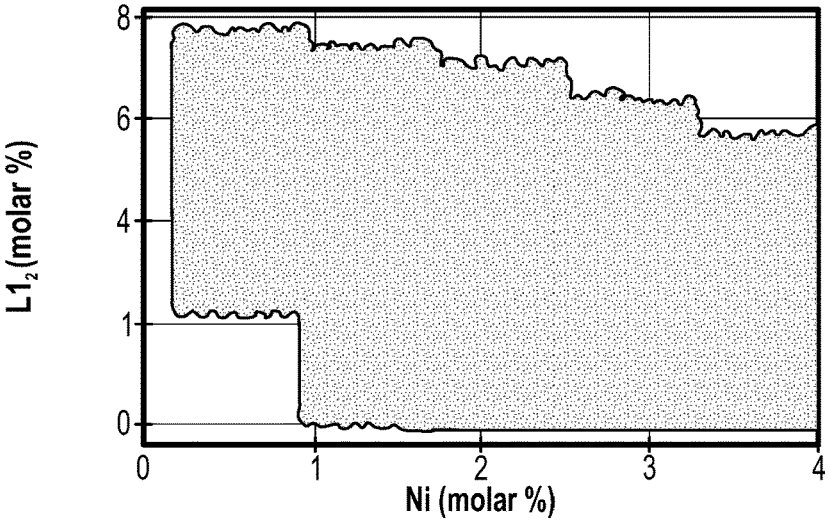
FIG. 69 is a plot of the molar concentrations of the $L1_2$ phase formed from the random precursor sample compositions with the indicated nickel molar percentages.
Figure 70:
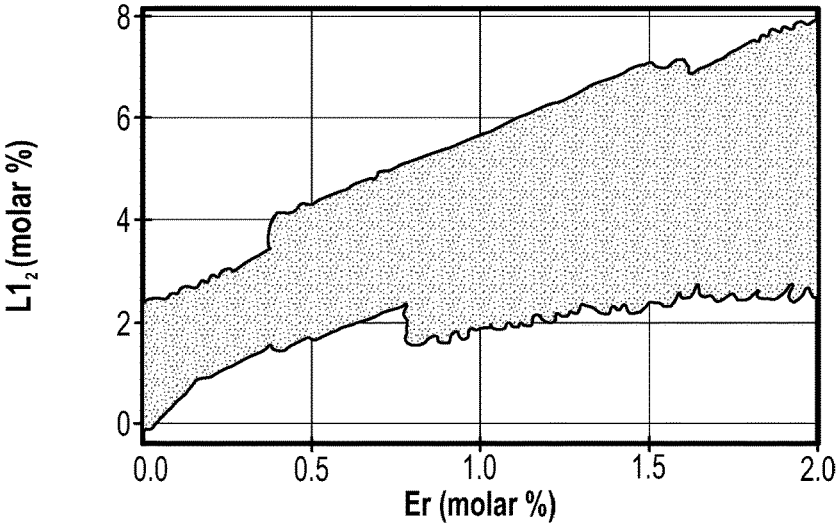
FIG. 70 is a plot of the molar concentrations of the $L1_2$ phase formed from the random precursor sample compositions with the indicated erbium molar percentages.
Figure 71:
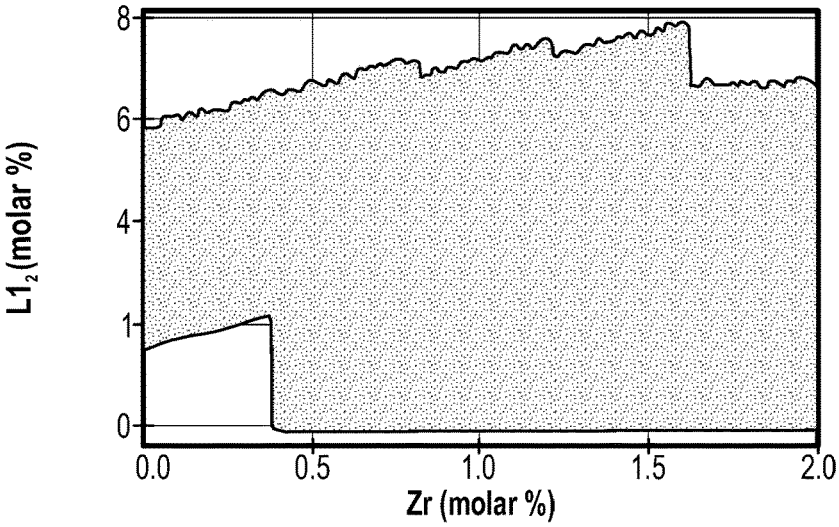
FIG. 71 is a plot of the molar concentrations of the $L1_2$ phase formed from the random precursor sample compositions with the indicated zirconium molar percentages.
Figure 72:
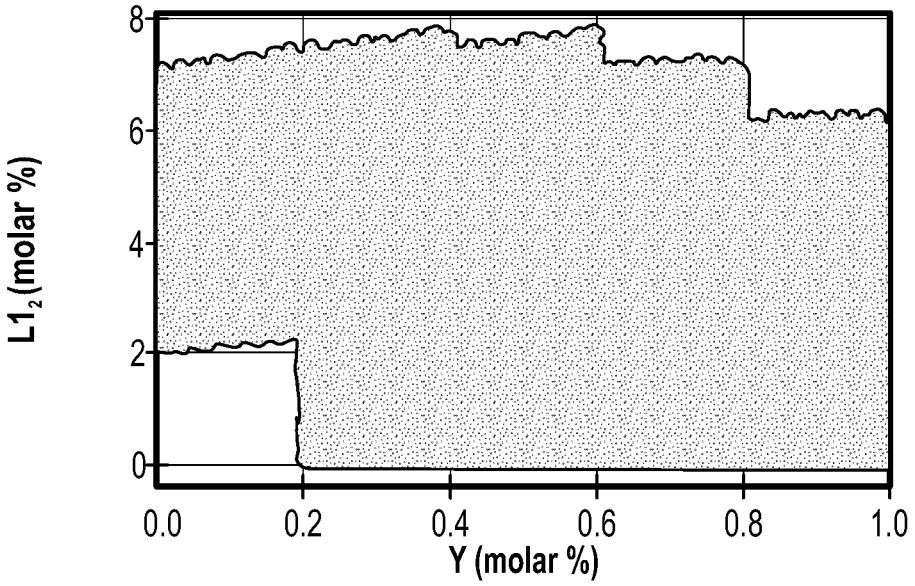
FIG. 72 is a plot of the molar concentrations of the $L1_2$ phase formed from the random precursor sample compositions with the indicated yttrium molar percentages.
Figure 73:
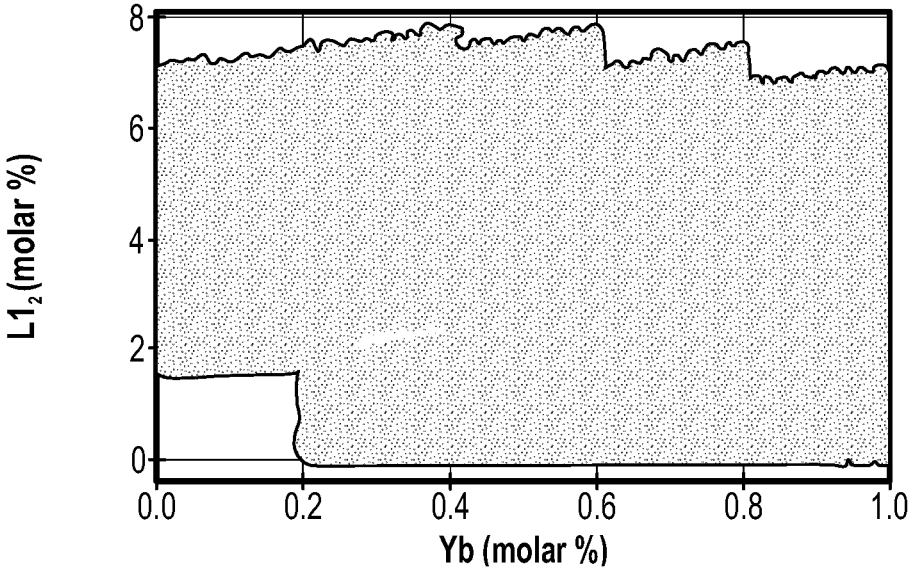
FIG. 73 is a plot of the molar concentrations of the $L1_2$ phase formed from the random precursor sample compositions with the indicated ytterbium molar percentages.
Figure 74:
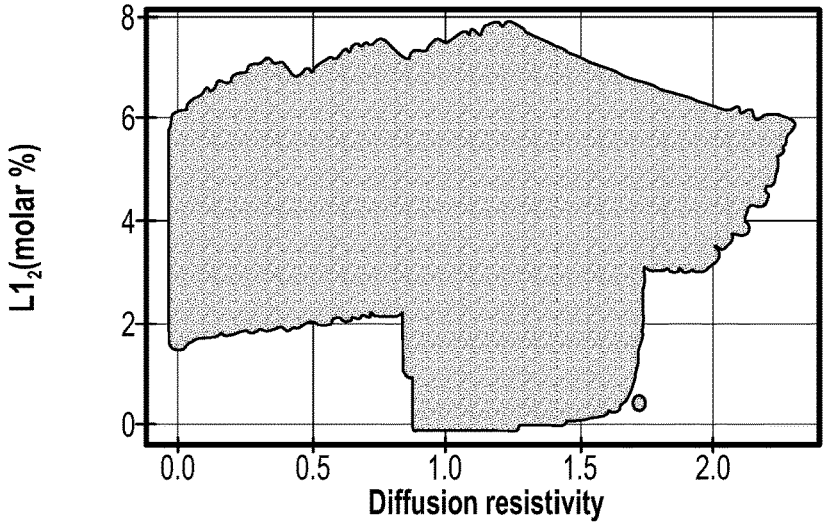
FIG. 74 is a plot of the molar concentrations of the $L1_2$ phase in the alloy compositions with the indicated diffusivity resistivity values.
Figure 75:
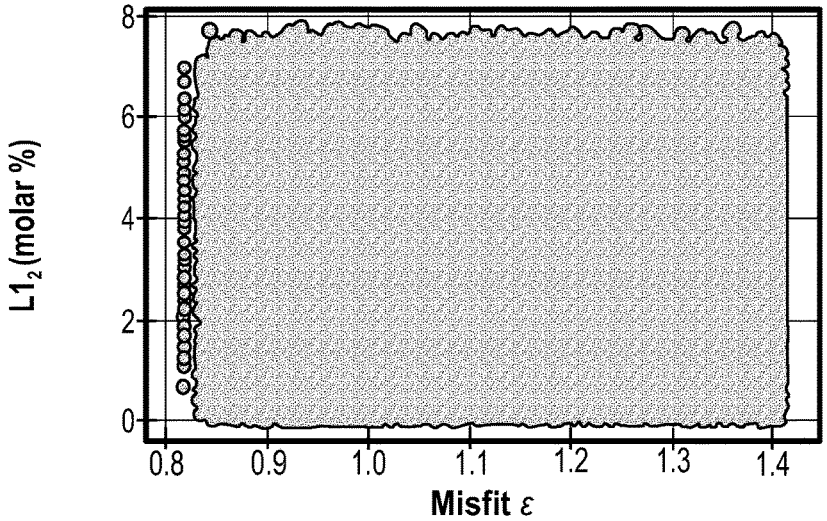
FIG. 75 is a plot of the molar concentrations of the $L1_2$ phase in the alloy compositions with the indicated misfit strain values at the phase interfaces in the alloy compositions formed from the random precursor sample compositions.
Figure 76:
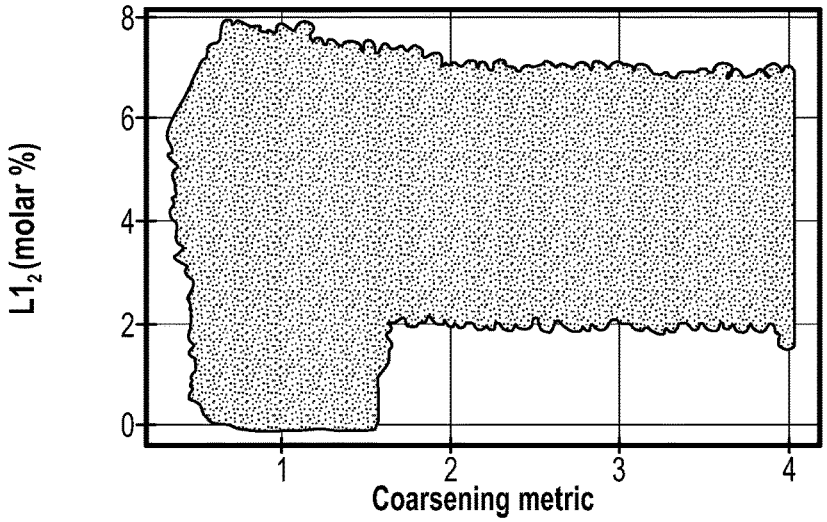
FIG. 76 is a plot of the molar concentrations of the $L1_2$ phase in the alloy compositions with the indicated coarsening metric of the $L1_2$ phase formed from the random precursor sample compositions.
Figure 77:
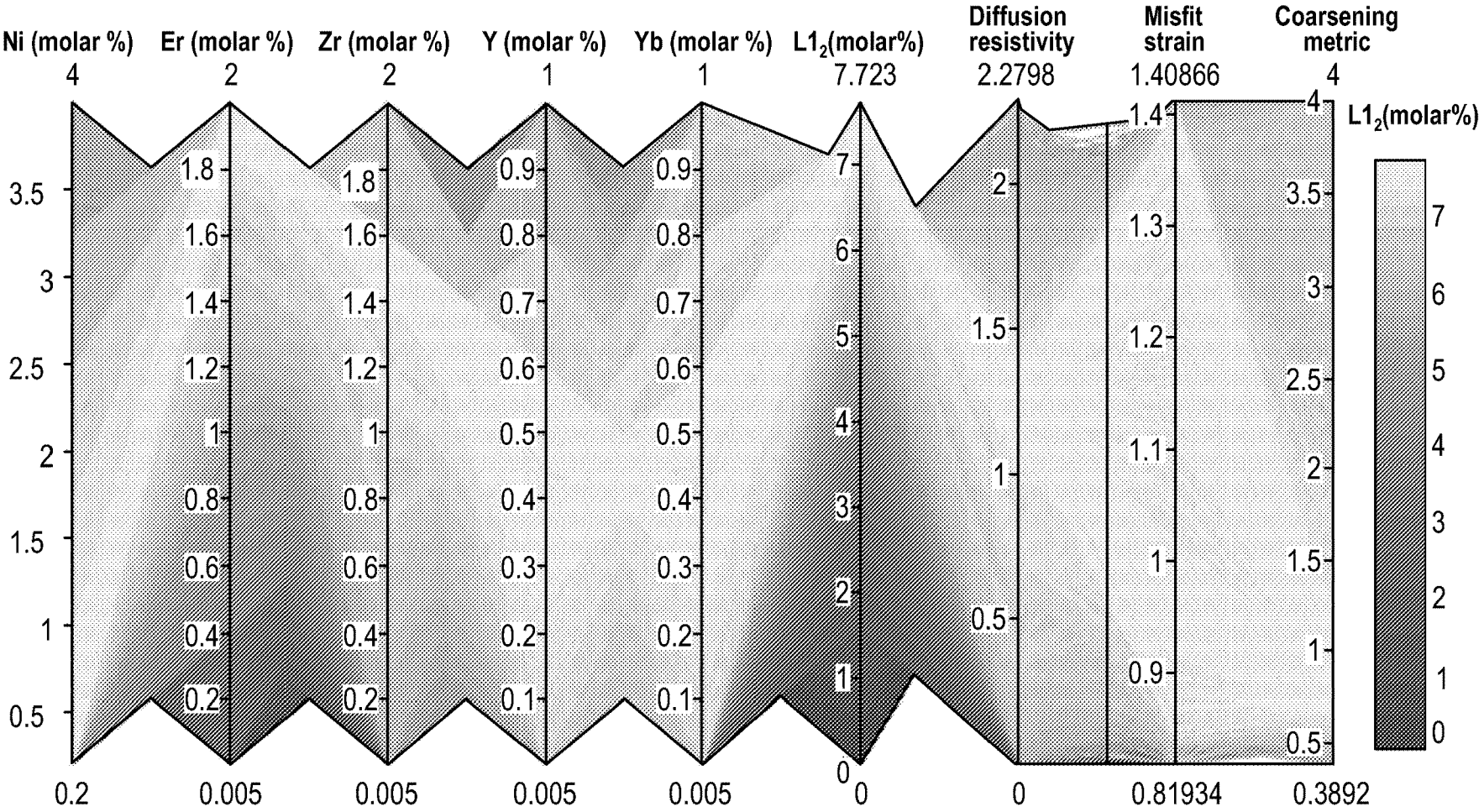
FIG. 77 is a parallel plot of design parameters, including molar values for the various elemental constituents and the $L1_2$ phase, the diffusion resistivity, the misfit strain, and the coarsening metric, wherein the molar concentrations of the $L1_2$ phase in the alloy are indicated by the shading.

Parallel plots of all studied parameters are shown in FIGS. 66-68. In FIG. 66, the shading reflects the diffusion resistivity. The lighter areas on the different axes show clearly that high amounts of zirconium and low amounts of ytterbium can increase the diffusion resistivity. FIG. 67 shows the parallel plot when the axes are shaded as a function of the misfit strain, ε. Zirconium here also decreases this parameter, and erbium is most influential in increasing misfit strain (ε). FIG. 68 shows the parallel plot when it is colored by the coarsening metric values. This plot shows that to have low coarsening metrics, we can add more zirconium. Having less erbium and ytterbium may also decrease the coarsening metrics. It should be noted that these shadings provide a global view of the problem; they provide no detail about the combinations of parameters. One may specify a target range for the coarsening metric, for example, and trim this distribution to produce more focused conclusions.

We also analyzed $L1_2$ molar % with respect to studied parameters. As shown in FIGS. 69-77, erbium has the maximum contribution for the increase of this phase. In contrast, an increase in nickel and yttrium decreases this phase.

Optional Additional Elements in Precursor Compositions:

The precursor compositions for forming the optimized aluminum alloy can also include a variety of other elements in addition to aluminum, nickel, erbium, zirconium, yttrium, and/or ytterbium. For example, the aluminum alloy can also include additional $L1_2$ phases with the composition $Al_3M$, wherein M is scandium (Sc), thulium (Tm), lutetium (Lu), uranium (U), and/or neptunium (NP). The aluminum alloy can also include molybdenum (Mo), which can also reduce the coarsening rate in the alloy, and/or magnesium (Mg), which can form a solid solution with aluminum. Further still, the alloy can include titanium (Ti), vanadium (V), iron (Fe), cobalt (Co), nickel (Ni), niobium (Nb), lanthanum (La), hafnium (Hf), tantalum (Ta), rhenium (Re), iridium (Ir), cerium (Ce), praseodymium (Pr), neodymium (Nd), promethium (Pm), samarium (Sm), gadolinium (Gd), terbium (Tb), dysprosium (Dy), holmium (Ho), thorium (Th), and/or plutonium (Pu).

Experiments on Laser-Scanned Induction-Melted Samples to Validate Printability and Precipitation Hardening:

For the experimental investigation of printability, we demonstrated an approach to assessing the development of hot cracks as a function of chemical composition. First, we scaled 9 batches determined via machine learning using an XPR analytical balance (from Mettler Toledo) with an accuracy of 0.005 mg. The purity of the raw elements utilized in this study was as follows: Al (99.99%), Ni (99.99%), Er (99.9%), and Zr (99.95%). The elements were employed in granulate shape (with <5 mm dimensions). For each batch, a total of 30 g was cast using a MC 20 V casting machine with an induction heating system (from Indutherm Erwärmungsanlagen GmbH) to ensure a homogeneous elemental distribution in the $Al_2O_3$ crucible.

Before heating, a vacuum was pumped to 0.1 mbar, reducing residual oxygen ($O_2$), then afterward flooded with argon (Ar) to normal pressure. The melting chamber was subsequently flooded with argon sequentially to avoid oxidation during melting. The overheating temperature of the melts was adjusted to 1,000° C., at which full melting of raw elements was achieved. The holding time at this melting temperature was set to 5 minutes. The castings solidified as rods with a length of approximately 60 mm and a diameter of 15 mm. These rods were rolled to obtain sheets. The roll gap was iteratively reduced over 10 steps to the desired thickness of 2 mm. During the rolling procedure, the specimens were heated to 100° C. to avoid edge cracking. Using this procedure, we obtained sheets with dimensions of $280\times35\times2$ $mm^3$. Because rolling caused the sheets to bend marginally, we performed a pressing step to produce flat sheets. The sheets were then laser scanned using an LT30 laser-based powder bed fusion machine (from DMG MORI). To ensure its performance and reliability, we generally calibrated the laser-based powder bed fusion machine according to ISO/ASTM DIS 52941:2019. This system is equipped with a solid-state Nd: YAG laser source with a wavelength of 1064 nm and a maximum laser power of 1000 W. Additionally, the laser beam had a Gaussian distribution with an adjusted laser focus of 70 μm. Regarding the atmosphere in the build chamber, Ar-4.6 was used to reduce a residual $O_2$ content to <1000 parts per million (ppm).

The baseplate temperature was set to room temperature and the baseplate was sprayed with boron nitride (BN) to avoid a potential joining of the sheets to the baseplate. The laser-based powder bed fusion processing parameters were used to ensure a deep penetration (~1.2 mm) by the laser. The following combination of process parameters was determined based on preliminary studies: scan speed 300 mm/s, hatch distance 170 μm, and laser power 400 W. A region of 200×25 $mm^2$ was laser-scanned employing a stripe-scanning strategy with a vector length of 8 mm to minimize warpage and residual stress in the aluminum sheets. Both sides of the sheets were laser scanned to ensure the rapid solidification of the microstructure throughout the processed volume. To validate the development of hot cracks during laser scanning, the specimens were extracted from the laser-exposed region. The cut specimens were conductively embedded, ground, and polished using a HEXAMATIC grinding and polishing machine (from Struers S.A.S.). Next, they were vibro-polished using a VIBROMET vibratory polisher (from Buehler) via colloidal suspension. Light micrographic images were then generated using a VHX 5000 digital microscope (from Keyence Corp.) to detect undesired process-induced defects.

The mechanical properties of the laser-scanned sheets as-built and aged for eight hours at 400° C. were analyzed. As part of this process, the micro-hardness of the sheets was measured using an FA 30 automatic Vickers hardness tester (from KB Prüftechnik) applying 100-gram force loading. We further performed Vickers hardness tests on an induction-melted sample of our final optimized design, wherein nickel=1.33 molar % and zirconium=1 molar %. In all of these tests, at least seven measurements were performed, with maxima and minima excluded.

3D-Printing of Custom Alloys:

The powder materials were ultrasonically atomized using an AUS500 atomizer (from Indutherm Blue Power). For the induction melting, an $Al_2O_3$ crucible was coated with hexagonal boron nitride paste to prevent the melt from reacting with the crucible material. The obtained particle size distribution was measured by laser diffraction. The particle size distribution for the optimized powder material was as follows: d10=44.5%, d50=63.8%, and d90=91.5%. The chemical composition of the powder material was measured for the optimized Al-2.47Ni-3.25Zr-2.38Er, which was detected via X-ray fluorescence measurement.

Subsequently, specimens were additively manufactured via laser-based powder bed fusion using an SLM 250 HL laser-beam melting system from SLM Solutions GmbH. This system has an Nd: YAG laser with a maximum laser power of 400 W operating at a wavelength of 1064 nm. We applied a Gaussian beam distribution with a laser beam diameter of 70 μm. The following processing parameters were employed: laser power=350 W, hatch distance=120 μm, scan speed=1100 mm/s, layer thickness=50 μm, scan strategy=8 mm stripes, and rotation of 67°. Regarding the build chamber conditions, a preheating temperature of 200° C. was selected; and during 3D-printing, Ar-4.6 was employed as an inert gas atmosphere with a residual 02-level of <1000 ppm. Additionally, before the laser-based powder bed fusion, the powder materials were vacuum dried to reduce their relative humidity by <5%. The printed specimen geometry had the dimensions of 6 $mm^3$ and 2 cm×6 mm×6 mm. The chemical composition of the printed optimized specimens was Al-2.55Ni-2.9Zr-2.37Er, as detected via an X-ray fluorescence measurement.

Microscopy and Mechanical Performance of 3D-Printed Samples:

Stem Characterization:

Scanning transmission electron microscopy (STEM) high-angle annular dark-field (HAADF) imaging and energy dispersive X-ray spectroscopy (EDS) confirms a microstructure having aluminum grains with 1-2 μm dimensions with grain boundary precipitates (having 20-50 nm dimensions) that are rich in nickel and erbium scattered throughout the aged sample, along with larger nickel-rich regions corresponding to the $Al_3Ni$ intermetallic (FIGS. 83-86). Atomic resolution imaging of these precipitates reveals a non-uniform composition and structure coherent with the "parent" grain, in this case imaged along a <110>-type zone (FIG. 21). Significant Z-contrast differences indicate the following two distinct structures, the relative chemical distribution of which are supported by EDS: type (1) in which single erbium-rich atomic planes are spaced by nickel- and aluminum-rich regions in FIG. 22, and type (2) in which erbium- and zirconium-rich planes are arranged in an $L1_2$-type ordering with aluminum (FIGS. 18-25). The differences in relative chemical compositions suggest that these structures correspond with the predicted Al—Ni—Er ternary and the Al—(Zr/Er) $L1_2$ phases, respectively, as shown by EDS maps in FIGS. 20 and 21. In addition, similar $L1_2$-type structures are found attached to or near the ternary phase for several of these grain boundary precipitates (FIGS. 19-21); combined with the expected transition from the ternary to the $L1_2$ phase during aging, this result suggests incomplete transformation.

In HAADF STEM images, the formation of sub-10-nm nanoprecipitates throughout the aluminum matrix is shown as well, confirming simulation results. Atomic-resolution images of the grain interior show alternating contrast in atomic planes consistent with $L1_2$-type ordering between higher Z and lower Z elements, with the Fourier transform of the image confirming the 001 superlattice reflections (FIGS. 22 and 23). In contrast with the grain boundary, the nickel concentration in the matrix is low, suggesting that these nanoprecipitates are primarily Al—Zr/Er, which has been confirmed by STEM EDS (FIGS. 24 and 25).

The mechanical properties of the as-built and aged 3D-printed optimized samples were analyzed. As part of this process, the micro-hardness of the sheets was measured using a Vickers hardness tester applying 100-gram force loading. The reported hardness is along the build directions and from the top surface of the samples. The samples were aged at 400° C. for various numbers of hours and their hardness was measured and compared with wrought 7075 aluminum alloy aged at identical conditions.

The as-built and aged tensile samples were cut using wire electrical-discharge machining (EDM). The thickness of the samples was 1.5 mm with a width of 7 mm, a length of 2.4 cm, a gauge length of 1 cm, and a gauge thickness of 3 mm. The samples were loaded at room temperature based on the ASTM E8 standard by the Westmoreland Company. The samples were deformed at a rate of 0.0178 cm/min. Optical extensometers were placed on opposite sides of each specimen to measure axial strain throughout testing.

Computer Implementation:

The methods and apparatus described herein can utilize a computer, operating as a system controller, in practicing the methods described herein. The computer can include a logic device, such as a microprocessor, microcontroller, programmable logic device or other suitable digital circuitry for executing the control algorithms or a networked combination of such devices; and the systems and methods of this disclosure can be implemented in a computing system environment. Examples of well-known computing system environments and components thereof that may be suitable for use with the systems and methods include, but are not limited to, personal computers, server computers, hand-held or laptop devices, tablet devices, smart phones, multiprocessor systems, microprocessor-based systems, set top boxes, programmable consumer electronics, network PCs, minicomputers, mainframe computers, distributed computing environments that include any of the above systems or devices, and the like. Typical computing system environments and their operations and components are described in many existing patents (e.g., U.S. Pat. No. 7,191,467, owned by Microsoft Corp.).

The methods may be carried out via non-transitory computer-executable instructions, such as program modules. Generally, program modules include routines, programs, objects, components, data structures, and so forth, that perform particular tasks or that implement particular types of data. The methods may also be practiced in distributed computing environments where tasks are performed by remote processing devices that are linked through a communications network. In a distributed computing environment, program modules may be located in both local and remote computer storage media including memory storage devices.

The processes and functions described herein can be non-transitorily stored in the form of software instructions in the computer. Components of the computer may include, but are not limited to, a computer processor, a computer storage medium serving as memory, and a system bus that couples various system components including the memory to the computer processor. The system bus can be of any of several types of bus structures including a memory bus or memory controller, a peripheral bus, and a local bus using any of a variety of bus architectures.

The computer typically includes one or more of a variety of computer-readable media accessible by the processor and including both volatile and nonvolatile media and removable and non-removable media. By way of example, computer-readable media can comprise computer-storage media and communication media.

The computer storage media can store the software and data in a non-transitory state and includes both volatile and nonvolatile, removable and non-removable media implemented in any method or technology for storage of software and data, such as computer-readable instructions, data structures, program modules or other data. Computer-storage media includes, but is not limited to, RAM, ROM, EEPROM, flash memory or other memory technology, solid-state memory, CD-ROM, digital versatile disks (DVD) or other optical disk storage, magnetic cassettes, magnetic tape, magnetic disk storage or other magnetic storage devices, or any other medium that can be used to store the desired information and that can accessed and executed by the processor.

The memory includes computer-storage media in the form of volatile and/or nonvolatile memory, such as read only memory (ROM) and random access memory (RAM). A basic input/output system (BIOS), containing the basic routines that help to transfer information between elements within the computer, such as during start-up, is typically stored in the ROM. The RAM typically contains data and/or program modules that are immediately accessible to and/or presently being operated on by the processor.

The computer may also include other removable/non-removable, volatile/nonvolatile computer-storage media, such as (a) a hard disk drive that reads from or writes to non-removable, nonvolatile magnetic media; (b) a magnetic disk drive that reads from or writes to a removable, nonvolatile magnetic disk; and (c) an optical disk drive that reads from or writes to a removable, nonvolatile optical disk such as a CD ROM or other optical medium. The computer-storage medium can be coupled with the system bus by a communication interface, wherein the interface can include, e.g., electrically conductive wires and/or fiber-optic pathways for transmitting digital or optical signals between components. Other removable/non-removable, volatile/nonvolatile computer storage media that can be used in the exemplary operating environment include magnetic tape cassettes, flash memory cards, digital versatile disks, digital video tape, solid-state RAM, solid-state ROM, and the like.

The drives and their associated computer-storage media provide storage of computer-readable instructions, data structures, program modules and other data for the computer. For example, a hard disk drive inside or external to the computer can store an operating system, application programs, and program data.

The computer can further include a network interface controller in communication with the processor and with an input/output device that communicates with external devices. The input/output device can include, e.g., input/output ports using electrically conductive wiring or wirelessly via, e.g., a wireless transmitter/receiver electrically connected with the system bus and in wireless communication with a wireless network router with which the external devices are also in communication.

In describing implementations, herein, specific terminology is used for the sake of clarity. For the purpose of description, specific terms are intended to at least include technical and functional equivalents that operate in a similar manner to accomplish a similar result. Additionally, in some instances where a particular implementation includes a plurality of system elements or method steps, those elements or steps may be replaced with a single element or step. Likewise, a single element or step may be replaced with a plurality of elements or steps that serve the same purpose. Further, where parameters for various properties or other values are specified herein for implementations, those parameters or values can be adjusted up or down by $1/100^{th}$, $1/50^{th}$, $1/20^{th}$, $1/10^{th}$, $1/5^{th}$, $1/3^{rd}$, $1/2$, $2/3^{rd}$, $3/4^{th}$, $4/5^{th}$, $9/10^{th}$, $19/20^{th}$, $49/50^{th}$, $99/100^{th}$, etc. (or up by a factor of 1, 2, 3, 4, 5, 6, 8, 10, 20, 50, 100, etc.), or by rounded-off approximations thereof or within a range of the specified parameter up to or down to any of the variations specified above (e.g., for a specified parameter of 100 and a variation of 1/100th, the value of the parameter may be in a range from 0.99 to 1.01), unless otherwise specified. Further still, where methods are recited and where steps/stages are recited in a particular order—with or without sequenced prefacing characters added for ease of reference—the steps/stages are not to be interpreted as being temporally limited to the order in which they are recited unless otherwise specified or implied by the terms and phrasing.

Additional examples consistent with the present teachings are set out in the following numbered clauses:

1. An aluminum alloy with high strength at high temperature, comprising:
   an aluminum matrix with a concentration of over 80 molar % aluminum; and
   $L1_2$ precipitate phases having a maximum dimension no greater than 20 nm in the aluminum matrix, the $L1_2$ precipitate phases having a formula of $Al_3M$, wherein M in the $L1_2$ precipitate phases comprises at least one of erbium and zirconium.

2. The aluminum alloy of clause 1, wherein the aluminum alloy comprises the following elements at the following molar percentages:
$x_{Al}$=at least 80% aluminum;
$x_{Ni}$=up to 2 molar % nickel;
$x_{Zr}$=0.1 to 1.5 molar % zirconium; and
$x_{Er}$=0.1 to 1 molar % erbium, wherein $x_{Er} \leq x_{Zr}$.
3. The aluminum alloy of clause 2, wherein the nickel is in the form of $Al_3Ni$ precipitate in the aluminum matrix.
4. The aluminum alloy of clause 2 or 3, wherein the aluminum alloy comprises the following molar percentages of the elements:
$x_{Ni}$=1.204 to 1.332 molar % nickel;
$x_{Zr}$=0.393 to 0.401 molar % erbium; and
$z_{Er}$=0.894 to 1.005 molar % zirconium.
5. The aluminum alloy of any of clauses 1-5, wherein the aluminum alloy further comprises at least one of yttrium and ytterbium.
6. The aluminum alloy of clause 5, wherein the yttrium and ytterbium are each present in a concentration of up to 0.1% in the aluminum alloy.
7. The aluminum alloy of any of clauses 1-6, wherein the aluminum alloy further comprises $L1_2$ phases comprising at least one of scandium (Sc), thulium (Tm), lutetium (Lu), uranium (U), and neptunium (NP).
8. The aluminum alloy of any of clauses 1-7, wherein the aluminum matrix comprises at least 90% aluminum.
9. The aluminum alloy of any of clauses 1-8, wherein the aluminum alloy is free of hot cracking.
10. The aluminum alloy of any of clauses 1-9, wherein the aluminum alloy has a surface hardness along its built direction of more than 150 HV (or more than 175 HV—in the range of cast 7075 aluminum alloy).
11. The aluminum alloy of clause 10, wherein the aluminum alloy retains its surface hardness along its built direction of more than 150 HV (or more than 195 HV) after at least 8 hours of aging at 400° C.
12. The aluminum alloy of any of clauses 1-11, wherein the aluminum alloy has a yield strength of at least 400 MPa.
13. The aluminum alloy of any of clauses 1-12, wherein the $L1_2$ phases have a maximum dimension in a range from 16-20 nm, which can optimize low creep performance of the alloy.
14. A method for fabricating an aluminum alloy, comprising:
heating a precursor composition to an elevated temperature above a solvus temperature at which the precursor composition is liquefied, the precursor composition comprising the following elements at the following molar percentages:
$x_{Al}$=at least 80% aluminum;
$x_{Ni}$=up to 2 molar % nickel;
$x_{Zr}$=0.1 to 1.5 molar % zirconium; and
$x_{Er}$=0.1 to 1 molar % erbium, wherein $x_{Er} \leq x_{Zr}$;
cooling the precursor composition from the elevated temperature at a cooling rate of at least 100 K/s to precipitate ternary phases having a formula of $Al_xNi_yM_z$ in an aluminum matrix comprising over 80% aluminum via rapid solidification; and
aging the aluminum alloy at a temperature below the solvus temperature to form $L1_2$ phases having a formula of $Al_3M$ from the ternary phases to produce the aluminum alloy, wherein M in both the ternary phases and the $L1_2$ phases comprises erbium and zirconium, and wherein the $L1_2$ phases have dimensions no greater than 20 nm after aging the aluminum alloy.
15. The method of clause 14, wherein the precursor composition is provided as a powder, the method further comprising repeatedly depositing successive layers of the precursor composition powder, wherein selected locations of each layer are heated to the elevated temperature with a laser or an electron beam to form the ternary phases in the selected locations before the next layer of the precursor composition powder is deposited.
16. The method of clause 14, further comprising depositing and heating the precursor composition to the elevated temperature via directed energy deposition.
17. The method of clause 14, further comprising depositing and heating the precursor composition to the elevated temperature in a process selected from a welding process, wire arc additive manufacturing, wire laser additive manufacturing, splat quenching, and giga casting.
18. A precursor composition for fabricating an aluminum alloy, comprising:
$x_{Al}$=at least 80% aluminum;
$x_{Ni}$=up to 2 molar % nickel;
$x_{Zr}$=0.1 to 1.5 molar % zirconium; and
$x_{Er}$=0.1 to 1 molar % erbium, wherein $x_{Er} \leq x_{Zr}$.
19. The precursor composition of clause 18, further comprising at least one of yttrium and ytterbium.
20. The precursor composition of clause 18, wherein the precursor composition comprises yttrium and ytterbium at a combined molar concentration up to 0.1%.
21. A computer-implemented method for formulating a composition and processing parameters, comprising:
obtaining a set of rules that define formation of phases, compositions, and microstructure features when forming a product composition from a precursor composition, wherein the rules utilize or generate values for:
parameters according to which the precursor composition is processed;
a coarsening metric reflecting a rate of phase growth based on precursor composition and the processing parameters;
combined diffusivity of elements across the precursor composition and phases formed therefrom;
misfit strain produced by misalignment of crystalline structures at phase interfaces; and
volume fraction of phases during solidification and in as-built and aged conditions, and a coarsening metric, wherein the set of rules includes evaluation of combined diffusivity across the precursor composition and phases formed therefrom and evaluation of misfit strain;
using a computing device, applying calculation-of-phase-diagram-(CALPHAD) based integrated-computational-materials-engineering (ICME) methods combined with machine-learning techniques to simulate production of product compositions from a plurality of different precursor compositions using the set of rules and evaluating a combination of material properties of the product compositions;
based on the evaluated material properties, identifying a selected precursor composition with an optimized value for the combination of material properties; and generating an output identifying the selected precursor composition with the optimized value for the combination of material properties.

22. The computer-implemented method of clause 21, wherein the evaluated material properties include coarsening metric, strength, crack- or defect-free manufacturing, high-temperature strength, microstructural stability at high temperature, creep resistance, and ductility.

23. The computer-implemented method of clause 21 or 22, wherein the product composition is an aluminum alloy including an $L1_2$ phase.

24. The computer-implemented method of any of clauses 21-23, further comprising forming a tangible embodiment of the precursor composition that substantially matches the selected precursor composition.

25. The computer-implemented method of any of clauses 21-24, further comprising applying different processing conditions to the CALPHAD ICME methods in the simulated production of product compositions.

26. The computer-implemented method of clause 25, wherein the processing conditions comprise at least one of:

processing and aging time and temperature; and variability of processing environment conditions.

27. The computer-implemented method of clause 25 or 26, wherein the computing device, in performing its evaluation, uses at least one technique selected from a convolutional neural network, K-nearest-neighbors, support vector machine, random forest, extreme gradient boost, and linear regression.

28. The computer-implemented method of any of clauses 21-27, further comprising using the computing device to apply inverse design techniques to work backward from targeted material properties to select at least one of a precursor composition and processing parameters for producing a product composition that possesses the targeted material properties.

29. The computer-implemented method of clause 28, wherein the inverse design techniques include at least one technique selected from particle swarm optimization and Bayesian optimization.

28. A non-transitory computer-readable medium that stores instructions that when executed by a processor, performs the following steps:

applying a set of rules that define formation of phases, compositions, and microstructure features when forming a product composition from a precursor composition, wherein the rules utilize or generate values for:

parameters according to which the precursor composition is processed;

a coarsening metric reflecting a rate of phase growth based on precursor composition and processing parameters;

combined diffusivity of elements across the precursor composition and phases formed therefrom;

misfit strain produced by misalignment of crystalline structures at phase interfaces; and volume fraction of phases during solidification and in as-built and aged conditions, and a coarsening metric, wherein the set of rules includes evaluation of combined diffusivity across the precursor composition and phases formed therefrom and evaluation of misfit strain;

using the set of rules that define formation of phases, compositions, and microstructure features, simulating production of product compositions from a plurality of different precursor compositions using the set of rules and evaluating a combination of material properties of the product compositions;

based on the evaluated material properties, identifying a selected precursor composition with an optimized value for the combination of material properties; and generating an output identifying the selected precursor composition with the optimized value for combination of material properties.

While this invention has been shown and described with references to particular implementations thereof, those skilled in the art will understand that various substitutions and alterations in form and details may be made therein without departing from the scope of the invention. Further still, other aspects, functions, and advantages are also within the scope of the invention; and all implementations of the invention need not necessarily achieve all of the advantages or possess all of the characteristics described above. Additionally, steps, elements, and features discussed herein in connection with one implementation can likewise be used in conjunction with other implementations. The contents of references, including reference texts, journal articles, patents, patent applications, etc., cited throughout the text are hereby incorporated by reference in their entirety for all purposes; and all appropriate combinations of implementations, features, characterizations, and methods from these references and the present disclosure may be included in implementations of this invention. Still further, the components and steps identified in the Background section are integral to this disclosure and can be used in conjunction with or substituted for components and steps described elsewhere in the disclosure within the scope of the invention.

What is claimed is:

1. A computer-implemented method for formulating a composition and processing parameters, comprising:

obtaining a set of rules that define formation of phases, compositions, and microstructure features when forming a product composition from a precursor composition, wherein the rules utilize or generate values for:

parameters according to which the precursor composition is processed;

a coarsening metric reflecting a rate of phase growth based on precursor composition and the processing parameters;

combined diffusivity of elements across the precursor composition and phases formed therefrom;

misfit strain produced by misalignment of crystalline structures at phase interfaces; and volume fraction of phases during solidification and in as-built and aged conditions, and a coarsening metric, wherein the set of rules includes evaluation of combined diffusivity across the precursor composition and phases formed therefrom and evaluation of misfit strain;

using a computing device, applying calculation-of-phase-diagram-(CALPHAD) based integrated-computational-materials-engineering (ICME) methods combined with machine-learning techniques to simulate production of product compositions from a plurality of different precursor compositions using the set of rules and evaluating a combination of material properties of the product compositions;

based on the evaluated material properties, identifying a selected precursor composition with an optimized value for the combination of material properties; and generating an output identifying the selected precursor composition with the optimized value for the combination of material properties.

2. The computer-implemented method of claim 1, wherein the evaluated material properties include coarsening metric, strength, crack-or defect-free manufacturing, high-temperature strength, microstructural stability at high temperature, creep resistance, and ductility.

3. The computer-implemented method of claim 1, wherein the product compositions include an aluminum alloy including an L12 phase.

4. The computer-implemented method of claim 1, further comprising forming a tangible embodiment of the precursor composition that substantially matches the selected precursor composition.

5. The computer-implemented method of claim 1, further comprising applying different processing conditions to the CALPHAD ICME methods in the simulated production of product compositions.

6. The computer-implemented method of claim 5, wherein the processing conditions comprise at least one of:

processing and aging time and temperature; and variability of processing environment conditions.

7. The computer-implemented method of claim 5, wherein the computing device, in performing its evaluation, uses at least one technique selected from a convolutional neural network, K-nearest-neighbors, support vector machine, random forest, extreme gradient boost, and linear regression.

8. The computer-implemented method of claim 1, further comprising using the computing device to apply inverse design techniques to work backward from targeted material properties to select at least one of a precursor composition and processing parameters for producing a product composition that possesses the targeted material properties.

9. The computer-implemented method of claim 8, wherein the inverse design techniques include at least one technique selected from particle swarm optimization and Bayesian optimization.

10. A non-transitory computer-readable medium that stores instructions that when executed by a processor, performs the following steps:

applying a set of rules that define formation of phases, compositions, and microstructure features when forming a product composition from a precursor composition, wherein the rules utilize or generate values for:

parameters according to which the precursor composition is processed;

a coarsening metric reflecting a rate of phase growth based on precursor composition and processing parameters;

combined diffusivity of elements across the precursor composition and phases formed therefrom;

misfit strain produced by misalignment of crystalline structures at phase interfaces; and volume fraction of phases during solidification and in as-built and aged conditions, and a coarsening metric, wherein the set of rules includes evaluation of combined diffusivity across the precursor composition and phases formed therefrom and evaluation of misfit strain;

using the set of rules that define formation of phases, compositions, and microstructure features, simulating production of product compositions from a plurality of different precursor compositions using the set of rules and evaluating a combination of material properties of the product compositions;

based on the evaluated material properties, identifying a selected precursor composition with an optimized value for the combination of material properties; and generating an output identifying the selected precursor composition with the optimized value for the combination of material properties.

* * * * *